US010399344B2

(12) United States Patent
Mizutani et al.

(10) Patent No.: US 10,399,344 B2
(45) Date of Patent: Sep. 3, 2019

(54) LIQUID CONTAINER

(71) Applicant: Seiko Epson Corporation, Tokyo (JP)

(72) Inventors: Tadahiro Mizutani, Shiojiri (JP); Ryoichi Tanaka, Shiojiri (JP); Taku Ishizawa, Matsumoto (JP); Atsushi Kobayashi, Matsumoto (JP); Koichi Toba, Shiojiri (JP); Yoshiaki Shimizu, Matsumoto (JP); Shun Oya, Kiso-Gun (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 15/728,143

(22) Filed: Oct. 9, 2017

(65) Prior Publication Data

US 2018/0099506 A1 Apr. 12, 2018

(30) Foreign Application Priority Data

Oct. 12, 2016 (JP) ..... 2016-200661

(51) Int. Cl.
*B41J 2/175* (2006.01)
*B41J 2/19* (2006.01)

(52) U.S. Cl.
CPC ..... *B41J 2/17513* (2013.01); *B41J 2/19* (2013.01); *B41J 2/17523* (2013.01); *B41J 2/17553* (2013.01); *B41J 2/17556* (2013.01)

(58) Field of Classification Search
USPC ..... 347/86
See application file for complete search history.

(56) References Cited

U.S. PATENT DOCUMENTS

| | | | | |
|---|---|---|---|---|
| 5,509,140 | A | 4/1996 | Koitabashi et al. | |
| 5,929,885 | A | 7/1999 | Nakajima et al. | |
| 6,257,712 | B1 | 7/2001 | Haigo | |
| 6,957,882 | B2 * | 10/2005 | Wouters | B41J 2/17513 347/86 |
| 9,308,735 | B2 | 4/2016 | Nozawa et al. | |
| 2014/0009539 | A1 | 1/2014 | Nozawa et al. | |
| 2014/0022316 | A1 | 1/2014 | Nozawa et al. | |

FOREIGN PATENT DOCUMENTS

| | | | |
|---|---|---|---|
| JP | H06-040041 | A | 2/1994 |
| JP | H06-226989 | A | 8/1994 |
| JP | H11-058772 | A | 3/1999 |

(Continued)

*Primary Examiner* — Lam S Nguyen
(74) *Attorney, Agent, or Firm* — Foley & Lardner LLP

(57) ABSTRACT

A liquid container comprises a liquid supply port provided in a bottom wall, a first chamber configured to contain a liquid, a second chamber configured to contain the liquid and to include at least one sub-chamber having a smaller dimension in the X direction than that of the first chamber, a partition wall configured to part the first chamber from the second chamber, and a connecting hole configured to connect the first chamber with the second chamber. The second chamber is connected with the liquid supply port, and the first chamber is connected with the liquid supply port via the connecting hole and the second chamber. The liquid contained in the first chamber is flowed from the connecting hole into the second chamber and is subsequently introduced through the sub-chamber to the liquid supply port.

6 Claims, 53 Drawing Sheets

(56) References Cited

FOREIGN PATENT DOCUMENTS

| | | | |
|---|---|---|---|
| JP | H11-198393 | A | 7/1999 |
| JP | 3807115 | B2 | 8/2006 |
| JP | 2011-110877 | A | 6/2011 |
| JP | 2014-014947 | A | 1/2014 |
| JP | 2014-019117 | A | 2/2014 |
| JP | 2014-040080 | A | 3/2014 |

* cited by examiner

LIQUID CONTAINER

CROSS-REFERENCE TO RELATED APPLICATION

The present application claims priority from Japanese patent application No. 2016-200661 filed on Oct. 12, 2016, the entirety of the content of which is hereby incorporated by reference into this application.

BACKGROUND

Field

The disclosure relates to a liquid container configured to contain a liquid such as ink.

Related Art

JP2014-40080A, JPH06-40041A and JP3807115B disclose various printers using ink tanks configured such that the air is introduced into an ink chamber. The printers described in JP2014-40080A and JPH06-40041A are "on-carriage type" printers in which an ink tank is mounted on a holder of a carriage that moves a print head. The printer described in JP3807115B is an "off-carriage type" printer in which an ink tank is not mounted on a carriage but is placed at a stationary position.

SUMMARY

In these various printers, there is a possibility that air bubbles are mixed in ink that is supplied from the ink tank. The inflow of air bubbles to the print head is likely to cause a printing failure. This problem may be especially remarkable in the ink tank mounted to the on-carriage type printer like that of JP2014-40080A and JPH06-40041A, because ink in an ink chamber ripples during reciprocation of the carriage and is likely to be mixed with the air to produce air bubbles. This problem is not characteristic of the ink tank configured to introduce the air into the ink chamber but may arise when a certain amount of the air is present in the ink chamber. This problem is more likely to arise in an ink tank having a large size of ink chamber. This problem is not limited to the printer but is commonly found in liquid containers configured to contain other types of liquids and liquid ejection apparatuses using such liquid containers.

In order to solve at least part of the problems described above, the disclosure may be implemented by aspects or configurations described below.

(1) According to an aspect of the disclosure, there is provided a liquid container configured to be mounted to a carriage that reciprocates in an X direction. The liquid container comprises: an upper wall and a bottom wall opposed to each other in a Z direction that crosses the X direction; a first side wall and a second side wall opposed to each other in a Y direction that crosses the X direction and the Z direction; a third side wall and a fourth side wall opposed to each other in the X direction; a liquid supply port provided in the bottom wall; a first chamber configured to contain a liquid therein; a second chamber configured to contain the liquid therein and to include at least one sub-chamber having a smaller dimension in the X direction than a dimension in the X direction of the first chamber; a partition wall configured to part the first chamber from the second chamber; and a connecting hole configured to connect the first chamber with the second chamber. The second chamber is connected with the liquid supply port, and the first chamber is connected with the liquid supply port via the connecting hole and the second chamber. The liquid contained in the first chamber is flowed from the connecting hole into the second chamber and is subsequently introduced through the sub-chamber to the liquid supply port.

In the liquid container of this aspect, the liquid is supplied to the liquid supply port after passing through the sub-chamber having the smaller dimension in the X direction. The small dimension of the sub-chamber in the X direction suppresses the ripple of the liquid and thereby suppresses production of air bubbles. The flow path configuration that the liquid passes through the sub-chamber to reach the liquid supply port provides such an advantageous effect that air bubbles are unlikely to reach the liquid supply port.

(2) In the above aspect, the first chamber may be provided with an air introducing hole configured to introduce air from outside of the first chamber into the first chamber.

In this configuration, even when air bubbles are produced in the first chamber, it is unlikely that the air bubbles reach the liquid supply port because the first chamber is not directly in fluid communication with the liquid supply port.

(3) In the above aspect, the second chamber may include two or more sub-chambers, and the two or more sub-chambers may be arrayed in the X direction.

In this configuration, the ripple of the liquid in the second chamber is further suppressed because the sub-chambers are arrayed in the direction of reciprocation of the carriage, thereby suppressing production of air bubbles.

(4) In the above aspect, a rib extended in the Z direction may be provided between bottoms of adjoining sub-chambers among the two or more sub-chambers.

In this configuration, when the liquid contains a sedimentation component (for example, pigment), a liquid having an excessively high concentration of the sedimentation component will be trapped by the rib, thereby stabilizing the concentration of the liquid that is supplied from the liquid supply port.

(5) In the above aspect, the second chamber may include three or more sub-chambers and may be configured such that the liquid in a specific sub-chamber among the three or more sub-chambers which is nearest to the connecting hole is consumed first and the liquid in another specific sub-chamber among the three or more sub-chambers which is nearest to an outlet of the liquid from the second chamber is consumed last.

In this configuration, even when air bubbles are produced, it is unlikely that the air bubbles reach the liquid supply port because the liquid in the specific sub-chamber which is nearest to the outlet of the liquid from the second chamber is consumed last.

(6) In the above aspect, the connecting hole may be provided at a position which is nearer to one of the third side wall and the fourth side wall than a middle position between the third side wall and the fourth side wall in the X direction, and an outlet of the liquid from the second chamber may be provided at a position which is nearer to the other of the third side wall and the fourth side wall than the middle position between the third side wall and the fourth side wall in the X direction.

This configuration increases the distance between the connecting port that is an inlet of the liquid into the second chamber and the outlet of the liquid from the second chamber. This accordingly gives a relatively long flow path from the first chamber to the liquid supply port and thereby makes it unlikely that air bubbles reach the liquid supply port.

(7) In the above aspect, a connecting flow path may be provided between the liquid supply port and an outlet of the liquid from the second chamber to connect the liquid supply port with the outlet.

In this configuration, the presence of the connecting flow path further lengthens the flow path from the first chamber to the liquid supply port and thereby makes it more unlikely that air bubbles reach the liquid supply port. It is preferable that the connecting flow path is extended from the other side wall toward the one side wall. In this configuration, the connecting flow path is provided so as to turn a flow path from the connecting hole to the outlet of the second chamber, thereby further lengthening the flow path.

(8) In the above aspect, an outflow portion of the liquid from the sub-chamber may be provided at a position which is nearer to the bottom wall than a position of half a height of the sub-chamber in the Z direction.

This configuration gives a structure that is unlikely to interfere with the flow of the liquid.

(9) In the above aspect, a dimension of the sub-chamber in the Y direction may be larger than a dimension of the sub-chamber in the X direction.

This configuration enables a larger volume of the liquid to be contained, while suppressing the ripple of the liquid in the sub-chamber.

(10) In the above aspect, a dimension of the sub-chamber in the Z direction may be larger than a dimension of the sub-chamber in the X direction.

This configuration enables a larger volume of the liquid to be contained, while suppressing the ripple of the liquid in the sub-chamber.

(11) In the above aspect, a dimension of the sub-chamber in the Z direction may be smaller than a dimension of the sub-chamber in the X direction.

This configuration enables the sub-chamber to serve as a trap flow path of air bubbles.

(12) In the above aspect, a position of an inlet of the liquid into the sub-chamber may differ from a position of an outlet of the liquid from the sub-chamber in at least one direction among the X direction, the Y direction and the Z direction.

This configuration enables the flow path from the inlet to the outlet of the sub-chamber to serve as a trap flow path (or labyrinth flow path) of air bubbles.

(13) In the above aspect, the liquid supply port may be provided in plurality, and the liquid flowing out from the second chamber is introduced through branch flow paths to the plurality of liquid supply ports.

This configuration splits the liquid into the branch flow paths immediately before the liquid supply port and accordingly reduces the possibility that a concentration difference arises in the liquid that is supplied from the respective liquid supply ports.

The present disclosure may be implemented by various aspects other than the aspects of the liquid container described above, for example, a liquid supply system, a cartridge, a liquid ejection apparatus and a printing apparatus.

DESCRIPTION OF EMBODIMENTS

Embodiments of the present disclosure are described below in the following sequence:

A. Configuration of Liquid Supply System According to First Embodiment
B. Configuration of Large-Size Cartridge
C. Configuration of Small-Size Cartridge
D. Other Embodiments
E. Modifications

A. Configuration of Liquid Supply System According to First Embodiment

Figure 1:
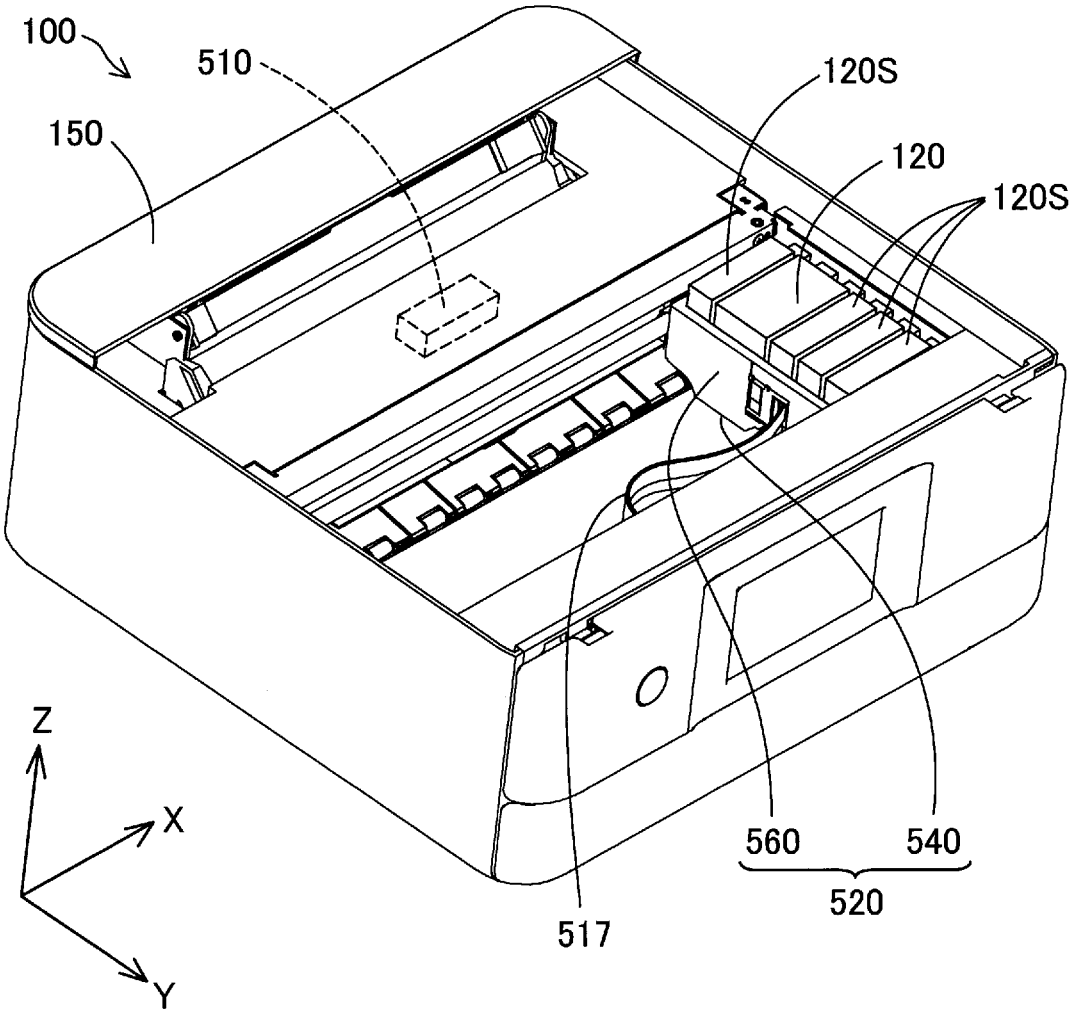
FIG. 1 is a perspective view illustrating the schematic configuration of a liquid supply system.

FIG. 1 is a perspective view illustrating the schematic configuration of a liquid supply system 100 according to a first embodiment. X, Y and Z axes that are orthogonal to one another are illustrated in FIG. 1. The X, Y and Z axes of FIG. 1 correspond to X, Y and Z axes of the other drawings. The liquid supply system 100 includes cartridges 120 and 120S as liquid containers and a printer 150 as a liquid ejection apparatus. In the liquid supply system 100, the cartridges 120 and 120S are mountable to a carriage 520 of the printer 150 by the user. In this illustrated example, the large-size cartridge 120 and the small-size cartridges 120S are mounted. In this embodiment, "liquid" denotes ink.

The cartridge 120 or 120S of the liquid supply system 100 is configured to contain ink as a printing material (or liquid) inside thereof. The ink contained in the cartridge 120 or 120S is supplied to a liquid ejection head 540 via a liquid supply port and a liquid introducing portion. In this embodiment, one large-size cartridge 120 and four small-size cartridges 120S are detachably mountable to a holder 560 of the printer 150. The respective cartridges 120 and 120S contain different types of inks. The types of inks contained and the number of cartridges may be changed arbitrarily. For example, only the small-size cartridge 120S may be mounted to the holder 560 or only the large-size cartridge 120S may be mounted to the holder 560.

The printer 150 is a small-size inkjet printer for personal use. The printer 150 includes a controller 510 and the carriage 520. The carriage 520 includes a liquid ejection head 540 and the holder 560. The printer 150 causes the inks to flow from the cartridges 120 and 120S mounted to the holder 560 through the liquid introducing portion (described later) to the liquid ejection head 540 and to be ejected (or supplied) from the liquid ejection head 540 onto a printing medium such as a sheet or paper or a label. This configuration prints characters, graphic, images and the like on the printing medium by using the liquid ejection head 540.

The controller 510 of the printer 150 controls the respective portions of the printer 150. The carriage 520 of the printer 150 is configured to move the liquid ejection head 540 relative to the printing medium. The liquid ejection head 540 of the printer 150 includes a liquid ejection mechanism configured to eject the liquids contained in the cartridges 120 and 120S onto the printing medium. The controller 510 and the carriage 520 are electrically interconnected by a flexible cable 517, and the liquid ejection mechanism of the liquid ejection head 540 operates, in response to control signals from the controller 510.

In this embodiment, the carriage 520 is provided with the holder 560 as well as the liquid ejection head 540. This type of printer 150 with the cartridges 120 and 120S mounted to the holder 560 on the carriage 520 that is configured to move the liquid ejection head 540 is called "on-carriage type". In another embodiment, a stationary, fixed holder 560 may be provided at a different position from the carriage 520, and the inks from the cartridges 120 and 120S mounted to the holder 560 may be supplied to the liquid ejection head 540 of the carriage 520 through a flexible tube. This type of printer is called "off-carriage type".

The printer 150 includes a main scanning feed mechanism and a sub-scanning feed mechanism configured to move the carriage 520 and the printing medium relative to each other to implement the printing on the printing medium. The main scanning feed mechanism of the printer 150 includes a carriage motor and a drive belt and is configured to transmit the power of the carriage motor via the drive belt to the carriage 520 and thereby reciprocate the carriage 520 in a main scanning direction. The sub-scanning feed mechanism of the printer 150 includes a feed motor and a platen and is configured to transmit the power of the feed motor to the platen and thereby feed the printing medium in a sub-scanning direction that is orthogonal to the main scanning direction. The carriage motor of the main scanning feed mechanism and the feed motor of the sub-scanning feed mechanism operate in response to control signals from the controller 510.

In this embodiment, in the use state (also called "use attitude") of the liquid supply system 100, an axis along the main scanning direction (left-right direction) in which the carriage 520 is reciprocated is specified as X axis; an axis along the sub-scanning direction (front-back direction) in which the printing medium is fed is specified as Y axis; and an axis along the direction of gravity (top-bottom direction) is specified as Z-axis. The use state of the liquid supply system 100 herein denotes the state of the liquid supply system 100 placed on a horizontal plane, and the horizontal plane denotes a plane parallel to the X axis and the Y axis (or XY plane). The sub-scanning direction (forward direction) is +Y direction and its reverse direction (backward direction) is −Y direction; a direction from the bottom to the top along the direction of gravity (upward direction) is +Z direction, and its reverse direction (downward direction) is −Z direction. A +Y direction side (front side) forms a front face of the liquid supply system 100. In this embodiment, a direction from a left side face to a right side face of the liquid supply system 100 is +X direction (right ward direction), and its reverse direction is −X direction (leftward direction).

A direction along the X axis (left-right direction) is also called "X direction", and a direction along the Z axis (top-bottom direction) is also called "Z direction". In this embodiment, the direction of array of the cartridges 120 and 120S mounted to the holder 560 is Y direction. In other words, the cartridges 120 and 120S are arrayed on the carriage 520 in a direction (Y direction) perpendicular to the direction in which the carriage 520 moves (X direction).

Figure 2:
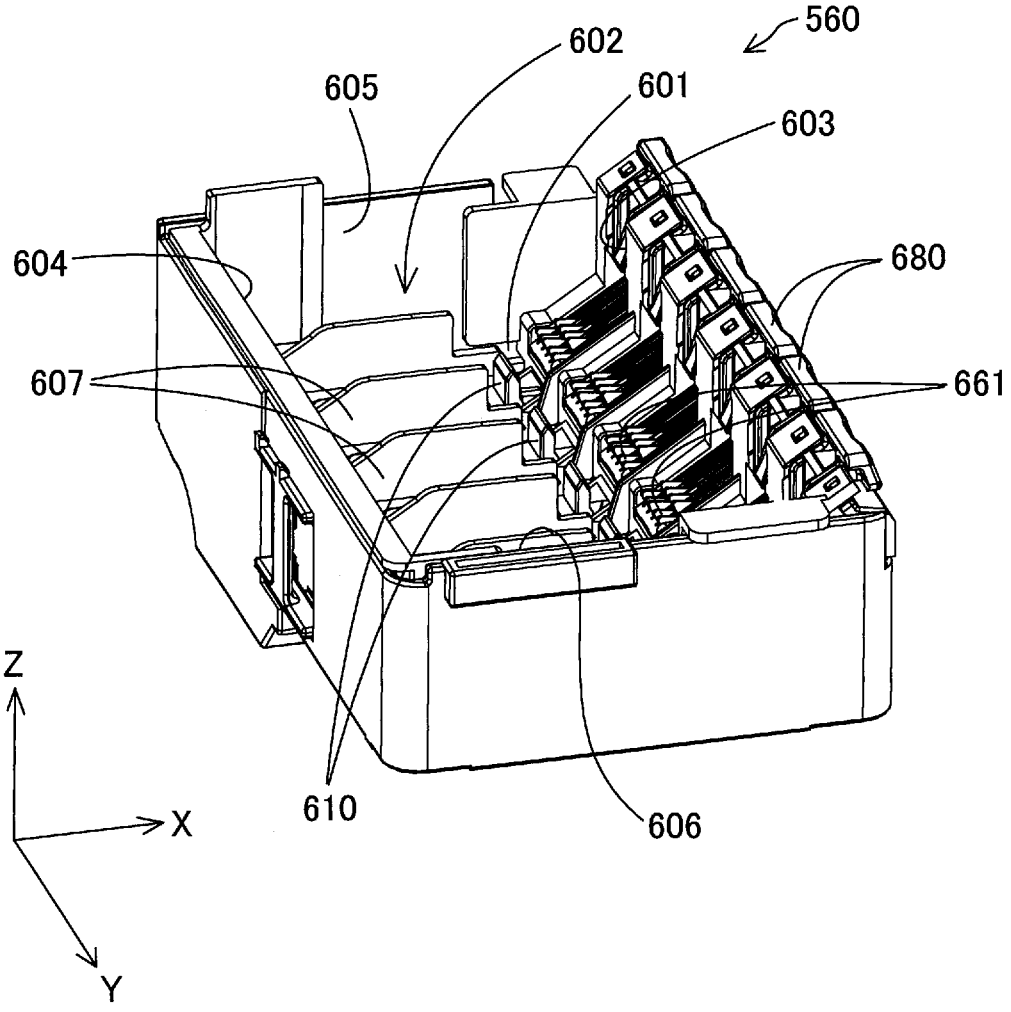
FIG. 2 is a perspective view illustrating a holder.
Figure 3:
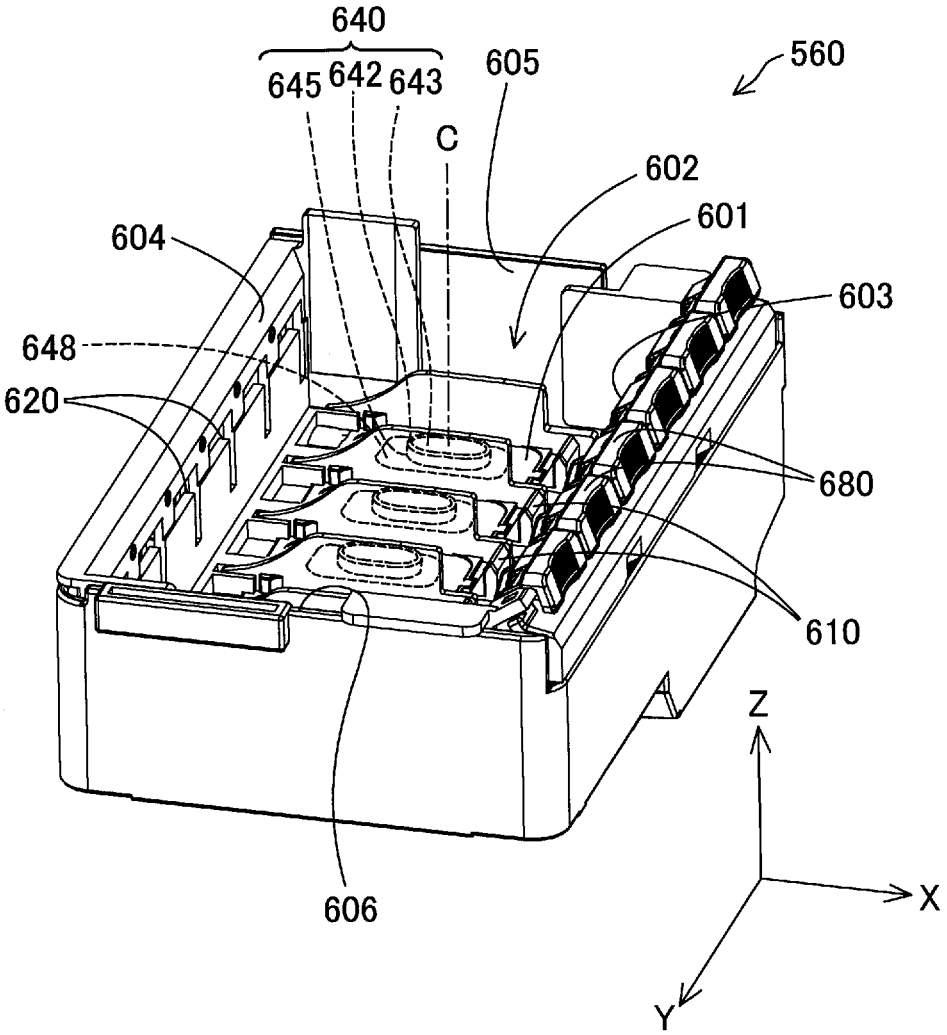
FIG. 3 is a perspective view illustrating the holder.
Figure 4:
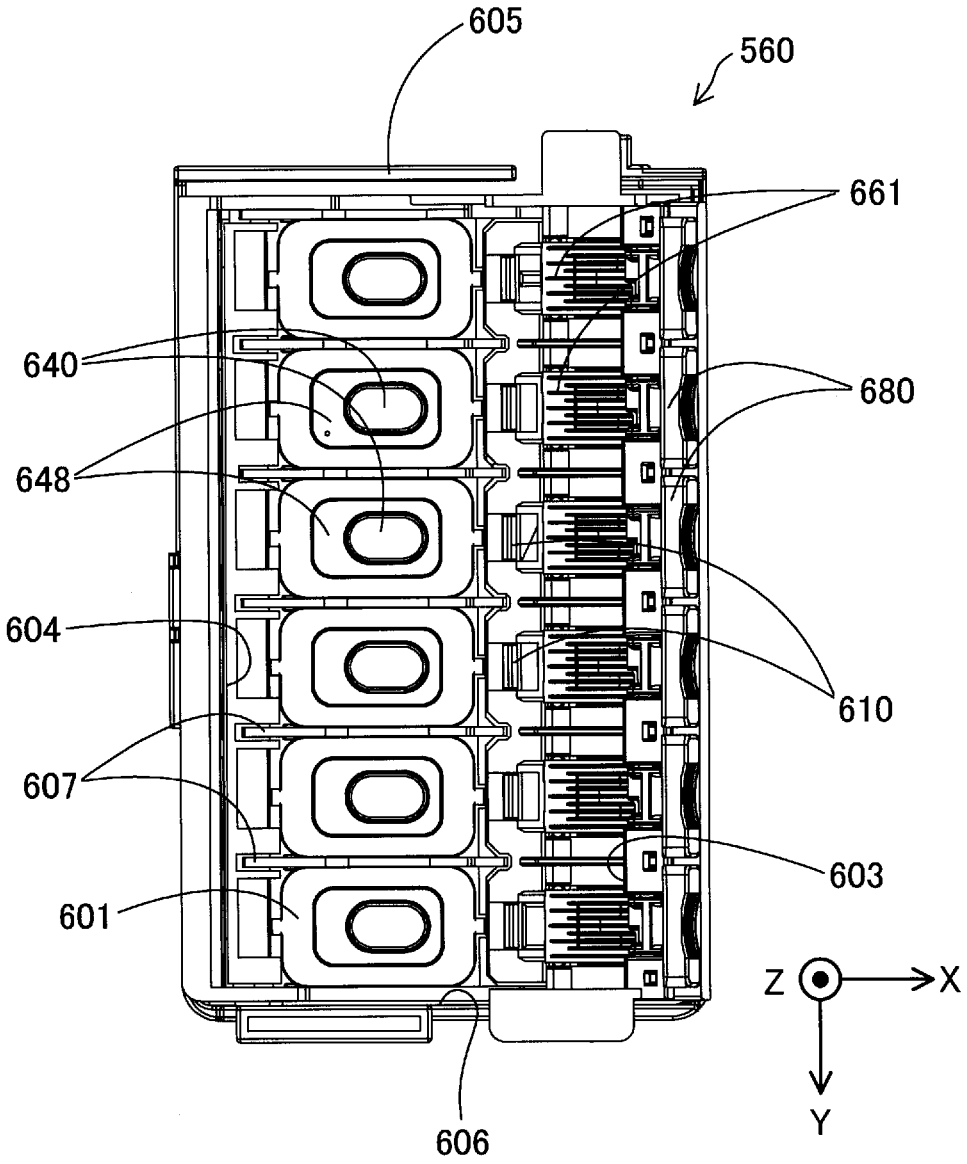
FIG. 4 is a plan view illustrating the holder.
Figure 5:
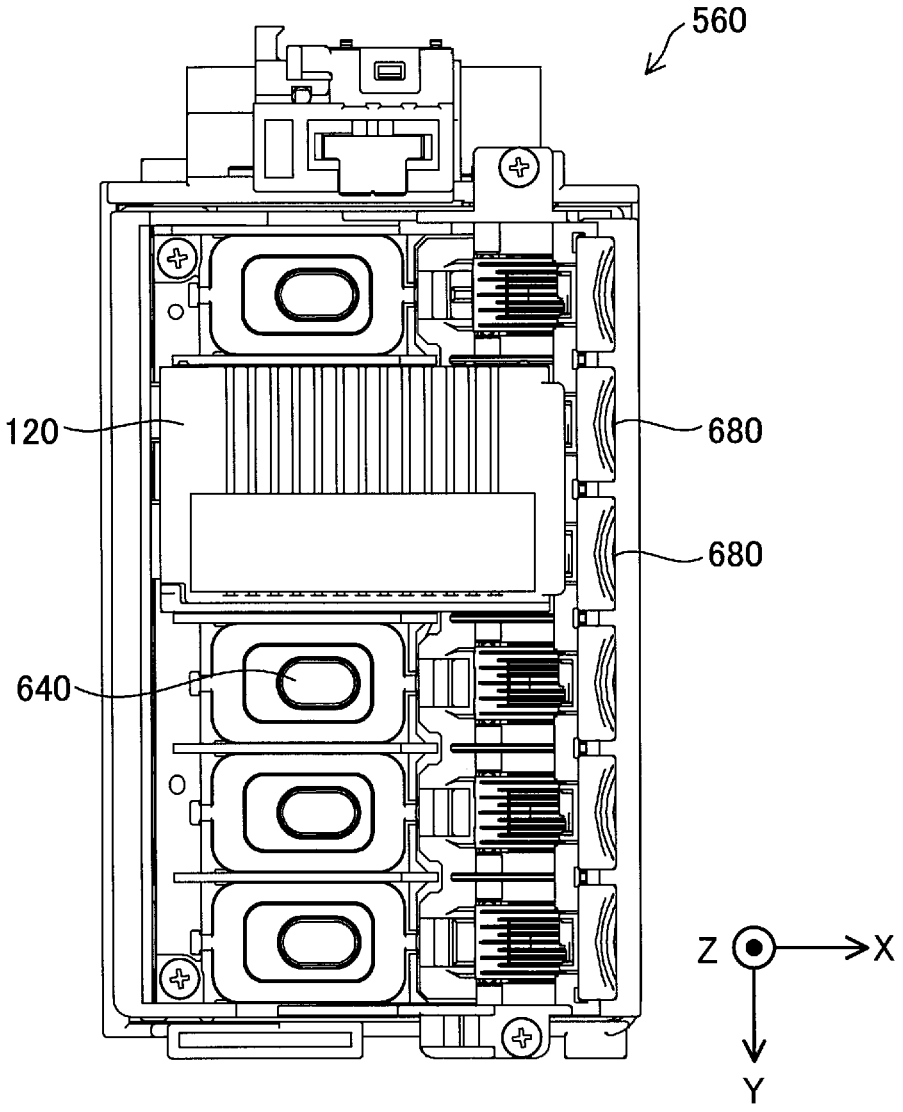
FIG. 5 is a plan view illustrating the holder with a large-size cartridge mounted thereto.
Figure 6:
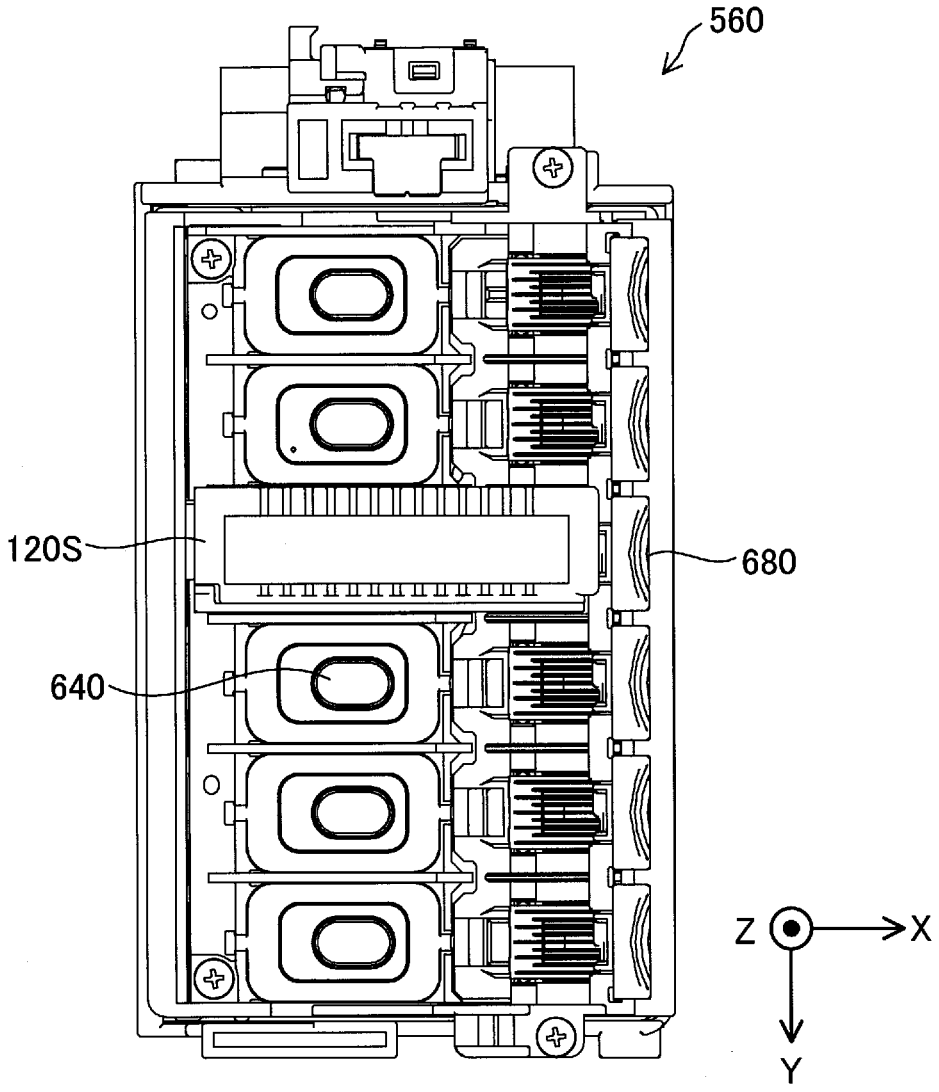
FIG. 6 is a plan view illustrating the holder with a small-size cartridge mounted thereto.

FIG. 2 and FIG. 3 are perspective views illustrating the holder 560, and FIG. 4 is a plan view illustrating the holder 560 viewed from the +Z direction side. FIG. 5 is a plan view illustrating the holder 560 with one large-size cartridge 120 mounted thereto, and FIG. 6 is a plan view illustrating the holder 560 with one small-size cartridge 120S mounted thereto.

The holder 560 includes five wall portions 601, 603, 604, 605 and 606. A recess formed by these five wall portions forms a cartridge chamber 602 (also called "cartridge mounting structure 602"). Hereinafter the wall portion 601 is also called bottom wall 601. The cartridge chamber 602 is divided by partition walls 607 into a plurality of slots (mounting spaces), each being configured to place one small-size cartridge 120S therein. One large-size cartridge 120 is placed in a space of the two slots. The partition walls 607 serve as a guide for inserting the cartridges 120 and 120S into the slots. Each slot is provided with a liquid introducing portion 640, a sheet member 648, an electrode portion 661, a lever 680, a positioning projection 610 and an apparatus-side restriction structure 620 (see FIG. 3). The apparatus-side restriction structurer 620 is a hole formed in a side wall 604 of the holder 560. One side face (+Z direction side face or upper face) of each slot is open, and the cartridge 120 or 120S is mounted to and demounted from the holder 560 via this open side face (or upper face). The liquid introducing portion 640 is provided to be placed between the two partition walls 607.

The positioning projection 610 is an approximately rectangular parallelepiped member protruded in the +Z direction from the bottom wall 601. The positioning projection 610 is inserted into a positioning structure (described later) provided in the cartridge 120 or 120S. The positioning projection 610 has a +X direction side face and a −X direction side face on its leading end portion that are inclined to be closer to each other toward the tip, in order to facilitate insertion into the positioning structure of the cartridge 120 or 120S.

The cartridge 120 or 120S is locked by the lever 680 and the apparatus-side restriction structure 620 to be mounted to the holder 560 in such a state that its liquid supply port (described later) is connected with the liquid introducing portion 640. This state is also called the "state that the cartridge is mounted to the holder 560" or the "mounted state". In the mounted state, a terminal group provided on a circuit board (described later) of the cartridge 120 or 120S is electrically connected with the electrode portion 661, so as to allow for transmission of various information between the cartridge 120 or 120S and the printer 150.

In the mounted state, the liquid introducing portion 640 (see FIG. 3) is connected with the liquid supply port of the cartridge 120 or 120S to introduce the liquid contained in the cartridge 120 or 120S to the liquid ejection head 540 that communicates with the liquid introducing portion 640. The liquid introducing portion 640 is in an approximately tubular form and includes a leading end portion 642 located on its +Z direction side and a base end portion 645 located on its −Z direction side. The base end portion 645 is provided on the bottom wall 601. The leading end portion 642 is connected with the liquid supply port of the cartridge 120 or 120S. The leading end portion 642 is provided with an apparatus-side filter 643. The liquid flows from the liquid supply port of the cartridge 120 or 120S through the apparatus-side filter 643 into the liquid introducing portion 640. The apparatus-side filter 643 may be made of, for example, a porous member, such as a metal mesh, a metal nonwoven fabric or a resin filter. The liquid introducing portion 640 has a center axis C that is parallel to the Z direction. A direction from the base end portion 645 toward the leading end portion 642 along the center axis C is +Z direction.

The sheet member 648 is provided around the base end portion 645 of the liquid introducing portion 640 to surround the liquid introducing portion 640. The sheet member 648 may be made of, for example, elastic rubber. The sheet member 648 seals the periphery of the liquid supply port of the cartridge 120 or 120S in the mounted state. The sheet member 648 accordingly prevents leakage of the liquid from the liquid supply port to the periphery. In the mounted state, the sheet member 648 applies a biasing force including a +Z-axis direction component to the cartridge 120 or 120S.

As understood from FIG. 5 and FIG. 6, the large-size cartridge 120 has a width (Y-direction dimension) approximately double the width of the small-size cartridge 120S. As described later, the large-size cartridge 120 has two liquid supply ports that are fit in the two liquid introducing portions 640 of the holder 560.

B. Configuration of Large-Size Cartridge 120

Figure 7:
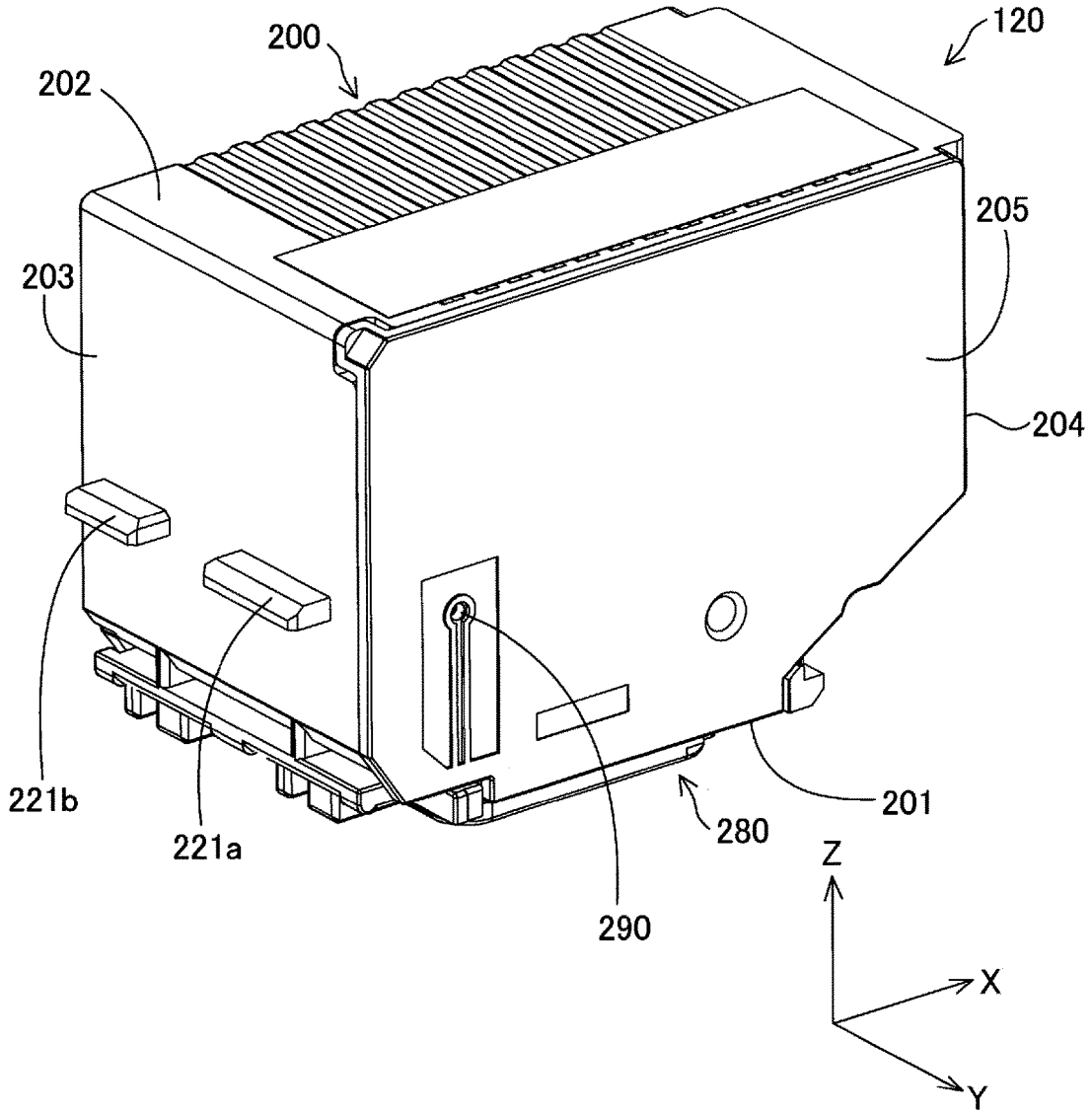
FIG. 7 is a perspective view illustrating the large-size cartridge.
Figure 8:
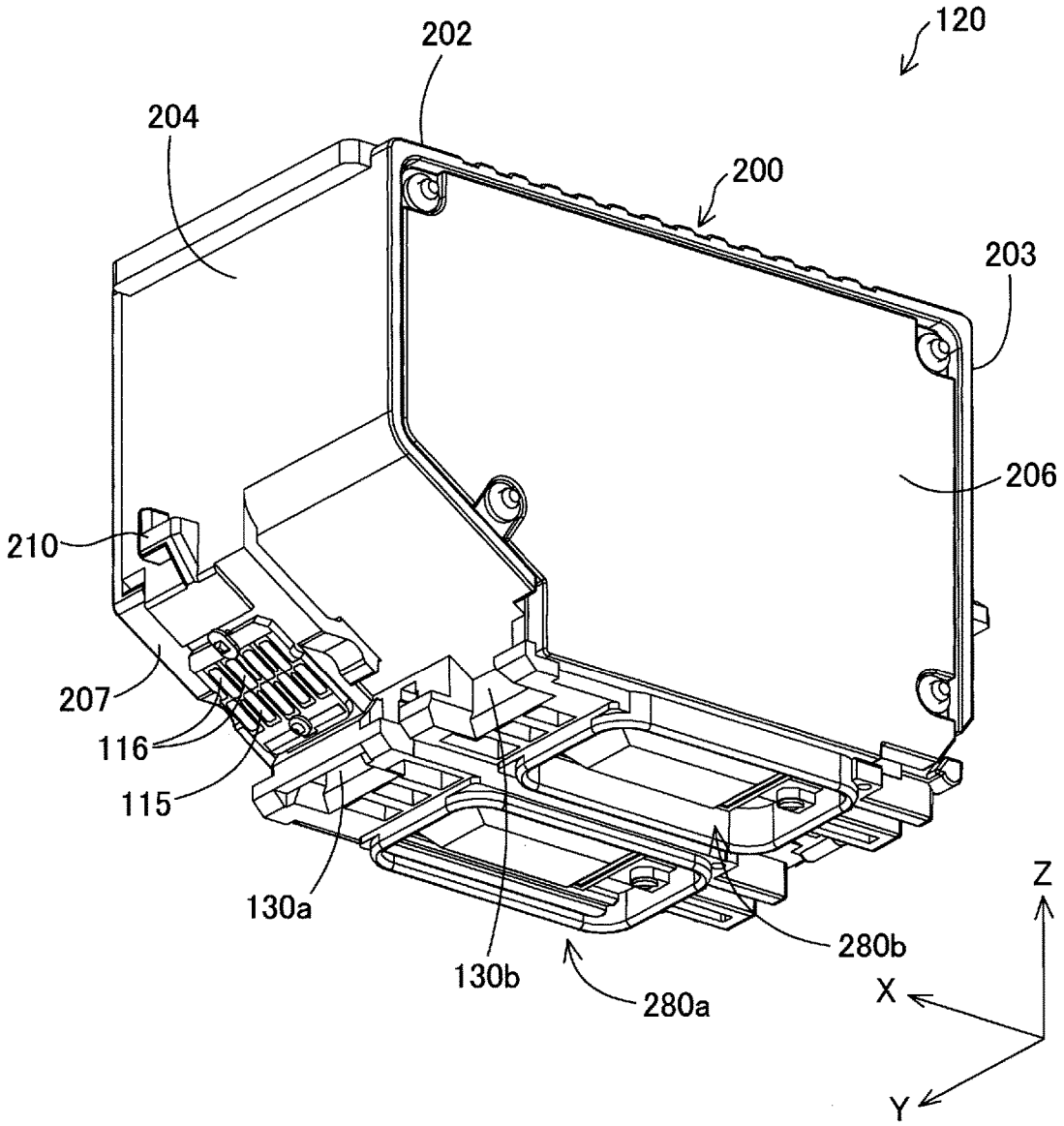
FIG. 8 is a perspective view illustrating the large-size cartridge.
Figure 9:
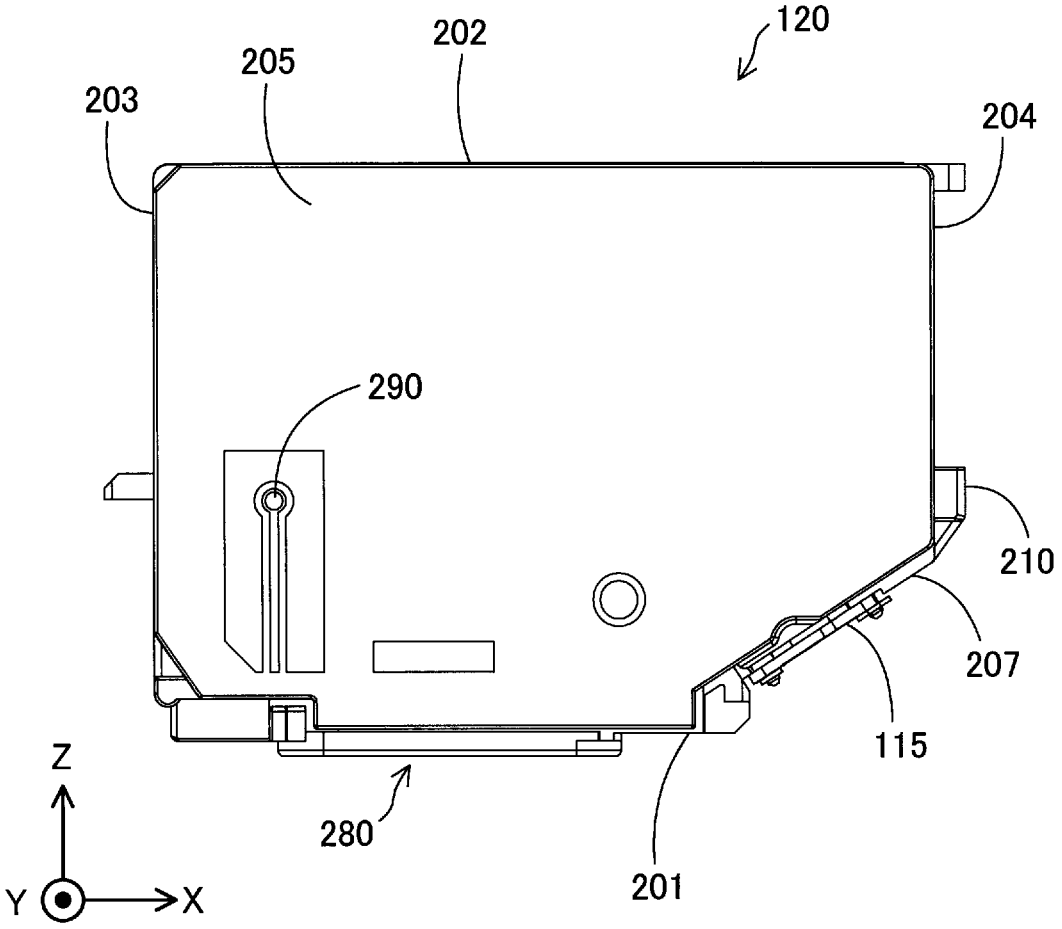
FIG. 9 is a front view illustrating the large-size cartridge.
Figure 10:
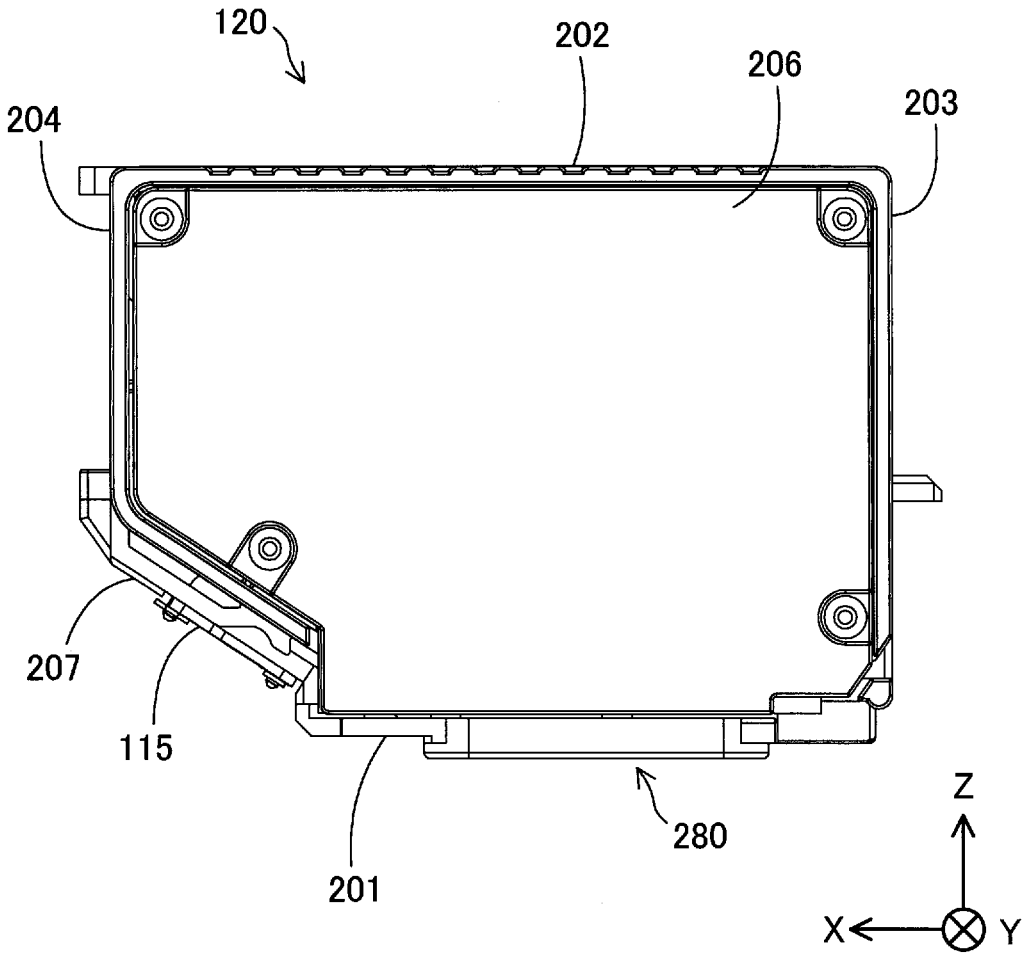
FIG. 10 is a rear view illustrating the large-size cartridge.
Figure 11:
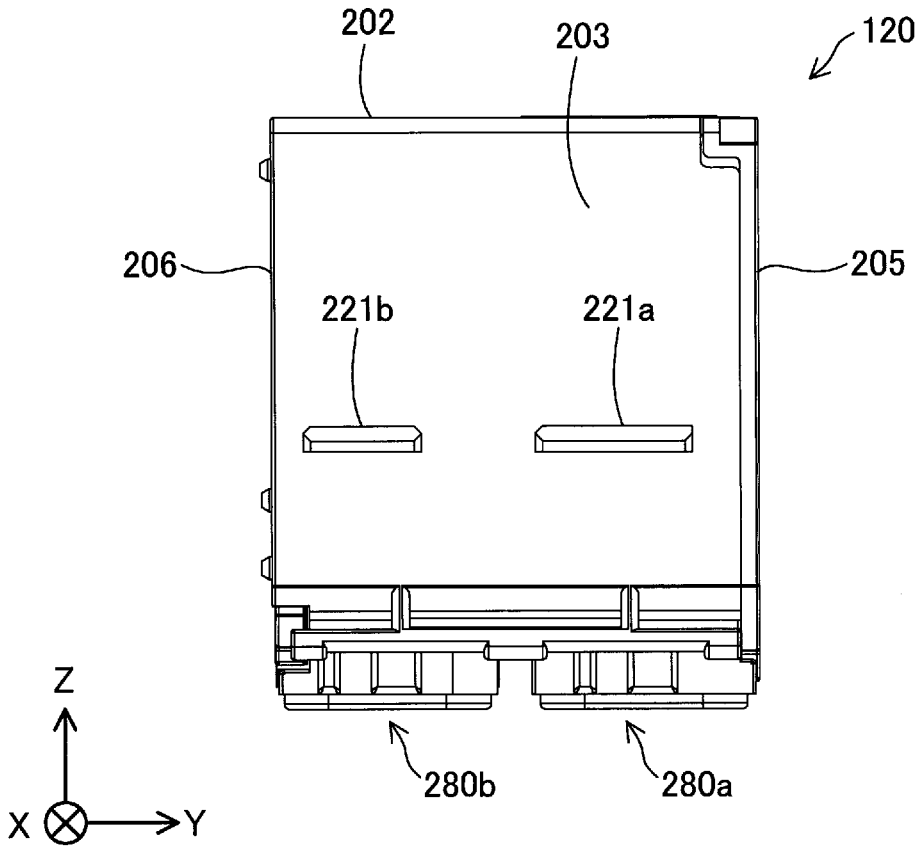
FIG. 11 is a left side view illustrating the large-size cartridge.
Figure 12:
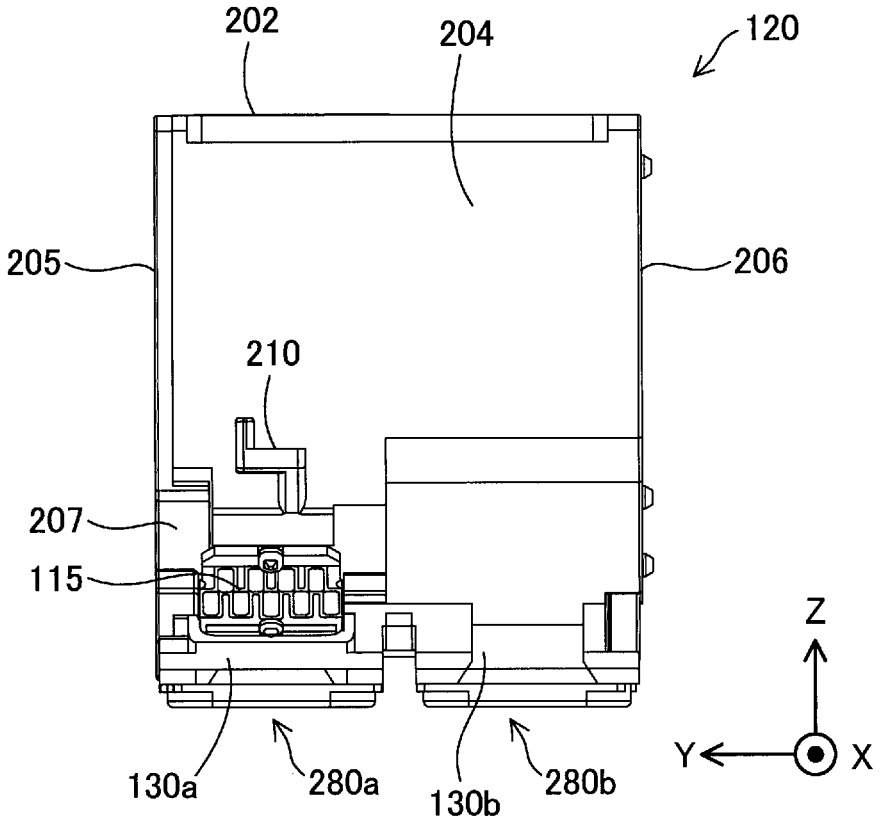
FIG. 12 is a right side view illustrating the large-size cartridge.
Figure 13:
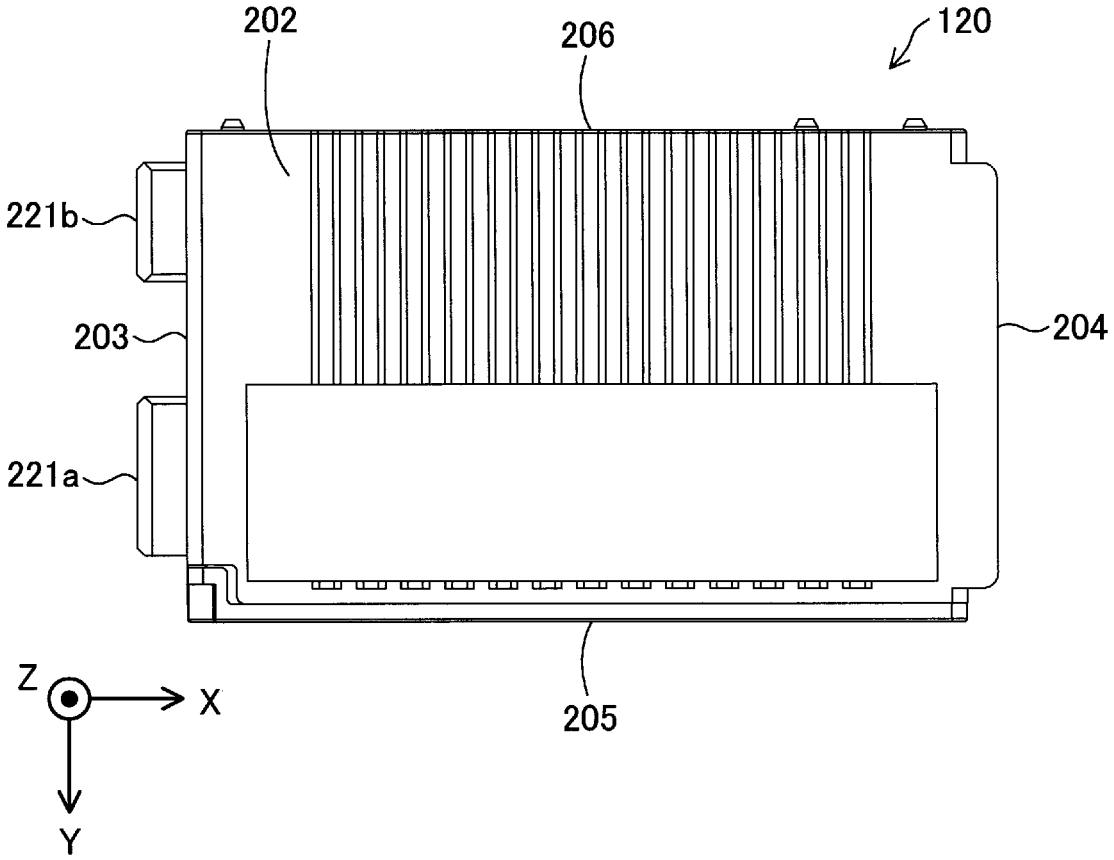
FIG. 13 is a plan view illustrating the large-size cartridge.
Figure 14:
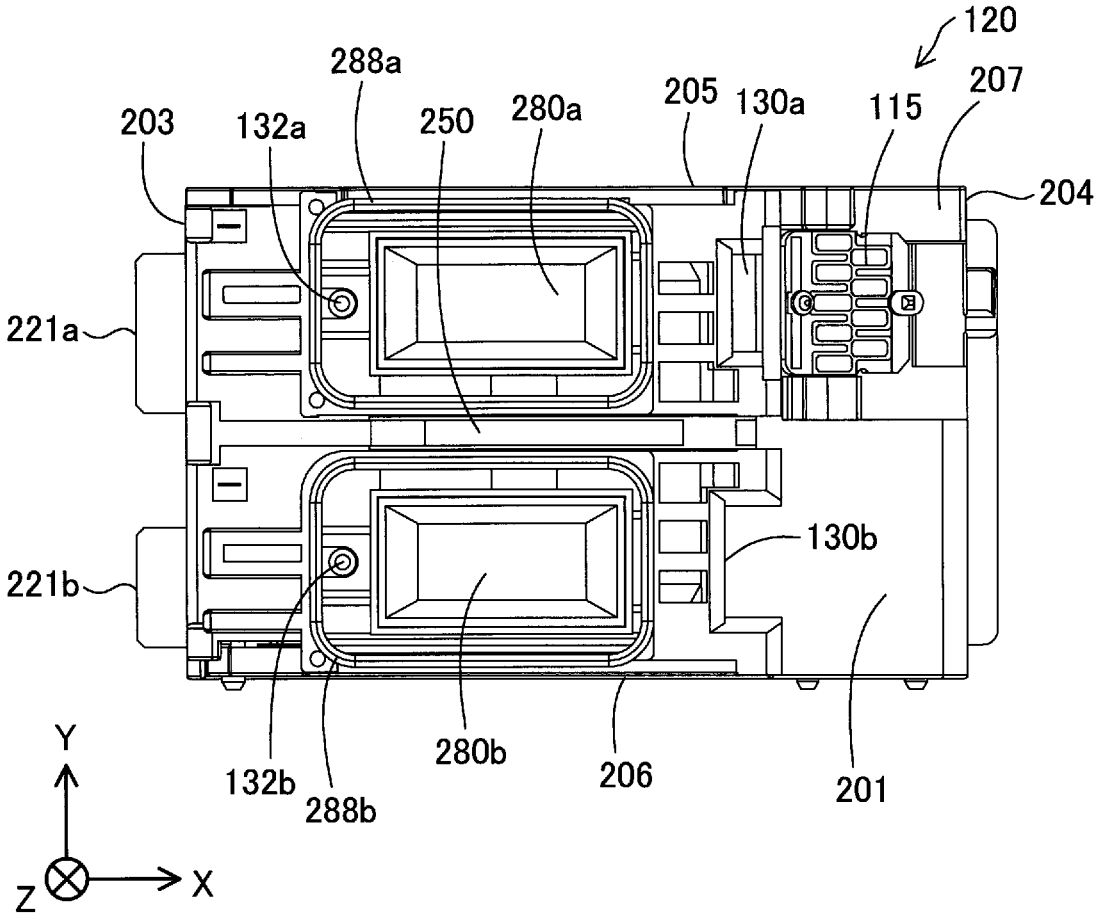
FIG. 14 is a bottom view illustrating the large-size cartridge.

FIG. 7 and FIG. 8 are perspective views illustrating the large-size cartridge 120, and FIGS. 9 to 14 are its six view drawings (front view, rear view, left side view, right side view, plan view and bottom view). The cartridge 120 is a semi-sealed type cartridge that intermittently introduces the outside air into a liquid chamber (described later) with consumption of the liquid.

The cartridge 120 includes seven wall portions 201 to 207. These wall portions constitute an approximately rectangular parallelepiped outer shell of the cartridge 120. The seven wall portions include a first wall portion 201 (or bottom wall 201), a second wall portion 202 (or upper wall 202), a third wall portion 203 (or third side wall 203), a fourth wall portion 204 (or fourth side wall 204), a fifth wall portion 205 (or first side wall 205), a sixth wall portion 206 (or second side wall 206), and a seventh wall portion 207 (or inclined wall 207). These seven wall portions 201 to 207 constitute the outer shell 200 of a liquid chamber (described later) configured to contain the liquid therein.

In the description below, the state that two wall portions "cross" or "intersect" means any one of the states including: a state that two wall portions are joined to cross each other; a state that an extension of one wall portion crosses the other wall portion; and a state that extensions of the respective wall portions cross each other. The state that two wall portions are "opposed to each other" includes both the states including: a state where no other object is present between the two wall portions, and a state where another object(s) is present between the two wall portions.

The respective wall portions 201 to 207 have practically planar outer surfaces. The practically planar state includes both the states including: a state where the entire surface is completely flat; and a state where the surface partly includes some unevenness. More specifically, the practically planar state includes the state where the surface is still regarded as a surface or a wall forming the outer shell 200 of the cartridge 120 even if the surface partly includes some unevenness. The outer shapes of the first wall portion 201 to the seventh wall portion 207 in the plan view (in the state that the respective wall portions are observed from their normal directions) are rectangular, except the fifth wall portion 205 and the sixth wall portion 206. In this embodiment, the first wall portion 201 to the seventh wall portion 207 may be outer surfaces of an assembly obtained by assembling a plurality of members. In this embodiment, the first wall portion 201 to the seventh wall portion 207 are plate-like members. In another embodiment, part of the first wall portion 201 to the seventh wall portion 207 may be a film-like (or thin film-like) member or a sheet-like member. The first wall portion 201 to the seventh wall portion 207 may be made of, for example, a synthetic resin such as polyacetal (POM).

The first wall portion 201 (or bottom wall) and the second wall portion 202 (or upper wall) are wall portions that are parallel to the X axis and the Y axis and are opposed to each other in the Z direction. The first wall portion 201 is located on the −Z direction side, and the second wall portion 202 is located on the +Z direction side. The first wall portion 201 and the second wall portion 202 have such a positional relationship as to cross the third wall portion 203, the fourth wall portion 204, the fifth wall portion 205 and the sixth wall portion 206. In this embodiment, in the mounted state that the cartridge 120 is mounted to the holder 560, the first wall portion 201 forms a bottom face of the cartridge 120, and the second wall portion 202 forms an upper face of the cartridge 120. The first wall portion 201 (see FIG. 14) is provided with two liquid supply ports 280*a* and 280*b*, their outer circumferential walls 288*a* and 288*b*, and two positioning structures 130*a* and 130*b*. The two liquid supply ports 280*a* and 280*b* are connected with the two liquid introducing portions 640 (see FIG. 4) of the holder 560. The two positioning structures 130*a* and 130*b* are respectively engaged with the positioning projections 610 (see FIG. 4) of the holder 560 to determine position of the cartridge 120 in the Y direction. Connecting holes 132*a* and 132*b* for the air are formed respectively inside of the outer circumferential walls 288*a* and 288*b*. The connecting holes 132*a* and 132*b* are openings provided to connect respective closed spaces inside of the outer circumferential walls 288*a* and 288*b* to the outside. In the mounted state, the configuration that the connecting holes 132 and 132*b* make the closed space inside of the outer circumferential wall 288*a* or 288*b* with the outside (ambient air) maintains an approximately constant pressure difference between the closed space and the outside. This accordingly suppresses leakage of the liquid from the liquid supply port 280*a* or 280*b* with a variation in pressure inside of the closed space.

A groove 250 is provided at a position corresponding to the partition wall 607 (see FIG. 4) of the holder 560 to be placed between the outer circumferential walls 288*a* and 288*b* of the two liquid supply ports 280*a* and 280*b* in the first wall portion 201. The groove 250 is recessed in the +Z direction from the surface of the first wall portion 201 and is configured to receive the partition wall 607 in the state that the liquid supply ports 280*a* and 280*b* are connected with the liquid introducing portions 640.

In the description hereof, suffixes of small letters "a" and "b" after the reference numbers of the respective members, such as the "liquid supply ports 280*a* and 280*b*" or the "outer circumferential walls 288*a* and 288*b*", are added for the purpose of discriminating members having substantially the same structure and the same function. In the description below, when there is no need to distinguish similar members from each other, the suffixes "a" and "b" may be omitted, and for example, the "liquid supply ports 280*a* and 280*b*" may be expressed as "liquid supply port 280". The same applies to other members.

The third wall portion 203 (or third side wall) and the fourth wall portion 204 (or fourth side wall) are wall portions that are parallel to the Y axis and the Z axis and are opposed to each other in the X direction. The third wall portion 203 is located on the −X direction side, and the fourth wall portion 204 is located on the +X direction side. The third wall portion 203 is arranged to cross the first wall portion 201 and the second wall portion 202. The fourth wall portion 204 is arranged to cross the first wall portion 201 and the second wall portion 202 and is opposed to the third wall portion 203. In this embodiment, in the state that the cartridge 120 is mounted to the carriage 520, the moving direction X of the carriage 520 is along a direction from the third wall portion 203 to the fourth wall portion 204. A first cartridge-side restriction structure 210 of a projected shape is formed on the fourth wall portion 204 (see FIG. 12). The first cartridge-side restriction structure 210 is locked by the lever 680 in the mounted state. The large-size cartridge 120 is inserted over the range of the two levers 680 as shown in FIG. 5, but only one of the levers 680 is used for fixation in the course of mounting. Accordingly, the first cartridge-side restriction structure 210 is provided at a position corresponding to this one of the levers 680. Second cartridge-side restriction structures 2241*a* and 221*b* of projected shapes are formed on the third wall portion 203 (see FIG. 11). The second cartridge-side restriction structures 221*a* and 221*b* are projections that are protruded in the −X direction from the third wall portion 203 to be engaged with the two apparatus-side restriction structures 620 (see FIG. 3) of the carriage 520. The apparatus-side restriction structures 620 are holes formed in the side wall 604 of the holder 560. In the mounted state, the second cartridge-side restriction structures 221*a* and 221*b* are inserted and locked in the apparatus-side restriction structures 620. More specifically, in the mounted state, the cartridge 120 is locked on the respective sides in the X direction by the lever 680 and the apparatus-side restriction structures 620 of the holder 560, so as to be fixed to the holder 560.

The fifth wall portion 205 (or first side wall) and the sixth wall portion 206 (or second side wall) are wall portions that are parallel to the X axis and the Z axis and are opposed to each other in the Y direction. The fifth wall portion 205 is arranged to cross the first wall portion 201, the second wall portion 202, the third wall portion 203 and the fourth wall portion 204. The sixth wall portion 206 is arranged to cross the first wall portion 201, the second wall portion 202, the third wall portion 203 and the fourth wall portion 204 and is opposed to the fifth wall portion 205. An air introducing hole 290 is formed in the fifth wall portion 205 (see FIG. 9) to introduce the air into the cartridge 120.

The seventh wall portion 207 (see FIG. 9) is an inclined wall provided to connect the first wall portion 201 with the fourth wall portion 204. The seventh wall portion 207 is arranged to cross the fifth wall portion 205 and the sixth wall portion 206 and is located between the first wall portion 201 and the fourth wall portion 204. Contact portions 116 are formed on the seventh wall portion 207 (see FIG. 8) to come into contact with the electrode portion 661 of the printer 150. In this embodiment, these contact portions 116 are formed on a substrate 115 provided on the seventh wall portion 207. In other words, the substrate 115 has a plurality of the contact portions 116 that come into contact with the electrode portion 661 provided on the holder 560 in the mounted state. More specifically, the contact portions 116 denote contact areas of electrode terminals provided on the surface of the substrate 115, such as to come into contact with the electrode portion 661. In this embodiment, the plurality of contact portions 116 are arranged to form two arrays that are arrayed along the Y-axis direction at predetermined intervals in the X direction, when being viewed from the −Z direction. A memory device (described later) is provided on a rear face of the substrate 115 to store various information regarding the cartridge 120. For example, information indicating the remaining amount of ink and the color of ink is stored in this memory device. When the electrode portion 661 provided on the holder 560 comes into contact with the contact portions 116, the controller 510 provided in the printer 150 reads various information from the memory device provided in the cartridge 120 via the flexible cable 517.

Figure 15:
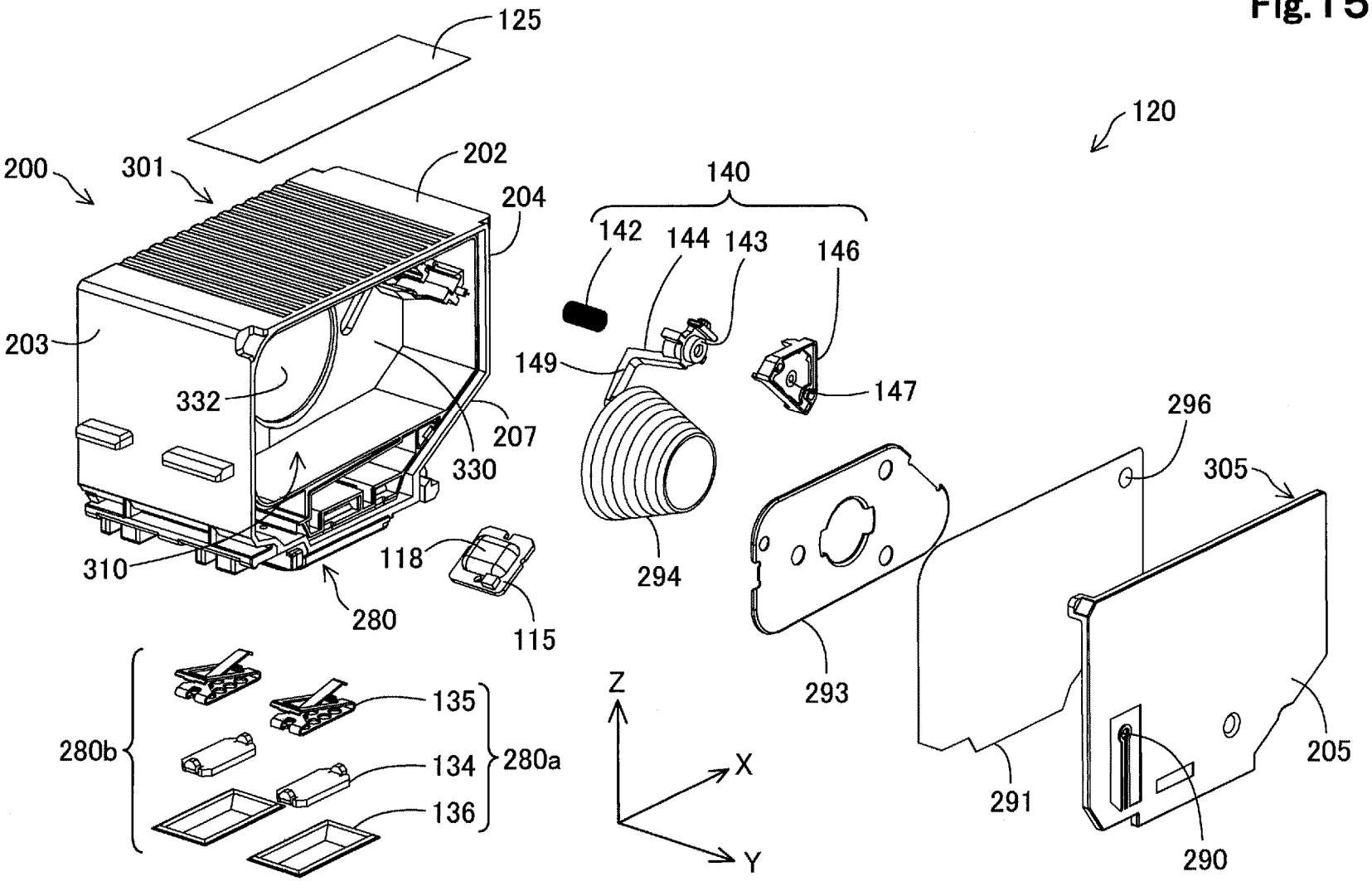
FIG. 15 is an exploded perspective view illustrating the large-size cartridge.
Figure 16:
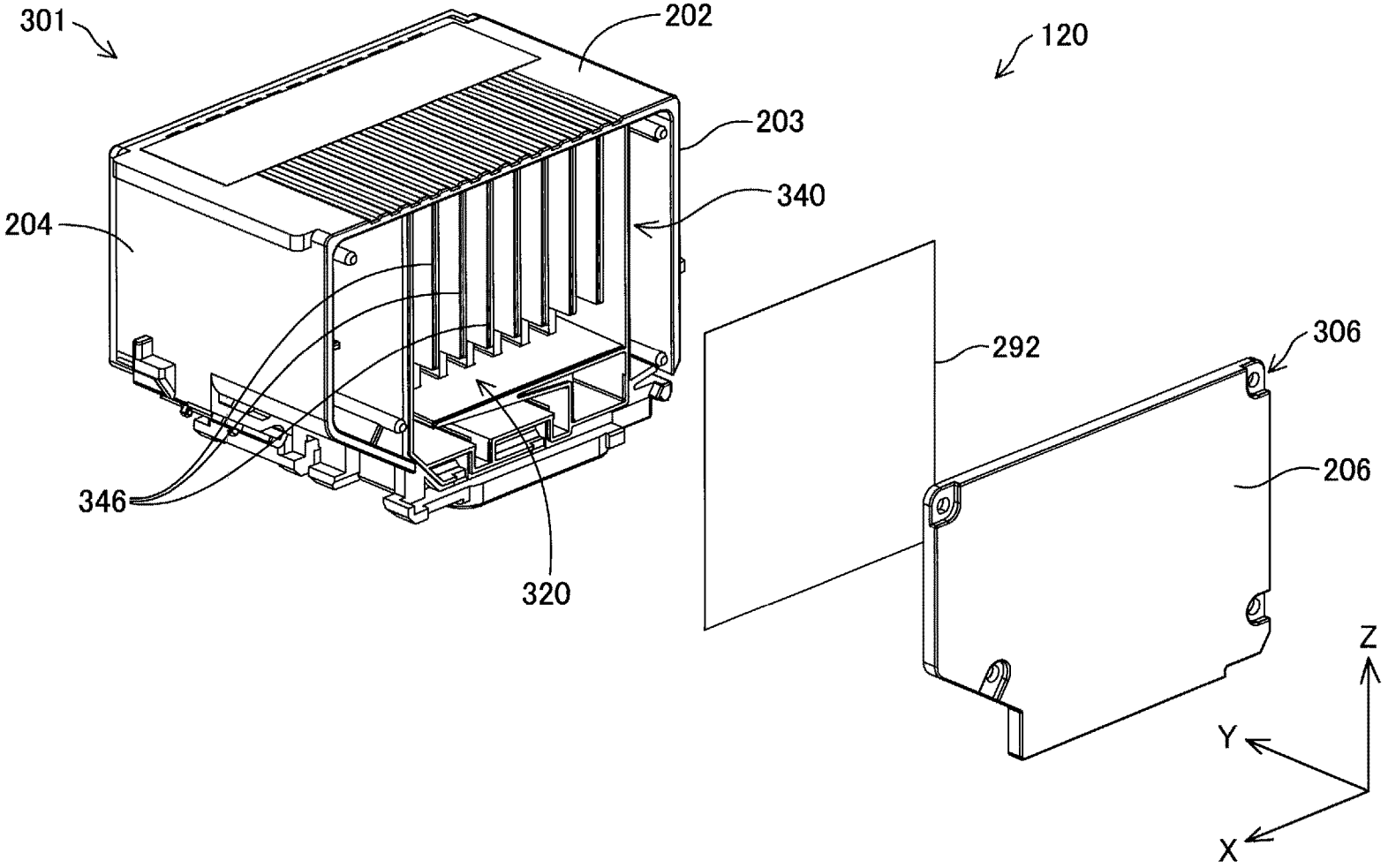
FIG. 16 is an exploded perspective view illustrating the large-size cartridge.

FIG. 15 and FIG. 16 are exploded perspective views illustrating the cartridge 120. The cartridge 120 includes a main body member 301, a first cover member 305 and a second cover member 306. The cartridge 120 also includes a first flexible sheet member 291 and a second flexible sheet member 292 to form a liquid chamber with the main body member 301. The main body member 301 is a hollow member of an approximately rectangular parallelepiped shape. The main body member 301 has openings on respective ends in the Y direction and includes a partition wall 330 provided on the approximate center of its width in the Y direction. This partition wall 330 is a wall arranged to part a liquid containing space inside of the main body member 301 into a first chamber 310 on the +Y direction side and a second chamber 320 on the −Y direction side. As described later, the first chamber 310 and the second chamber 320 is in fluid communication with each other via a connecting hole provided in the partition wall 330. A peripheral wall 340 is formed on the −Y direction side of the partition wall 330 of the main body member 301 (see FIG. 16) to surround the periphery of the second chamber 320. Sub-partition walls 346 are formed inside of the peripheral wall 340 to part the second chamber 320 into a plurality of sub-chambers (described later). The peripheral wall 340 and the sub-partition walls 346 are wall members that are extended in the −Y direction from the partition wall 330 (see FIG. 15).

The sheet members 291 and 292 are thin films having liquid impermeability, air tightness and flexibility. The sheet members 291 and 292 are joined with the main body member 301 by bonding or welding and, in combination with the main body member 301 define and form the liquid chambers 310 and 320. More specifically, the sheet member 291 (see FIG. 15) is joined with a +Y direction side end face of the main body member 301 and is used to define the first chamber 310. The first sheet member 291 is formed in such dimensions that cover the first chamber 310 and a fluid flow path (or connecting flow path) formed below the first chamber 310. The sheet member 292 (see FIG. 16) is joined with a −Y direction side end face of the main body member 301 and is used to define the second chamber 320. The second sheet member 292 is formed in such dimensions that cover the peripheral wall 340 of the second chamber 320 and a fluid flow path (or connecting flow path) formed below the second chamber 320. As described above, parts of the outer walls of the liquid chambers 310 and 320 are formed by the sheet members 291 and 292.

The first cover member 305 is attached to the main body member 301 so as to cover the first sheet member 291. The second cover member 306 is attached to the main body member 301 so as to cover the second sheet member 292. The main body member 301 and the cover members 305 and 306 are made of a synthetic resin, such as polypropylene. The sheet members 291 and 292 are made of a synthetic resin, such as a composite material containing nylon and polypropylene.

A pressure receiving plate 293 as a plate-like member is placed inside of the first chamber 310 (see FIG. 15). One surface of the pressure receiving plate 293 is in contact with the first sheet member 291. A coil spring 294 as a biasing member is placed between the other surface (or −Y direction side surface) of the pressure receiving plate 293 and the partition wall 330. A recess 332 is formed at the center of the partition wall 330 to receive the coil spring 294. The coil spring 294 biases the pressure receiving plate 293 from the partition wall 330 toward the fifth wall portion 205. More specifically, the coil spring 294 biases the first sheet member 291 via the pressure receiving plate 293 in a direction of expanding the volume of the first chamber 310. The internal pressure of the first chamber 310 is maintained at a pressure (a negative pressure) lower than the atmospheric pressure by the biasing force of this coil spring 294. The coil spring 294 has a truncated cone outer shape, but it may have a cylindrical outer shape.

An air valve 140 is further placed inside of the first chamber 310 to introduce the air into the first chamber 310. The air valve 140 includes a valve seat 146, a valving member 144 and a coil spring 142. The valving member 144 is pressed against the valve seat 146 by the coil spring 142 to close an air introducing hole 147 that is a through hole formed in the valve seat 146. The valving member 144 includes a valving element portion 143 provided to open and close the air introducing hole 147 and a lever portion 149 provided to abut on the pressure receiving plate 293 such that the valving element portion 143 is movable. The valve seat 146 is placed in a corner of the main body member 301 where the second wall portion 202 crosses the fourth wall portion 204 and is attached to the main body member 301. The valve seat 146 includes a recess, and the sheet member 291 is airtightly applied to an end face that forms an opening of the recess. The recess of the valve seat 146 is in fluid communication with a through hole 296 of the sheet member 291. The air introducing hole 147 is formed in a bottom of the recess of the valve seat 146 such that the hole 174 reaches the rear side of the valve seat 146. The valving element portion 143 of the valving member 144 is pressed against the valve seat 146 by the coil spring 142 to close the air introducing hole 147. The lever portion 149 of the valving member 144 is pressed by the pressure receiving plate 293 when the pressure receiving plate 293 moves in the −Y direction. As described later, when the lever portion 149 is pressed by the pressure receiving plate 293, the state of the valving element portion 143 and the valve seat 146 changes from a valve closed position to a valve open position.

A flat spring 135, a liquid-permeable porous member 134 (for example, resin foam) and a cartridge-side filter 136 are sequentially fit in each of the two liquid supply ports 280 (see FIG. 15) provided on the bottom face of the main body member 301. The cartridge-side filter 136 comes into contact with the liquid introducing portion 640 (see FIG. 4) of the holder 560 to supply the liquid to the liquid introducing portion 640.

The substrate 115 provided with a memory device 118 is fixed to the seventh wall portion 207 of the main body member 301. A label 125 may be applied on an outer surface of the second wall portion 202 of the main body member 301. For example, the manufacturer and the model number of the cartridge 120 are shown on the label 125. The label 125 may be applied at any position. For example, the label 125 may be applied on any one wall portion among the second wall portion 202, the third wall portion 203, the fourth wall portion 204, the fifth wall portion 205 and the sixth wall portion 206 or may be applied across two or more wall portions.

Figure 17:
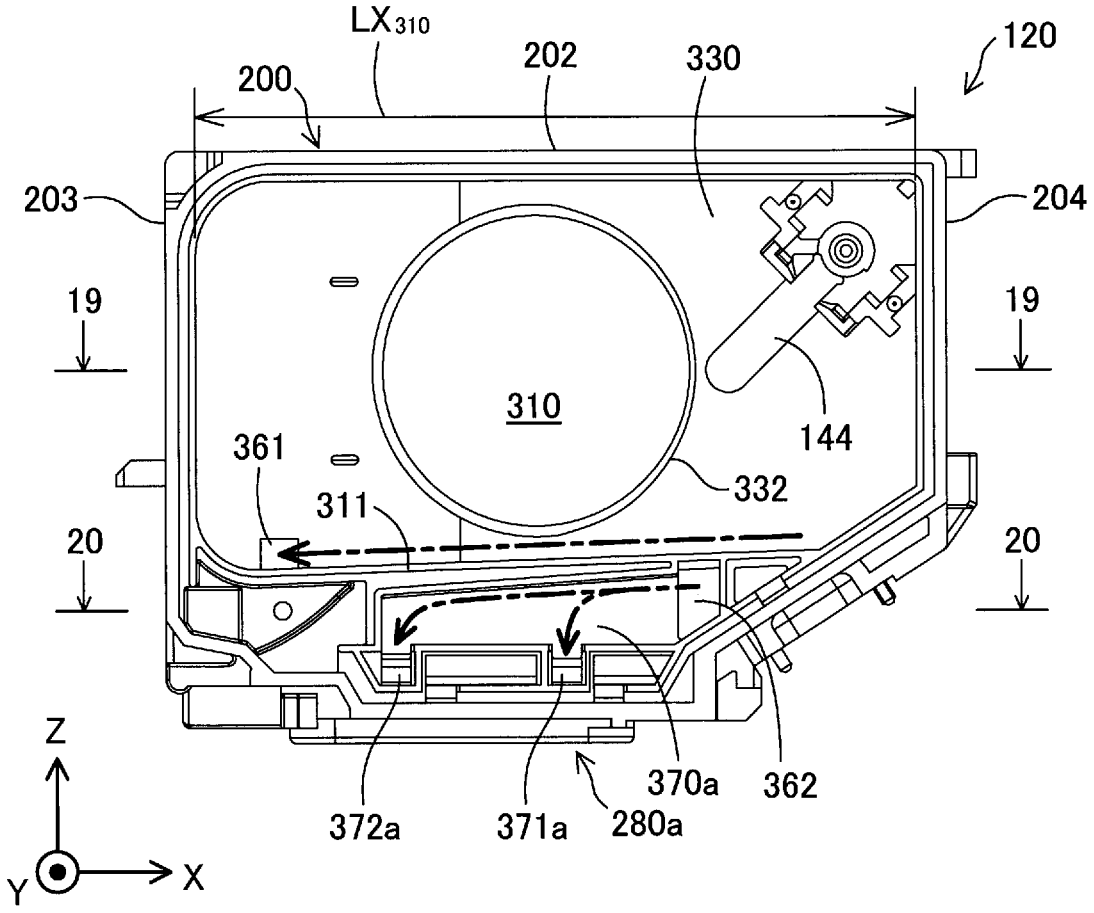
FIG. 17 is a front view illustrating a main body member of the large-size cartridge.
Figure 18:
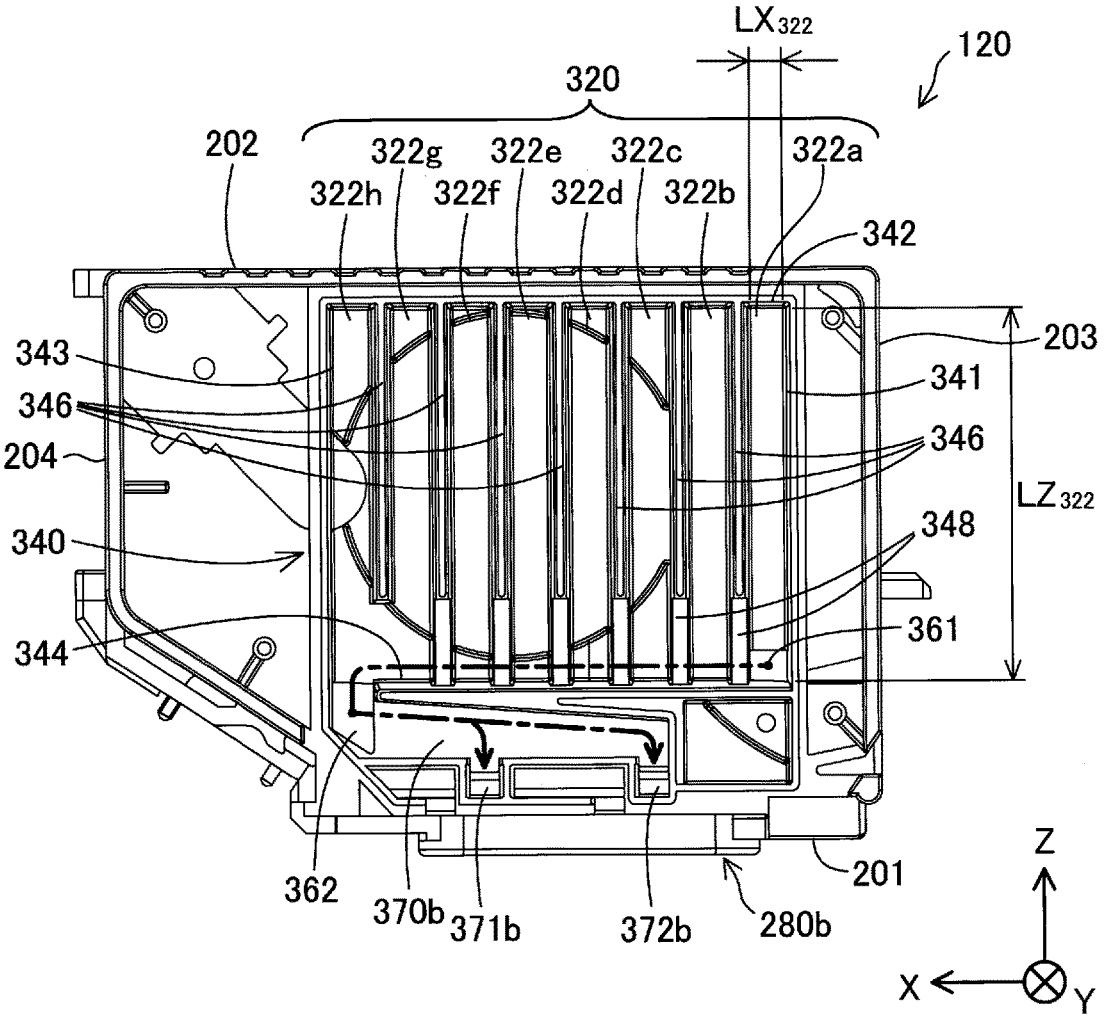
FIG. 18 is a rear view illustrating the main body member of the large-size cartridge.
Figure 19:
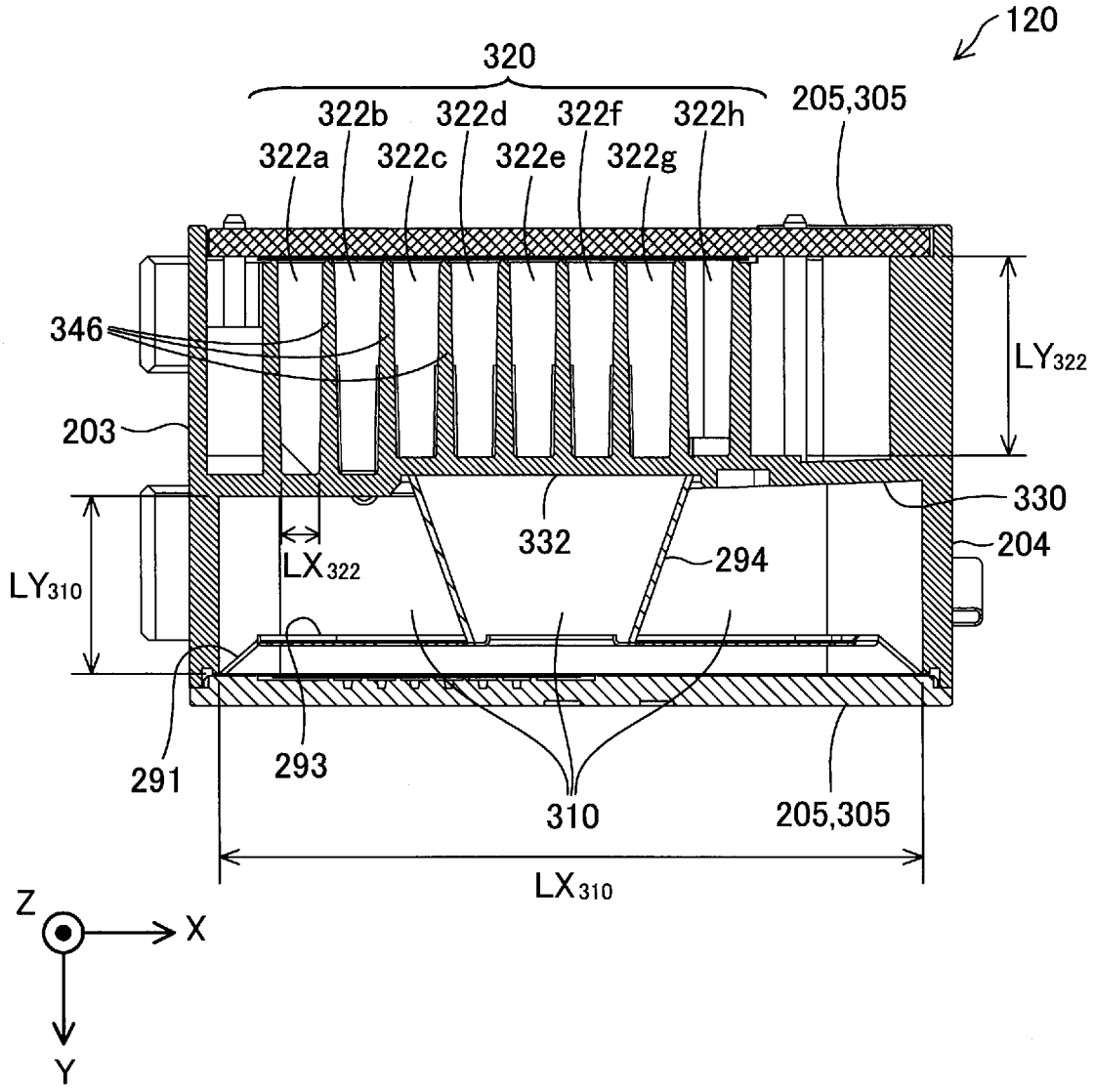
FIG. 19 is a sectional view illustrating a section 19-19 in FIG. 17.
Figure 20:
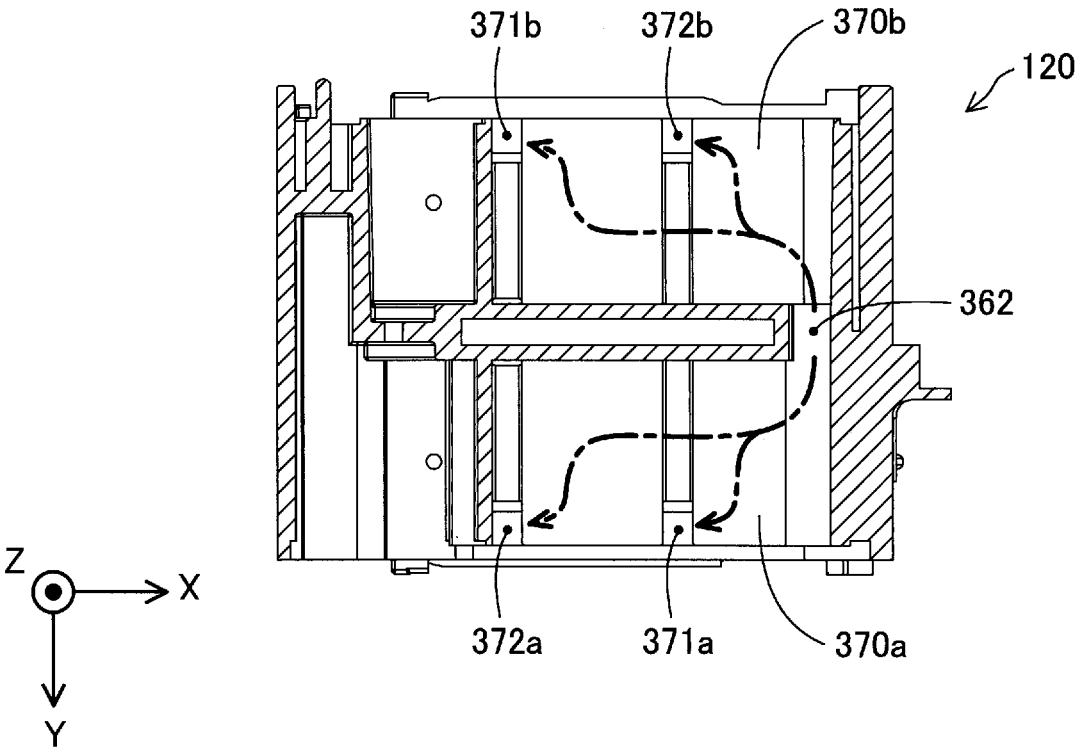
FIG. 20 is a sectional view illustrating a section 20-20 in FIG. 17.

FIGS. 17 to 20 illustrate the configuration of the main body member 301. FIG. 17 is a front view illustrating the main body member 301. FIG. 18 is a rear view illustrating the main body member 301. FIG. 19 is a sectional view illustrating a section 19-19 in FIG. 17. FIG. 20 is a sectional view illustrating a section 20-20 in FIG. 17. In FIG. 17, FIG. 18 and FIG. 20, thick one-dot chain line arrows indicate the flow route of the liquid.

The first chamber 310 is formed on the +Y direction side of the partition wall 330 of the main body member 301. FIG. 17 illustrates the state that the valving member 144 described above with reference to FIG. 15 is placed inside of the first chamber 310. The first chamber 310 is a space of an approximately rectangular sectional shape surrounded by an inner surface of the second wall portion 202 (or upper wall), an inner surface of the third wall portion 203 (or third side wall), an inner surface of the fourth wall portion 204 (or fourth side wall) and an upper surface of a bottom face wall portion 311. The +Y direction side of the first chamber 310 is sealed by the first sheet member 291 (see FIG. 15). A connecting hole 361 is provided at a position nearer to the third wall portion 203 than the fourth wall portion 204 in the bottom of the first chamber 310 to connect the first chamber 310 with the second chamber 320. This connecting hole 361 is an opening provided in the partition wall 330. The liquid moves from the first chamber 310 through the connecting hole 361 to the second chamber 320 that is on the back side of the first chamber 310.

The second chamber 320 (see FIG. 18) is surrounded by the peripheral wall 340. This peripheral wall 340 is comprised of two side walls 341 and 343 that are opposed to each other in the X direction, and an upper wall 342 and a bottom face wall portion 344 that are opposed to each other in the Z direction. Sub-partition walls 346 are formed inside of the peripheral wall 340 to part the second chamber 320 into a plurality of sub-chambers 322*a* to 322*h*. These sub-partition walls 346 are wall members extended on a YZ plane, and the plurality of sub-chambers 322*a* to 322*h* are arranged to be sequentially arrayed along the X direction. In the description below, when there is no need to distinguish the individual sub-chambers 322*a* to 322*h* from one another, these sub-chambers 322*a* to 322*h* are called "sub-chambers 322" with omission of the suffixes "a" to "h". A lower end of the sub-partition wall 346 has a partly cutout shape that forms an inflow-outflow portion 348 of the liquid. More specifically, sub-chambers 322 adjoining to each other in the X direction among the plurality of sub-chambers 322 are connected with each other via this inflow-outflow portion 348. For example, the liquid flows into the second sub-chamber 322*b* via the inflow-outflow portion 348 placed between the first sub-chamber 322*a* and the second sub-chamber 322*b*. The liquid flows out from the second sub-chamber 322*b* via the inflow-outflow portion 348 placed between the second sub-chamber 322*b* and the third sub-chamber 322*c*. It is preferable that the inflow-outflow portions 348 are provided at positions nearer to the bottom wall 201 than the positions of half a height $LZ_{322}$ of the sub-chambers 322 in the Z direction. This configuration gives a structure that is unlikely to interfere with the flow of the liquid passing through the plurality of sub-chambers 322.

In this embodiment, the inflow-output portion 348 on the upstream side of each sub-chamber 322 serves as an inlet of the liquid to the sub-chamber 322, and the inflow-output portion 348 on the downstream side of the sub-chamber 322 serves as an outlet of the liquid from the sub-chamber 322. In other words, the position of the inlet of the liquid to each sub-chamber 322 and the position of the outlet of the liquid from the sub-chamber 322 are different in the X direction but are identical in the Y direction and in the Z direction. The position of the inlet of the liquid to each sub-chamber 322 and the position of the outlet of the liquid from the sub-chamber 322 may be made different in at least one direction among the X direction, the Y direction and the Z direction. Employing this configuration enables the plurality of sub-chambers 322 to serve as a trap flow path (or labyrinth flow path) of air bubbles.

A dimension $LX_{322}$ of the sub-chamber 322 in the X direction is set to be smaller than a dimension $LX_{310}$ of the first chamber 310 in the X direction (see FIG. 17). This configuration suppresses the ripple of the liquid inside of the sub-chambers 322 during reciprocation of the carriage 520 in the X direction and thereby suppresses air bubbles from being produced in the sub-chambers 322. The flow path configuration that the liquid flows through the sub-chambers 322 and reaches the liquid supply port 280 also provides such an advantage that air bubbles are unlikely to reach the liquid supply port 280. A dimension $LY_{322}$ of the sub-chamber 322 in the Y direction (see FIG. 19) is set to be larger than the dimension $LX_{322}$ of the sub-chamber 322 in the X direction. This configuration enables a larger volume of the liquid to be contained in the sub-chambers 322, while suppressing the ripple of the liquid in the sub-chambers 322. Additionally, a dimension $LZ_{322}$ of the sub-chamber 322 in the Z direction (see FIG. 18) is set to be larger than the dimension $LX_{322}$ of the sub-chamber 322 in the X direction. This configuration enables a larger volume of the liquid to be contained in the sub-chambers 322, while suppressing the ripple of the liquid in the sub-chambers 322.

In the illustrated example of FIG. 18, the plurality of sub-chambers 322 have the inflow-outflow portions 348 provided as communication paths provided on their lower end portions, while not being provided with communication paths on their upper end portions. Even when air bubbles are produced and remain in any of the sub-chambers 322, this configuration prevents the air bubbles from moving to other sub-chambers 322 on the downstream side.

A connecting hole 362 is provided below the sub-chamber 322*h* on the most downstream side in the second chamber 320, as an outlet of the liquid from the second chamber 320. This connecting hole 362 is an opening provided in the partition wall 330, and the bottom face wall portion 344 of the second chamber 320 is formed in such a shape that does not cover the upper portion of this connecting hole 362. The connecting hole 362 is provided at a position nearer to the fourth side wall 204 than a middle position between the third side wall 203 and the fourth side wall 204 in the X direction. The connecting hole 361 that is an inlet of the liquid to the second chamber 320 is, on the other hand, provided at a position nearer to the third side wall 203 than the middle position between the third side wall 203 and the fourth side wall 204 in the X direction. This configuration increases the distance between the connecting hole 361 as the inlet of the liquid to the second chamber 320 and the connecting hole 362 as the outlet of the liquid from the second chamber 320. As a result, this gives a relatively long flow path from the first chamber 310 to the liquid supply port 280 and thereby provides such an advantage that air bubbles are unlikely to reach the liquid supply port 280. The positional relationship between the two connecting holes 361 and 362 in the X direction may be reversed. More specifically, the connecting hole 361 as the inlet of the liquid to the second chamber 320 may be provided at a position nearer to one side wall out of the third side wall 203 and the fourth side wall 204 than the middle position between the third side wall 203 and the fourth side wall 204 in the X direction, while the connecting hole 362 as the outlet of the liquid from the second chamber 320 may be provided at a position nearer to the other side wall out of the third side wall 203 and the fourth side wall 204 than the middle position between the third side wall 203 and the fourth side wall 204 in the X direction. In the description below, the "connecting hole 362" may also be called the "outlet 362 of the liquid" or simply called the "outlet 362".

The liquid flowing out from the second chamber 320 is split into two branch flow paths 370*a* and 370*b* at the outlet 362 (see FIG. 20). The first branch flow path 370*a* (see FIG. 17) is formed below the first chamber 310 across the bottom face wall portion 311 of the first chamber 310. The second branch flow path 370*b* (see FIG. 18) is formed below the second chamber 320 across the bottom face wall portion 344 of the second chamber 320. The liquid to be flowing to the two liquid supply ports 280 provided in the bottom of the cartridge 120 is split into the two branch flow paths 370*a* and 370*b* immediately before the two liquid supply ports 280. This accordingly reduces the possibility that a concentration difference arises in the liquid that is supplied from the respective liquid supply ports 280 to the liquid introducing portions 640 (see FIG. 4).

One joint flow path by joining the two branch flow paths 370*a* and 370*b* may be formed, instead of forming the two separate branch flow paths 370*a* and 370*b*. The joint flow path or the branch flow paths 370*a* and 370*b* serve as a connecting flow path for connecting the outlet 362 of the liquid of the second chamber 320 with the liquid supply port 280. Providing such a connecting flow path further lengthens the flow path from the first chamber 310 to the liquid supply port 280 and accordingly provides such an advantage that air bubbles are more unlikely to reach the liquid supply port 280. It is preferable that such a connecting flow path is provided to be extended from the fourth side wall 204-side nearer to the outlet 362 toward the third side wall-203 side nearer to the connecting hole 361. This configuration enables the connecting flow path to be formed as a turning flow path below the flow path from the connecting hole 361 to the outlet 362 of the second chamber 320 (i.e., the flow path formed by connecting the plurality of inflow-outflow portions 348), thereby further lengthening the total flow path.

Two supply port connecting paths 371*a* and 372*a* (see FIG. 17) that are connected with the liquid supply port 280*a* are formed in the bottom of the first branch flow path 370*a*. Similarly, two supply port connecting paths 371*b* and 372*b* (see FIG. 18) that are connected with the liquid supply port 280*b* are formed in the bottom of the second branch flow path 370*b*. Providing two supply port connecting paths 371 and 372 for one liquid supply port 280 causes a gas-liquid exchange phenomenon that causes the liquid to flow out from one of the two supply port connecting paths 371 and 372, while causing the gas to flow in from the other supply port connecting path into the cartridge 120, even when the liquid flows out from the liquid supply port 280 to the liquid introducing portion 640 (see FIG. 4) in the state that the gas is present in the connecting part of the liquid supply port 280 and the liquid introducing portion 640. This configuration accordingly enables the liquid to be supplied to the liquid introducing portion 640 without causing air bubbles to excessively flow out to the liquid introducing portion 640. In a modification, only one supply port connecting path may be provided for one liquid supply port 280.

In FIG. 17, FIG. 18 and FIG. 20, the flow route of the liquid is shown by the thick one-dot chain line arrows. The liquid contained in the first chamber 310 flows through the connecting hole 361 (see FIG. 17) formed in the bottom of the first chamber 310 into the second chamber 320 (see FIG. 18), passes through the plurality of sub-chambers 322 of the second chamber 320, reaches the other connecting hole 362 (or outlet 362) provided on the opposite side to (or +X direction side of) the connecting port 361, is split into the two branch flow paths 370*a* and 370*b* (see FIG. 20) at this connecting port 362, and flows through the supply port connecting paths 371*a*, 372*a*, 371*b* and 372*b* of the respective branch flow paths 370*a* and 370*b* to the two liquid supply ports 280*a* and 280*b*. This liquid further flows from the liquid supply ports 280*a* and 280*b* to reach the two liquid introducing portions 640 provided in the holder 560 (see FIG. 4). As described above, the second chamber 320 including the sub-chambers 322 that have the smaller dimension in the X direction than that of the first chamber 310 is provided on the downstream side of the first chamber 310. This configuration provides such an advantage that air bubbles are unlikely to be produced in the sub-chambers 322 even during reciprocation of the carriage 520 in the X direction.

Figure 21:
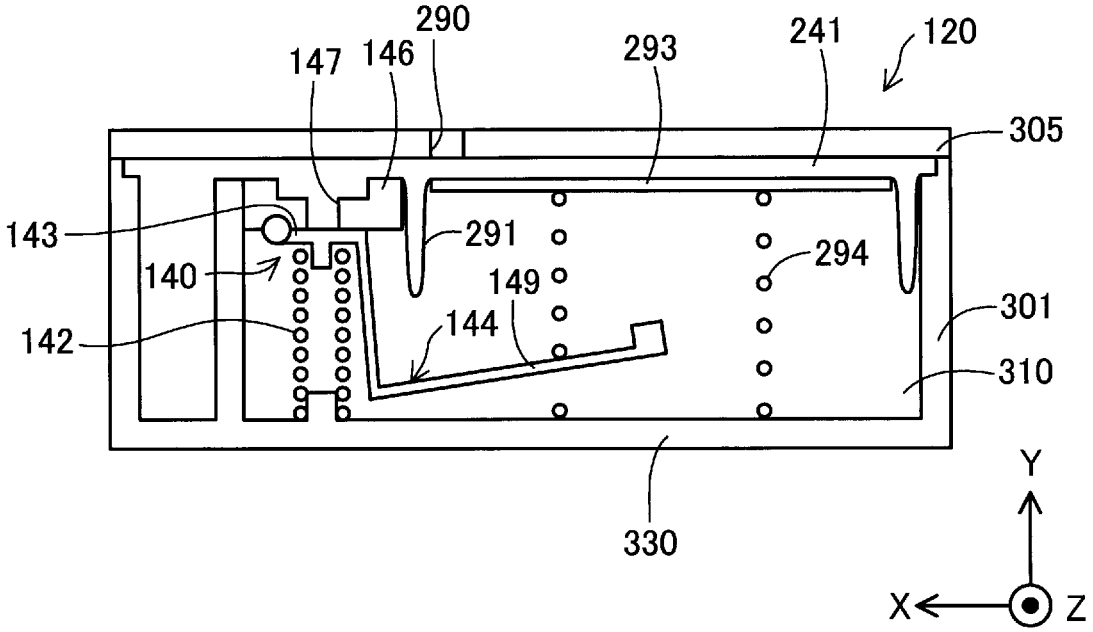
FIG. 21 is a diagram illustrating the operation of an air valve.
Figure 22:
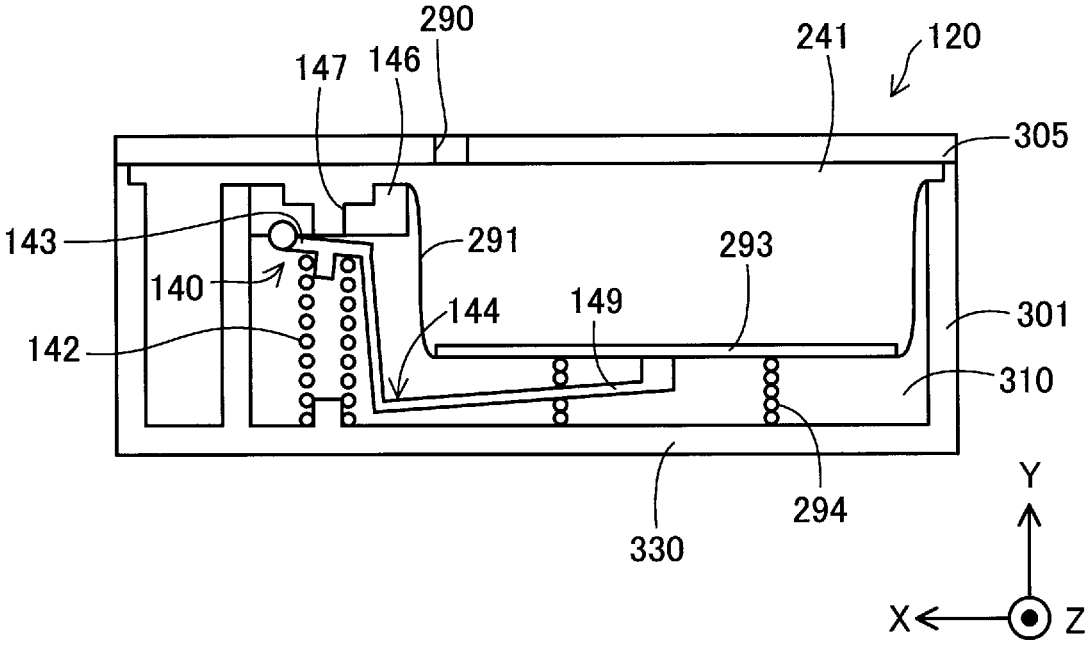
FIG. 22 is a diagram illustrating the operation of the air valve.
Figure 23:
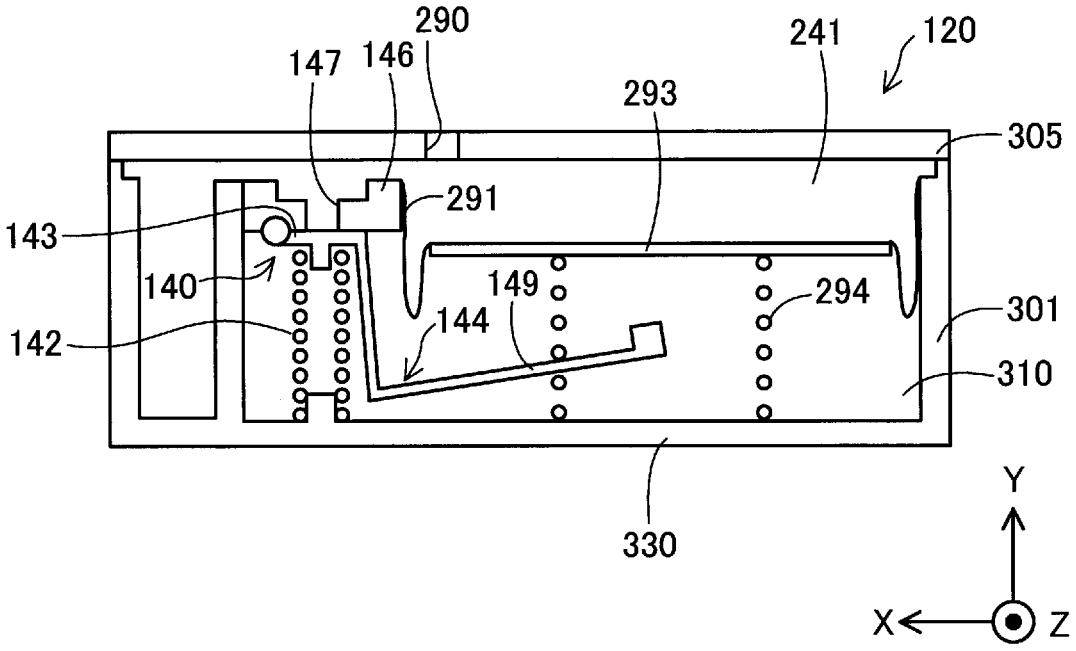
FIG. 23 is a diagram illustrating the operation of the air valve.

FIGS. 21 to 23 are diagrams illustrating the operation of the air valve 140 provided in the first chamber 310 of the cartridge 120. The first cover member 305 is provided with the air introducing hole 290. The first chamber 310 is defined by the main body member 301 and the first sheet member 291. An air chamber 241 is formed between the first cover member 305 and the first sheet member 291. The air chamber 241 communicates with the outside air via the air introducing hole 290 provided in the first cover member 305. The connecting holes 132*a* and 132*b* (see FIG. 14) provided in the bottom wall 201 of the cartridge 120 also communicate with the air chamber 241. The pressure receiving plate 293 and the coil spring 294 are placed inside of the first sheet member 291. The coil spring 294 biases the pressure receiving plate 293 and the first sheet member 291 in a direction of expanding the volume of the first chamber 310. The internal pressure of the first chamber 310 is maintained at a pressure (negative pressure) lower than the atmospheric pressure by the biasing force of this coil spring 294.

The air is introduced into the first chamber 310 via the air introducing hole 290, the air chamber 241 and the air introducing hole 147 at a specific timing. The air introducing hole 147 is a connecting hole configured to connect the first chamber 310 with the air chamber 241. The air valve 140 is a valve mechanism provided to open and close this air introducing hole 147. The air valve 140 includes the valve seat 146, the valving member 144 and the coil spring 142. The valving member 144 is pressed against the valve seat 146 by the coil spring 142 to close the air introducing hole 147 that is a through hole formed in the valve seat 146. The valving member 144 includes the valving element portion 143 provided to open and close the air introducing hole 147 and the lever portion 149 provided to abut on the pressure receiving plate 293 such that the valving element portion 143 is movable.

In the initial stage (or non-use state) of the cartridge 120, the first chamber 310 is filled with the liquid. In this state, the pressure receiving plate 293 is located at a position nearest to the first cover member 305 as shown in FIG. 21. When the pressure receiving plate 293 comes closers toward the partition wall 330 with consumption of the liquid in the first chamber 310, the pressure receiving plate 293 presses the lever portion 149 toward the partition wall 330 as shown in FIG. 22. This causes the valving element portion 143 to be separated from the air introducing hole 147 and thereby sets the valving member 144 in the valve open position. The outside air accordingly flows through the air introducing hole 290, the air chamber 241 and the air introducing hole 147 into the first chamber 310. The volume of the first chamber 310 is increased by the introduced amount of the air as shown in FIG. 23. Simultaneously, the internal pressure of the first chamber 310 comes closer to the atmospheric pressure with reducing the negative pressure. When a certain amount of the air is introduced into the first chamber 310, the pressure receiving plate 293 is separated from the lever portion 149. This causes the valving element portion 143 to close the air introducing hole 147 again and thereby sets the valving member 144 in the valve closed position. As described above, when the negative pressure in the first chamber 310 increases with consumption of the liquid, the valving member 144 is temporarily set in the valve open position, so as to maintain the internal pressure of the first chamber 310 in an appropriate pressure range. This configuration accordingly suppresses, for example, failed supply of the liquid from the liquid supply port 280 due to an excessive increase of the negative pressure in the first chamber 310.

The air valve 140 may be omitted. In this case, the air introducing hole 290 may be provided not in the first cover member 305 but in the upper wall 202 (see FIG. 17) to directly introduce the air from the air introducing hole 290 into the first chamber 310. Furthermore, a configuration that does not introduce the air into the first chamber 310 with omission of the air introducing hole 290 may also be employable. Employing the configuration that the air is introduced from the air introducing hole 290 into the first chamber 310 but is not directly introduced into the second chamber 320 like this embodiment, however, gives a long flow path from the air introducing hole 290 to the liquid supply port 280 and thereby provides such an advantage that air bubbles are unlikely to reach the liquid supply port 280 even when air bubbles are produced in the first chamber 310.

Figure 24:
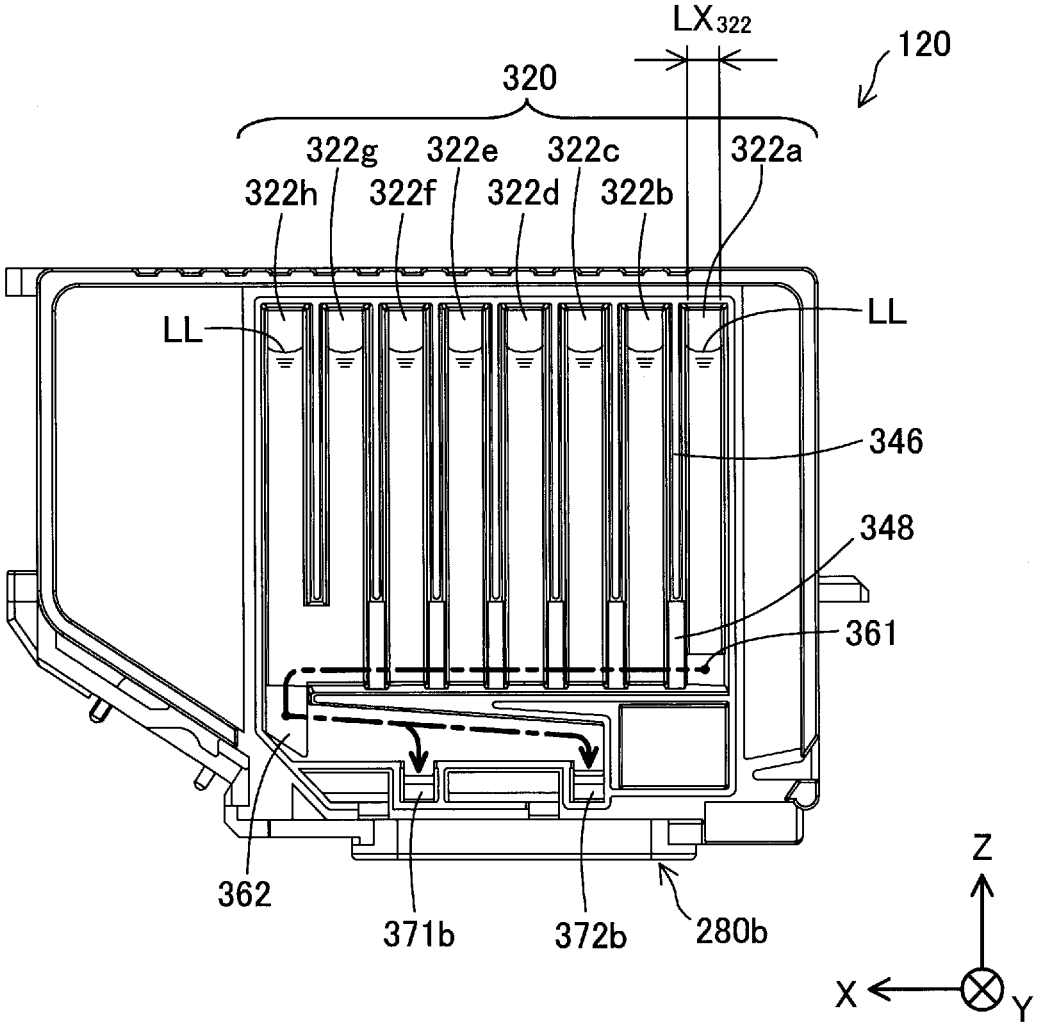
FIG. 24 is a diagram illustrating a change in liquid level in a second chamber.
Figure 25:
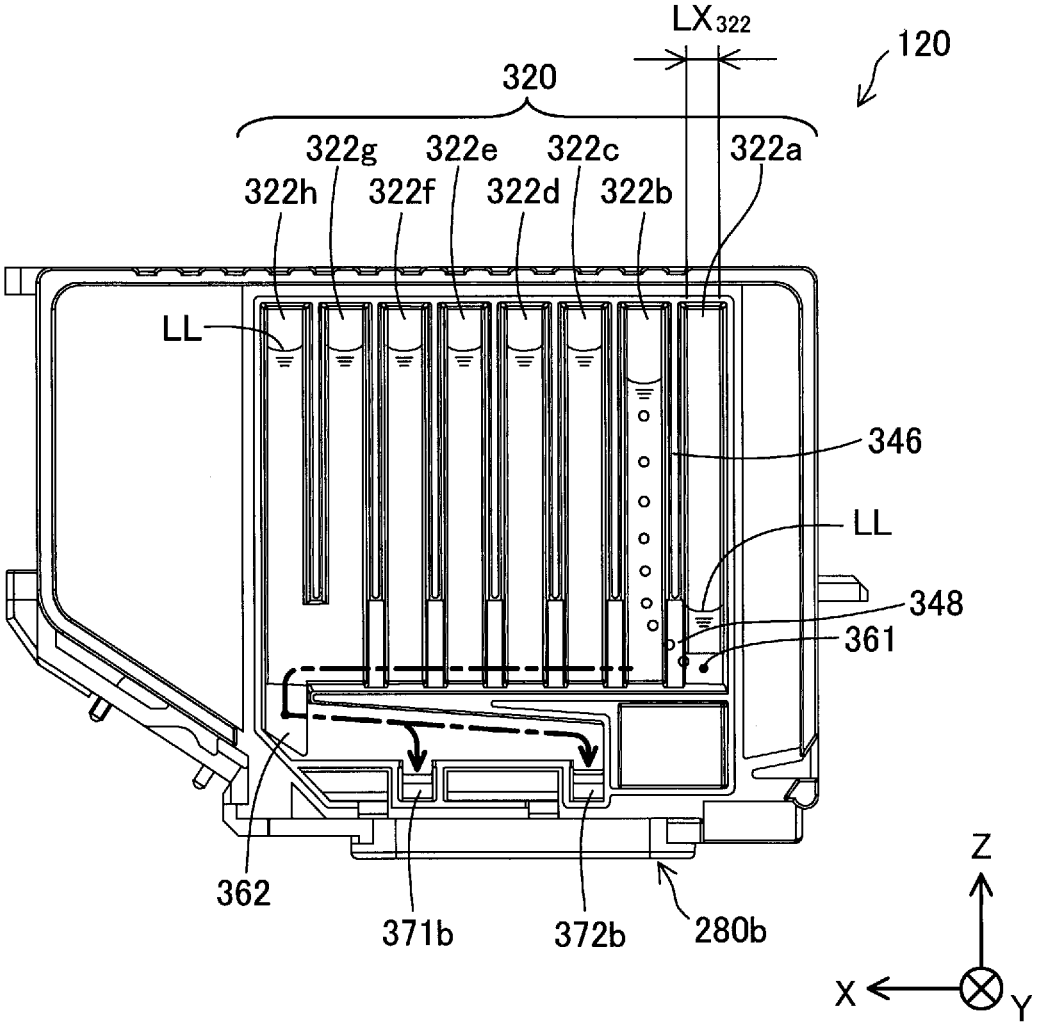
FIG. 25 is a diagram illustrating the change in liquid level in the second chamber.

FIG. 24 and FIG. 25 are diagrams illustrating a change in liquid level with consumption of the liquid in the second chamber 320. In the initial state (or non-use state) of the cartridge 120, the second chamber 320 is also filled with the liquid, and liquid levels LL in the plurality of sub-chambers 322 are near to the respective upper ends of the individual sub-chambers 322. In the ideal initial state, the sub-chambers 322 are completely filled with the liquid up to their respective upper ends, and no air is present in the sub-chambers 322. Some amount of the air may, however, be present in the sub-chambers 322. When the liquid in the first chamber 310 is mostly consumed and the liquid level in the first chamber 310 falls to the level of the connecting hole 361 provided to connect the first chamber 310 with the second chamber 320, the air is flowed from the first chamber 310 through the connecting hole 361 into the second chamber 320 according to the consumption of the liquid.

FIG. 25 illustrates the state that the air flows from the first chamber 310 into the sub-chambers 322 in the second chamber 320. When the air is accumulated in the first sub-chamber 322*a* and the liquid level LL in the first sub-chamber 322*a* falls to the upper end position of the inflow-output portion 348 between the first sub-chamber 322*a* and the second sub-chamber 322*b*, the air (or air bubbles) from the first chamber 310 is flowed into the second sub-chamber 322*b* according to the consumption of the liquid. As understood from this explanation, the amount of the liquid in the sub-chamber 322*a* on the most upstream side among the plurality of sub-chambers 322*a* to 322*h* arrayed in the X direction is decreased first, and the amount of the liquid in the sub-chamber 322*h* on the most downstream side is decreased last. The dimension $LX_{322}$ of each of the sub-chambers 322 in the X direction is smaller than the dimension $LX_{310}$ of the first chamber 310 in the X direction (see FIG. 17). This configuration suppresses the significant ripple of the liquid in the individual sub-chambers 322 accompanied by the move of the carriage 520 and thereby suppresses air bubbles from being produced in the sub-chambers 322.

In this embodiment, the plurality of sub-chambers 322 are arrayed in the X direction (or reciprocating direction of the carriage 520). This configuration accordingly further suppresses the ripple of the liquid in the second chamber 320 accompanied by the move of the carriage 520 and thereby further suppresses production of the air bubbles. Furthermore, In this embodiment, the plurality of sub-chambers 322 are not connected with one another in the vicinity of their upper ends. Even when air bubbles are produced and remain in any of the sub-chambers 322, this configuration prevents the air bubbles from moving to other sub-chambers 322 on the downstream side.

In this embodiment, eight sub-chambers 322 are provided. The number of the sub-chambers 322 may, however, be determined arbitrarily, and the second chamber 320 may be formed to include at least one sub-chamber 322. Providing two or more sub-chambers 322 in the second chamber 320, however, more efficiently reduces the possibility that air bubbles are mixed in the liquid that is supplied from the liquid supply port 280 to the liquid introducing portion 640.

Figure 26:
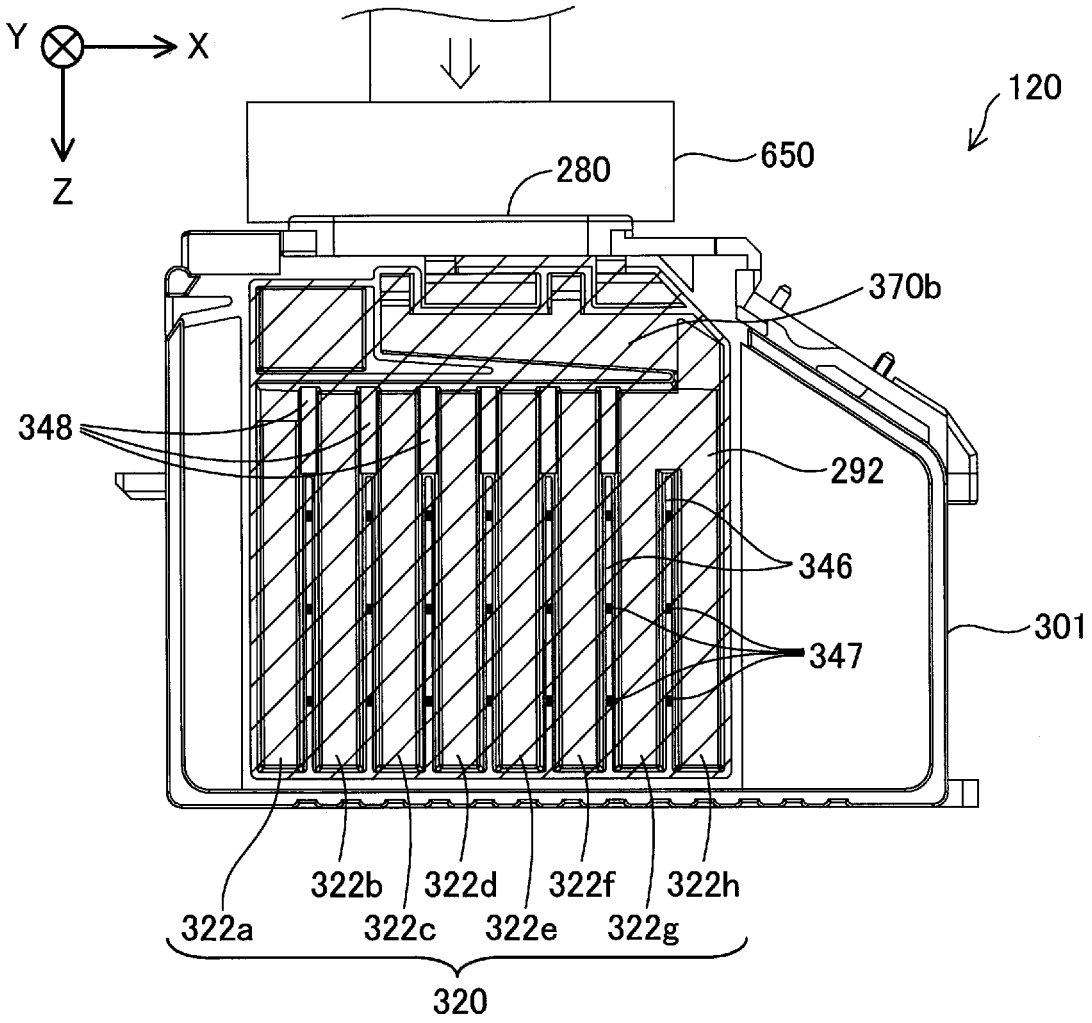
FIG. 26 is a diagram illustrating a liquid filling state in the process of manufacturing the large-size cartridge.
Figure 27:
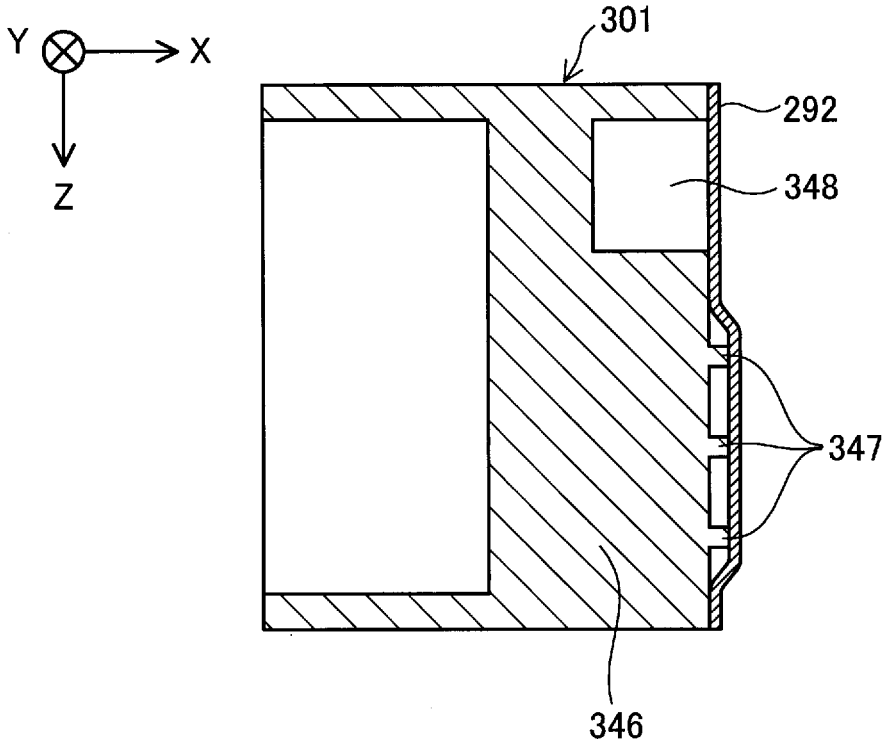
FIG. 27 is a diagram illustrating the liquid filling state in the process of manufacturing the large-size cartridge.

FIG. 26 and FIG. 27 are diagrams illustrating the liquid filling state in the process of manufacturing the cartridge 120. FIG. 26 illustrates the state that the second cover member 306 on the rear face side of the cartridge 120 is not attached and the cartridge 120 is turned upside down. A liquid fill port 650 of a manufacturing apparatus is connected with the two liquid supply ports 280. The second sheet member 292 (shown by hatching) is joined with the rear face wall portion of the main body member 301 to seal the liquid containing space including the second chamber 320 and the second branch flow path 370*b*. The first sheet member 291 (see FIG. 15) is similarly joined with the front face wall portion of the main body member 301 to seal the liquid containing space including the first chamber 310 and the first branch flow path 370*a* (see FIG. 17), although not being specifically illustrated.

FIG. 27 is a sectional view of a main part illustrating the second sheet member 292 joined with the sub-partition wall 346 in the state of FIG. 26. A plurality of projections 347 are formed on the sub-partition wall 346, and gaps between the sub-partition wall 346 and the second sheet member 292 in the vicinity of the projections 347 form connecting paths of the fluid.

During liquid filling, while the air introducing hole 290 (see FIG. 7) is closed, the liquid is filled from the liquid fill port 650 after the liquid containing space in the cartridge 120 is evacuated via the liquid fill port 650 (see FIG. 26). The liquid is flowed through the connecting paths in the vicinity of the projection 347 and is thus readily filled into the cartridge 120. On completion of the liquid filling, the second sheet member 292 is welded to the sub-partition wall 346 by application of heat and pressure such as to crush the projections 347. After completion of such liquid filling, the cartridge 120 is covered by the protective cap and is appropriately packaged for shipment.

Figure 28:
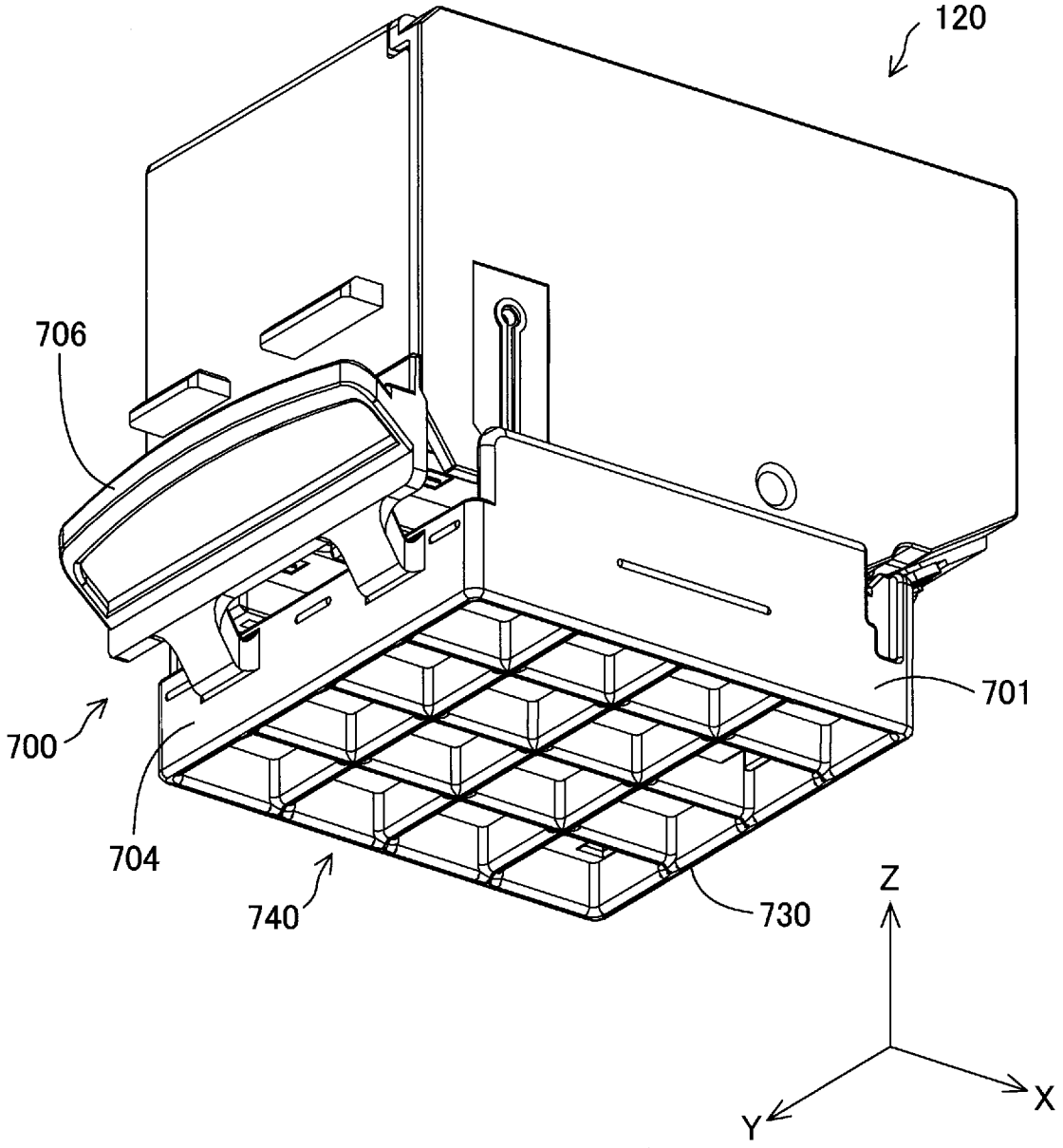
FIG. 28 is a perspective view illustrating the large-size cartridge with a protective cap attached thereto.
Figure 29:
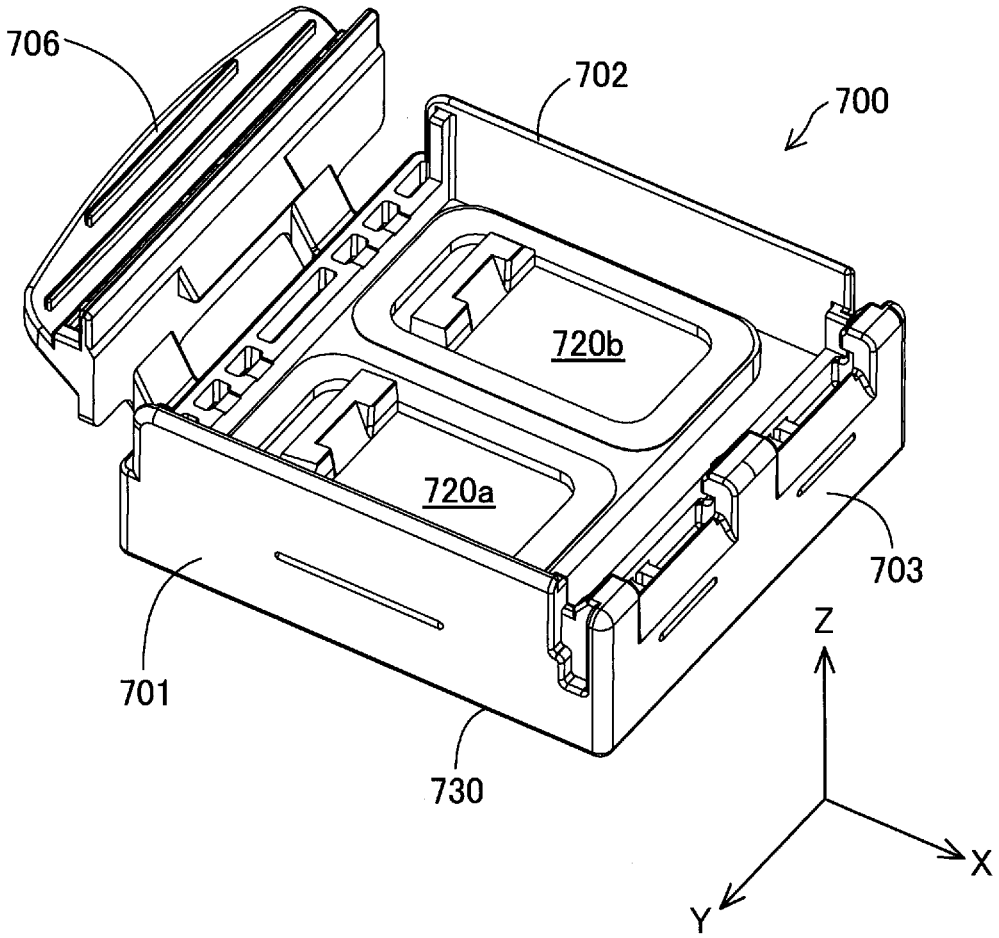
FIG. 29 is a perspective view illustrating the protective cap for large-size cartridge.
Figure 30:
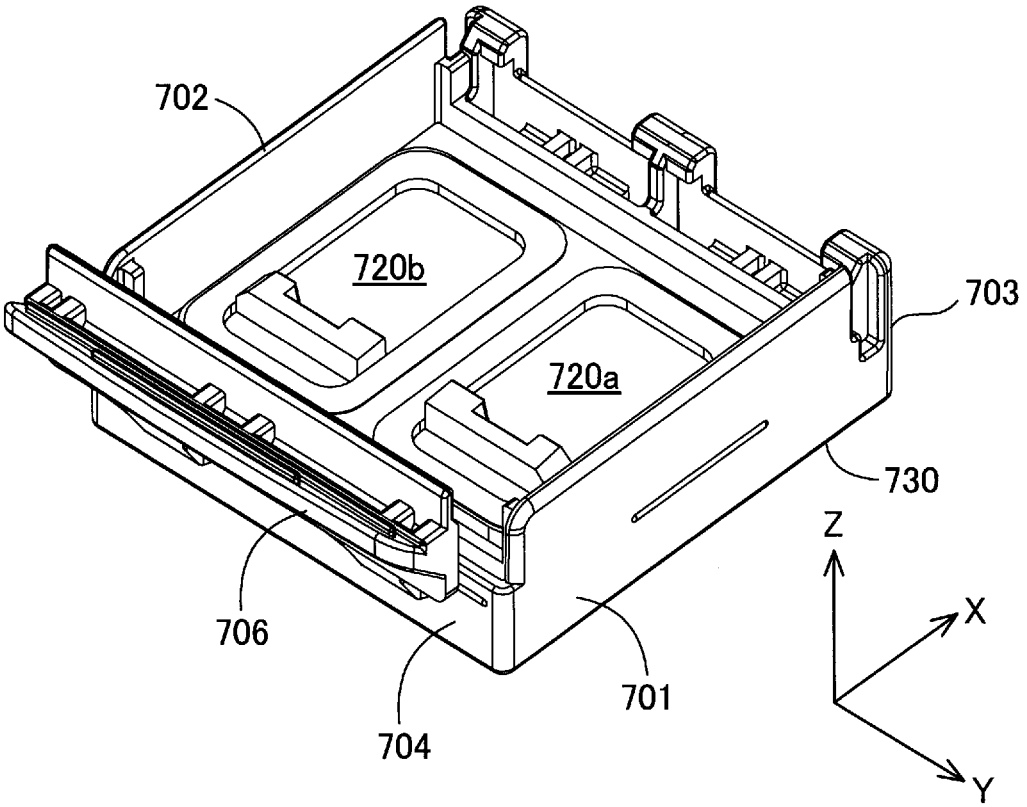
FIG. 30 is a perspective view illustrating the protective cap for large-size cartridge.

FIG. 28 is a perspective view illustrating the large-size cartridge 120 with a protective cap 700 attached thereto. FIG. 29 and FIG. 30 are perspective views illustrating the protective cap 700 alone. The protective cap 700 includes a cap main body 740 configured to cover almost the whole lower end portion including the first wall portion 201 of the cartridge 120, and a lever-type engagement element 706. The cap main body 740 includes a bottom wall portion 730 and four side wall portions 701, 702, 703 and 704.

The bottom wall portion 730 has an approximately rectangular shape and includes a bottom face that is formed in a lattice pattern. The bottom wall portion 730 is opposed to the first wall portion 201 (or bottom wall) of the cartridge 120. Two seal portions 720*a* and 720*b* are placed in a recess on the upper face side of the bottom wall portion 730. The liquid supply ports 280*a* and 280*b* of the cartridge 120 are covered by these seal portions 720*a* and 720*b*.

The lever-type engagement element 706 is provided on the −X direction side of the fourth side wall portion 704. The user uses the lever-type engagement element 706 to remove the protective cap 700 from the cartridge 120. The user places a finger on the lever-type engagement element 706 and rotates the lever-type engagement element 706 to detach the protective cap 700 from the cartridge 120. The lever-type engagement element 706 is slightly inclined obliquely upward for the user's easy operation.

As described above, according to the first embodiment, the second chamber 320 including the sub-chambers 322 that have the smaller dimension in the X direction than that of the first chamber 310 are provided on the downstream side of the first chamber 310. This configuration makes it unlikely to produce air bubbles in the sub-chambers 322 even during reciprocation of the carriage 520 in the X direction. Even when air bubbles are produced in the first chamber 310, the sub-chambers 322 serve as the air bubble trap flow path. This configuration accordingly suppresses the phenomenon that air bubbles are mixed in the liquid that is supplied to the liquid introducing portion 640 of the holder 560.

C. Configuration of Small-Size Cartridge 120S

Figure 31:
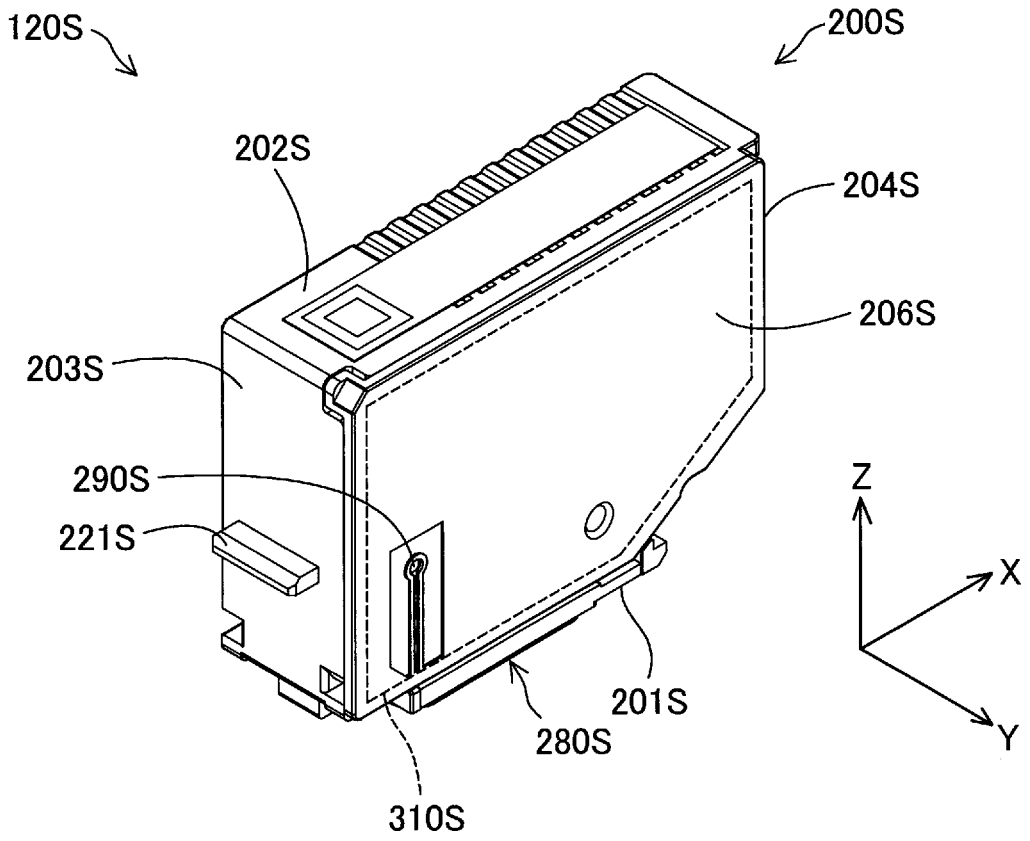
FIG. 31 is a perspective view illustrating the small-size cartridge.
Figure 32:
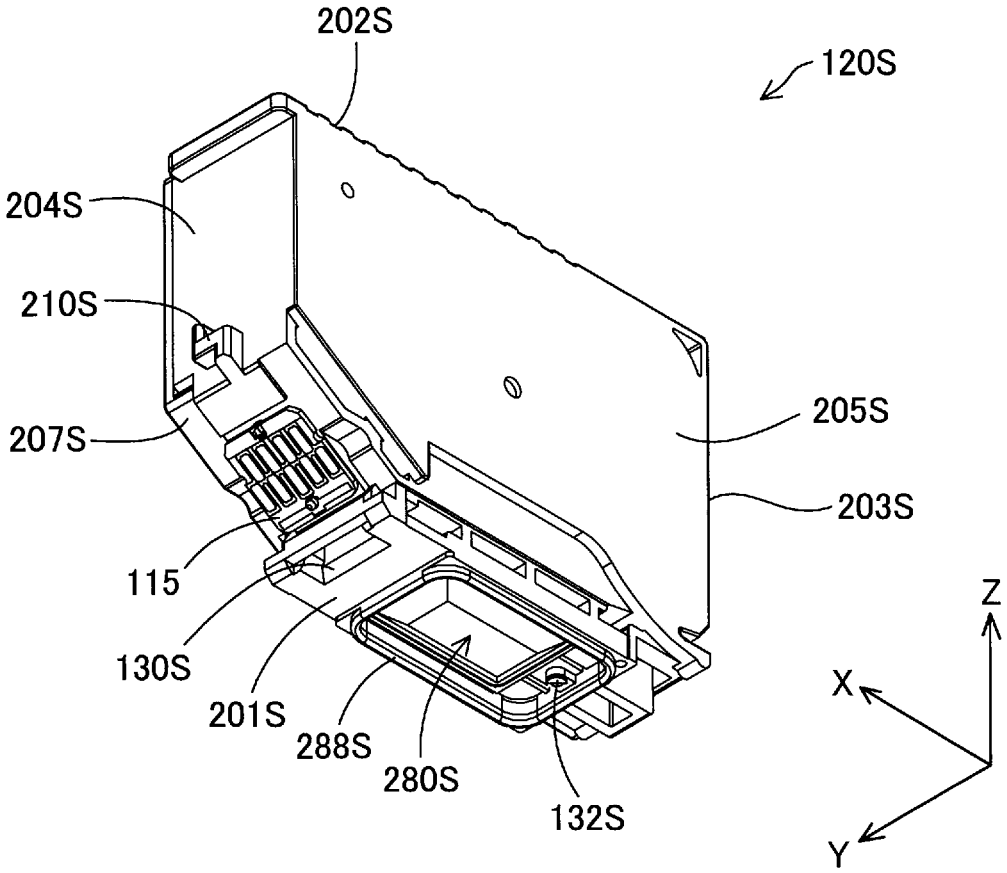
FIG. 32 is a perspective view illustrating the small-size cartridge.
Figure 33:
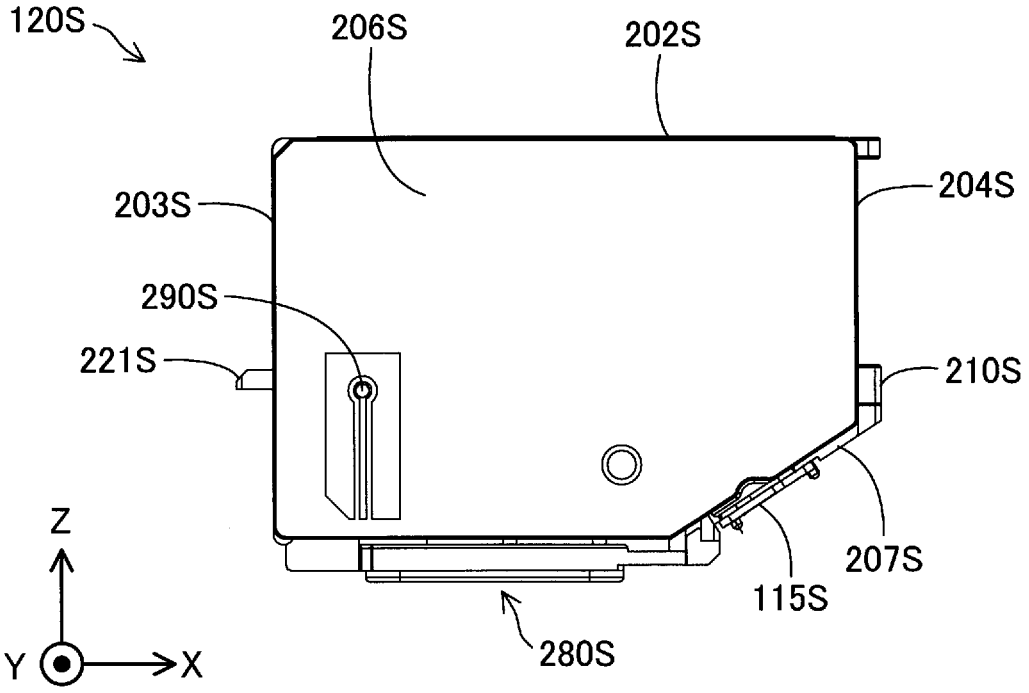
FIG. 33 is a front view illustrating the small-size cartridge.
Figure 34:
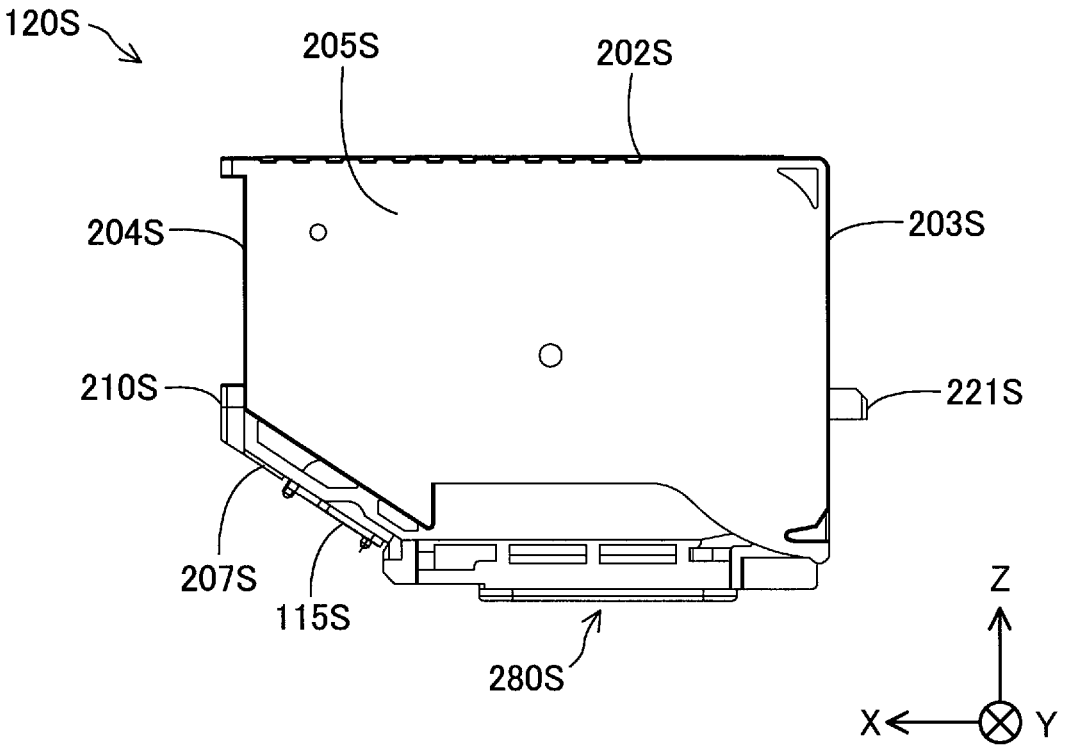
FIG. 34 is a rear view illustrating the small-size cartridge.
Figure 35:
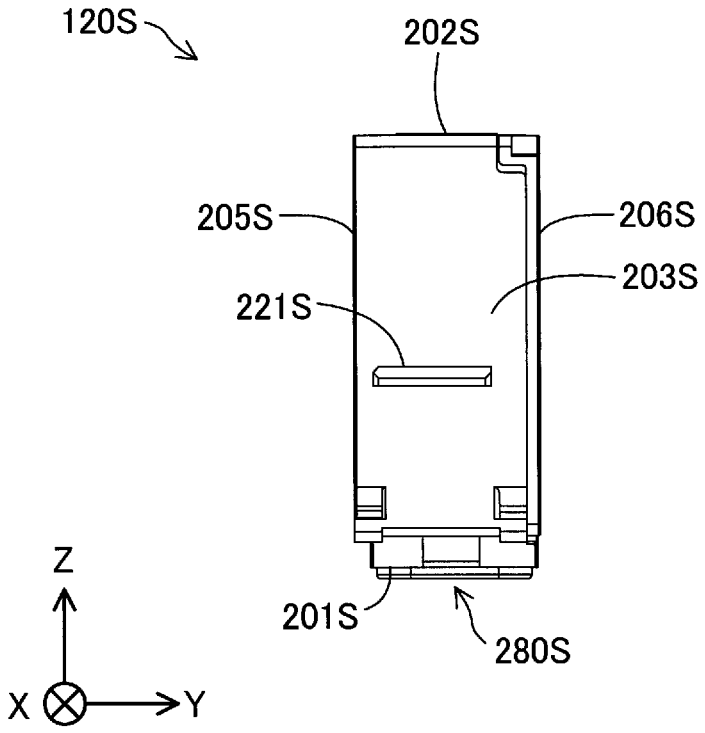
FIG. 35 is a left side view illustrating the small-size cartridge.
Figure 36:
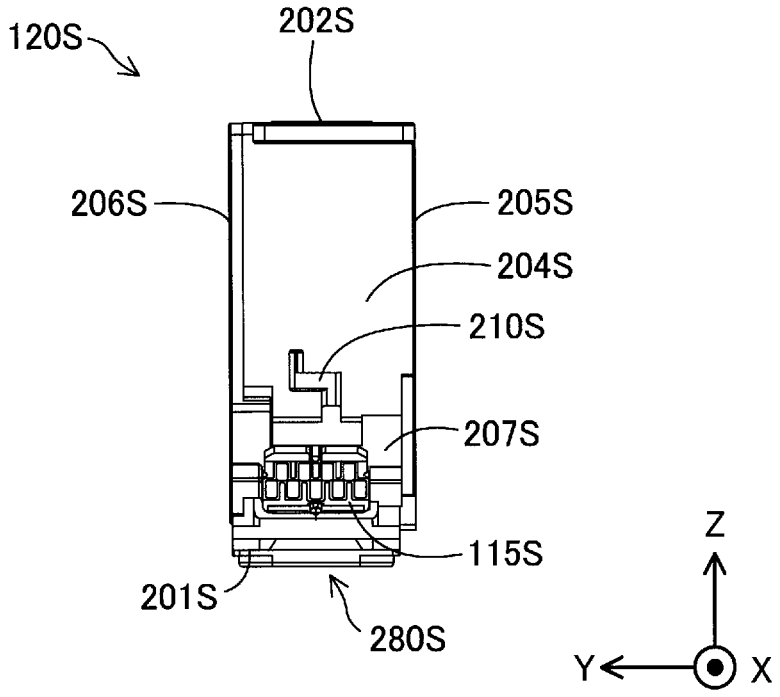
FIG. 36 is a right side view illustrating the small-size cartridge.
Figure 37:
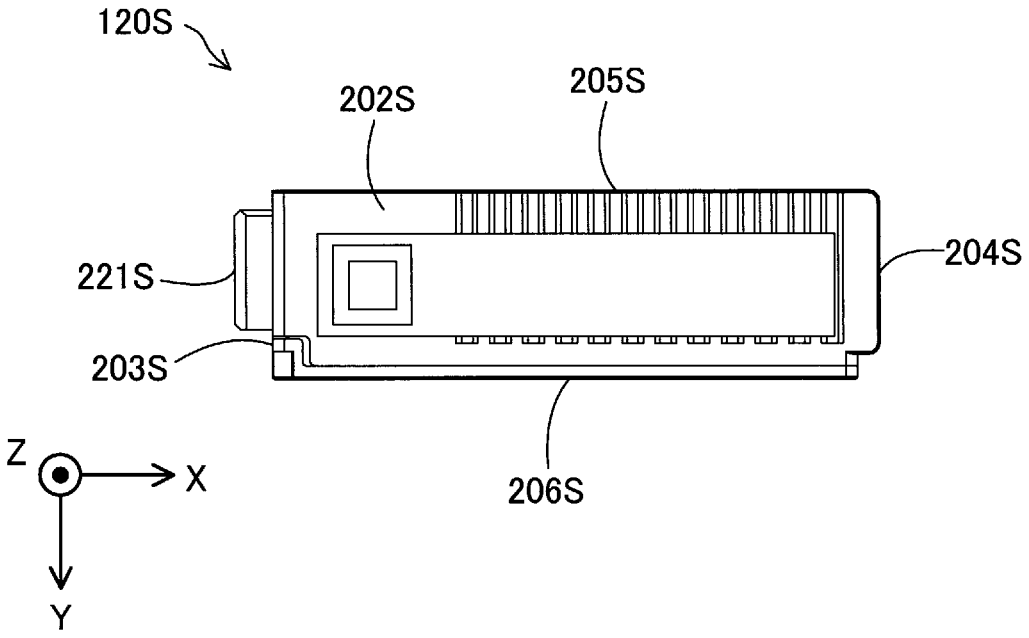
FIG. 37 is a plan view illustrating the small-size cartridge.
Figure 38:
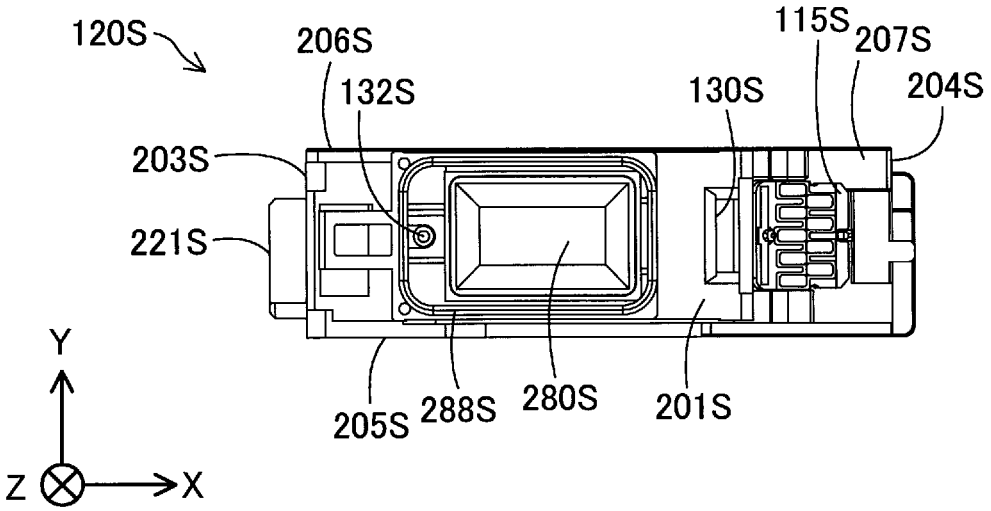
FIG. 38 is a bottom view illustrating the small-size cartridge.

FIG. 31 and FIG. 32 are perspective views illustrating the configuration of the small-size cartridge 120S, and FIGS. 33 to 38 are its six view drawings (front view, rear view, left side view, right side view, plan view and bottom view). In the description of the small-size cartridge 120S, components identical with or corresponding to those of the large-size cartridge 120 are expressed by the same reference signs to those of the components of the cartridge 120 with addition of the suffix "S", and their description is partly omitted.

The small-size cartridge 120S includes seven wall portions 201S to 207S. These seven wall portions 201S to 207S constitute an outer shell 200S of a liquid chamber 310S configured to contain the liquid therein. A first wall portion 201S (see FIG. 32) is provided with a liquid supply port 280S, its outer circumferential wall 288S and a positioning structure 130S. Only one liquid supply port 280S is provided in the small-size cartridge 120S. A connecting hole 132S for the air is formed inside of the outer circumferential wall 288S (see FIG. 38). A first cartridge-side restriction structure 210S of a projected shape is formed on a fourth wall portion 204S (see FIG. 32). A second cartridge-side restriction structure 221S of a projected shape is formed on a third wall portion 203S (see FIG. 35). An air introducing hole 290S is formed on a fifth wall portion 205S (see FIG. 31) to introduce the air into the cartridge 120S. A substrate 115S is placed on a seventh wall portion 207S (see FIG. 32). This substrate 115S is identical with the substrate 115 used for the large-size cartridge 120.

Figure 39:
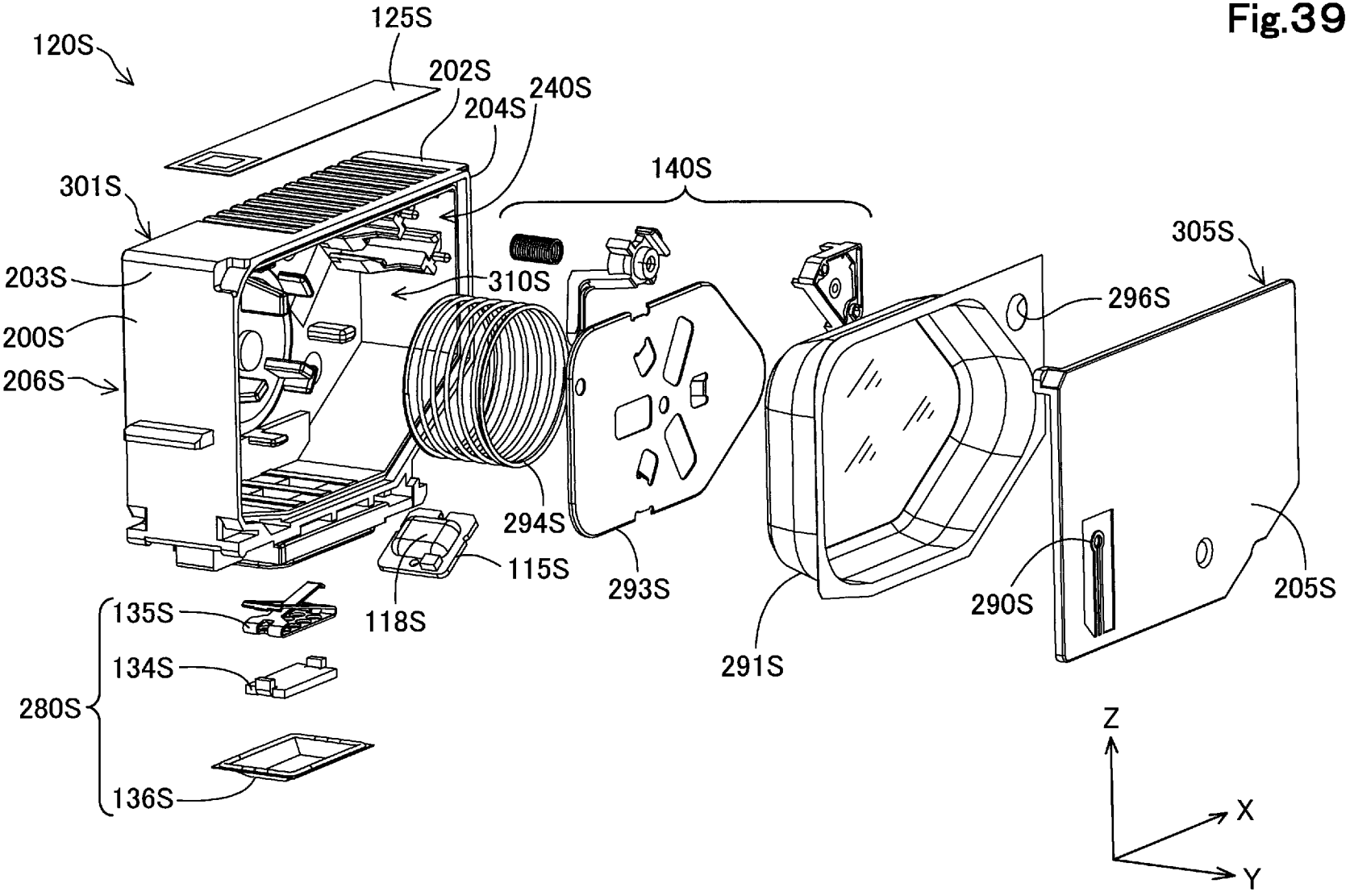
FIG. 39 is an exploded perspective view illustrating the small-size cartridge.

FIG. 39 is an exploded perspective view illustrating the small-size cartridge 120S. The cartridge 120S includes a main body member 301S, a cover member 305S on the front face side, and a sheet member 291S. The main body member 301S is a bottomed member of an approximately rectangular parallelepiped shape. More specifically, a wall portion 206S opposed to the cover member 305S in the Y direction is part of the main body member 301S. The small-size cartridge 120S does not have a second chamber and is accordingly not provided with the partition wall 330 (see FIG. 15). The cover member 305S is attached to the main body member 301S to cover the sheet member 291S. The sheet member 291S is provided with a through hole 296S that communicates with an air valve 140S. In the illustrated example of FIG. 40, the sheet member 291S is shown to have a center portion that is extended and recessed. During assembly of the cartridge 120S, however, the sheet member 291S is a flat film-like member like the sheet member 291 shown in FIG. 15.

A pressure receiving plate 293S, a coil spring 294S and the air valve 140S are placed inside of the liquid chamber 310S. This air valve 140S has similar functions to those of the air valve 140 described above with reference to FIGS. 21 to 23. A flat spring 135S, a liquid-permeable porous member 134S and a cartridge-side filter 136S are sequentially fit in the liquid supply port 280S provided on the bottom face of the main body member 301S. The substrate 115S including a memory device 118S is fixed to the seventh wall portion 207S of the main body member 301S (see FIG. 32). A label 125S is applied on an outer surface of the second wall portion 202S of the main body member 301S.

Figure 40:
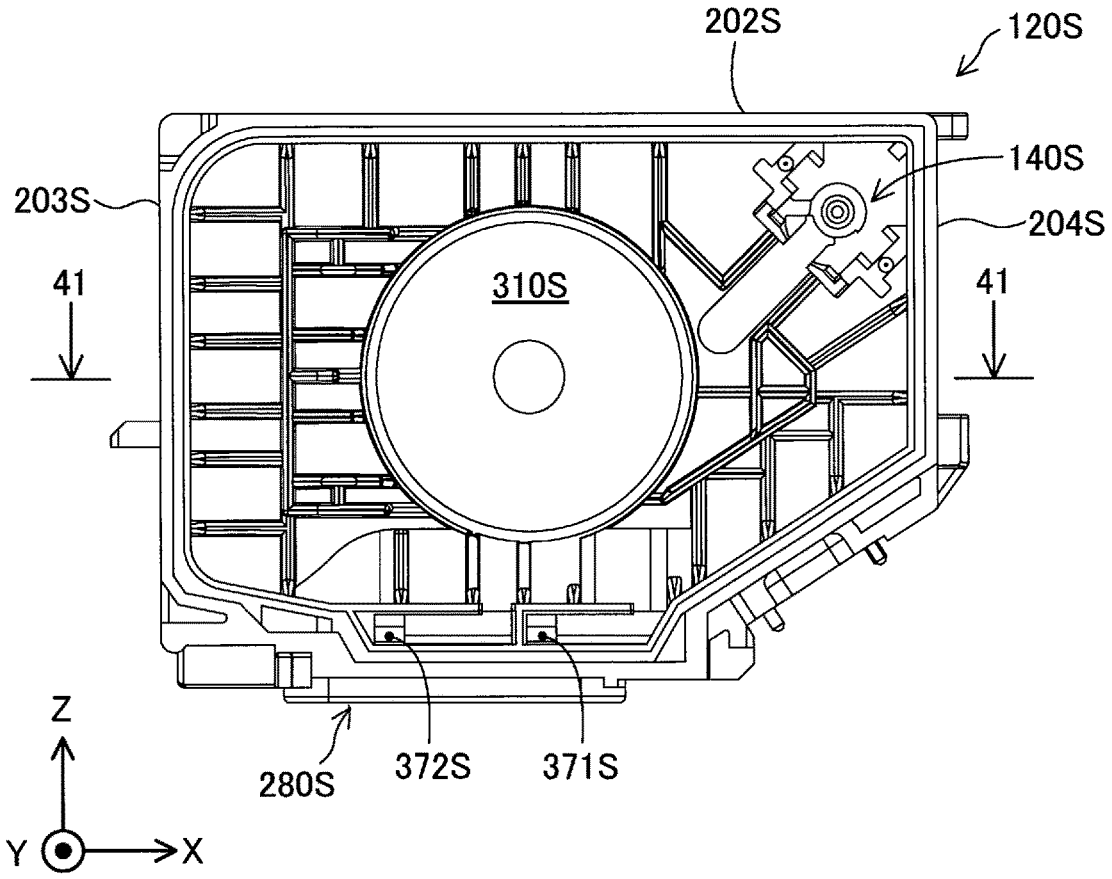
FIG. 40 is a front view illustrating a main body member of the small-size cartridge.
Figure 41:
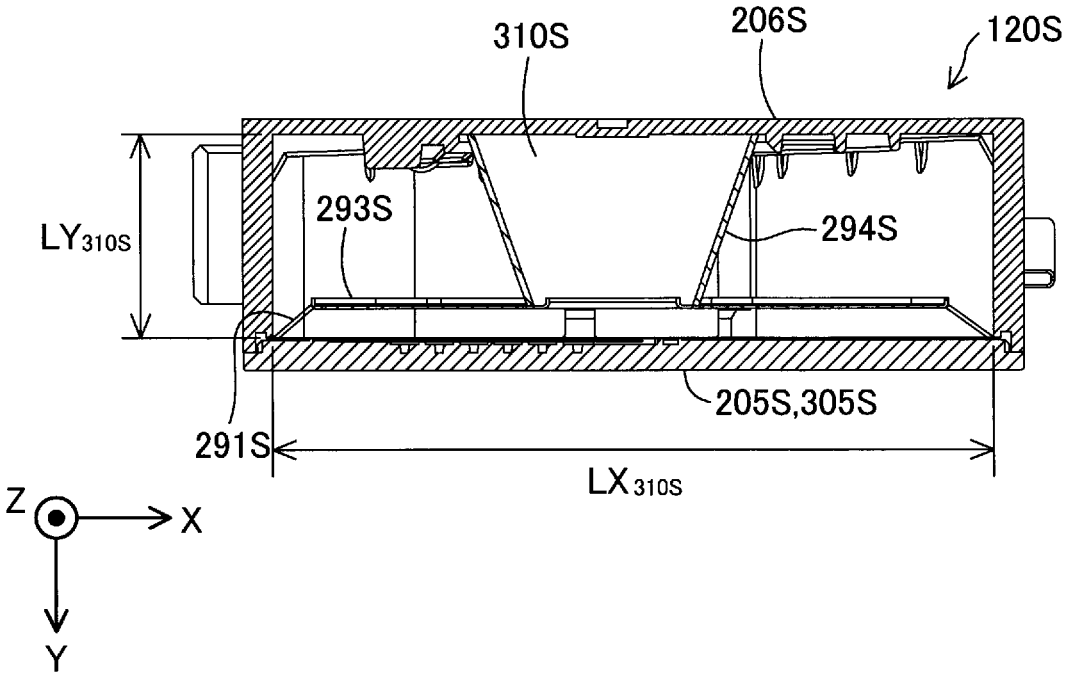
FIG. 41 is a sectional view illustrating a section 41-41 in FIG. 40.

FIG. 40 and FIG. 41 illustrate the configuration of the main body member 301S. FIG. 40 is a front view illustrating the main body member 301S, and FIG. 41 is a sectional view illustrating a section 41-41 in FIG. 40. The liquid chamber 310S is formed on the +Y direction side of the sixth wall portion 206S of the main body member 301S. This liquid chamber 310S corresponds to the first chamber 310 of the large-size cartridge 120. A dimension $LX_{310S}$ in the X direction and a dimension $LY_{310S}$ in the Y direction of the liquid chamber 310S are approximately equal to the dimension $LX_{310}$ in the X direction (see FIG. 19) and a dimension $LY_{310}$ in the Y direction of the first chamber 310 of the large-size cartridge 120, respectively. The small-size cartridge 120S does not have a chamber corresponding to the second chamber 320 of the large-size cartridge 120. A +Y direction side of the liquid chamber 310S is sealed by the sheet member 291S. Two supply port connecting paths 371S and 372S that are connected with the liquid supply port 280S are formed in the bottom of the liquid chamber 310S (FIG. 40).

The small-size cartridge 120S is provided with the liquid chamber 310S corresponding to the first chamber 310 of the large-size cartridge 120 but is not provided with a liquid chamber corresponding to the second chamber 320. The liquid contained in the liquid chamber 310S is flowed from the liquid chamber 310S, reaches the liquid supply port 280S through the two supply port connecting paths 371S and 372S, and flows out from the liquid supply port 280S to the liquid introducing portion 640 of the holder 560.

The small-size cartridge 120S without the second chamber 320 including the sub-chambers 322 may have a slightly higher possibility that air bubbles are produced in the liquid chamber 310S, compared with the large-size cartridge 120. The air valve 140S having the same functions to those of the air valve 140 described above with reference to FIGS. 21 to 23 is, however, provided in the liquid chamber 310S. With consumption of the liquid contained in the liquid chamber 310S, the pressure receiving plate 293S and the sheet member 291S approach the sixth wall portion 206S (see FIG. 41) to decrease the substantive dimension of the liquid chamber 310S in the Y direction. The liquid chamber 310S of the small-size cartridge 120S is configured to decrease its dimension with a decrease in amount of the liquid. This configuration sufficiently suppresses production of air bubbles in the liquid chamber 310S during reciprocation of the cartridge 120S in the X direction, compared with a configuration that does not change the dimension in spite of a decrease in amount of the liquid. The small-size cartridge 120S accordingly does not have any practical problem with regard to production of air bubbles. In the large-size cartridge 120 described above, the second chamber 320 located on the downstream side of the first chamber 310 does not include a mechanism such as the air valve 140. It is accordingly preferable that the second chamber 320 includes the sub-chambers 322 of the smaller dimension than that of the first chamber 310, in order to suppress production of air bubbles.

Figure 42:
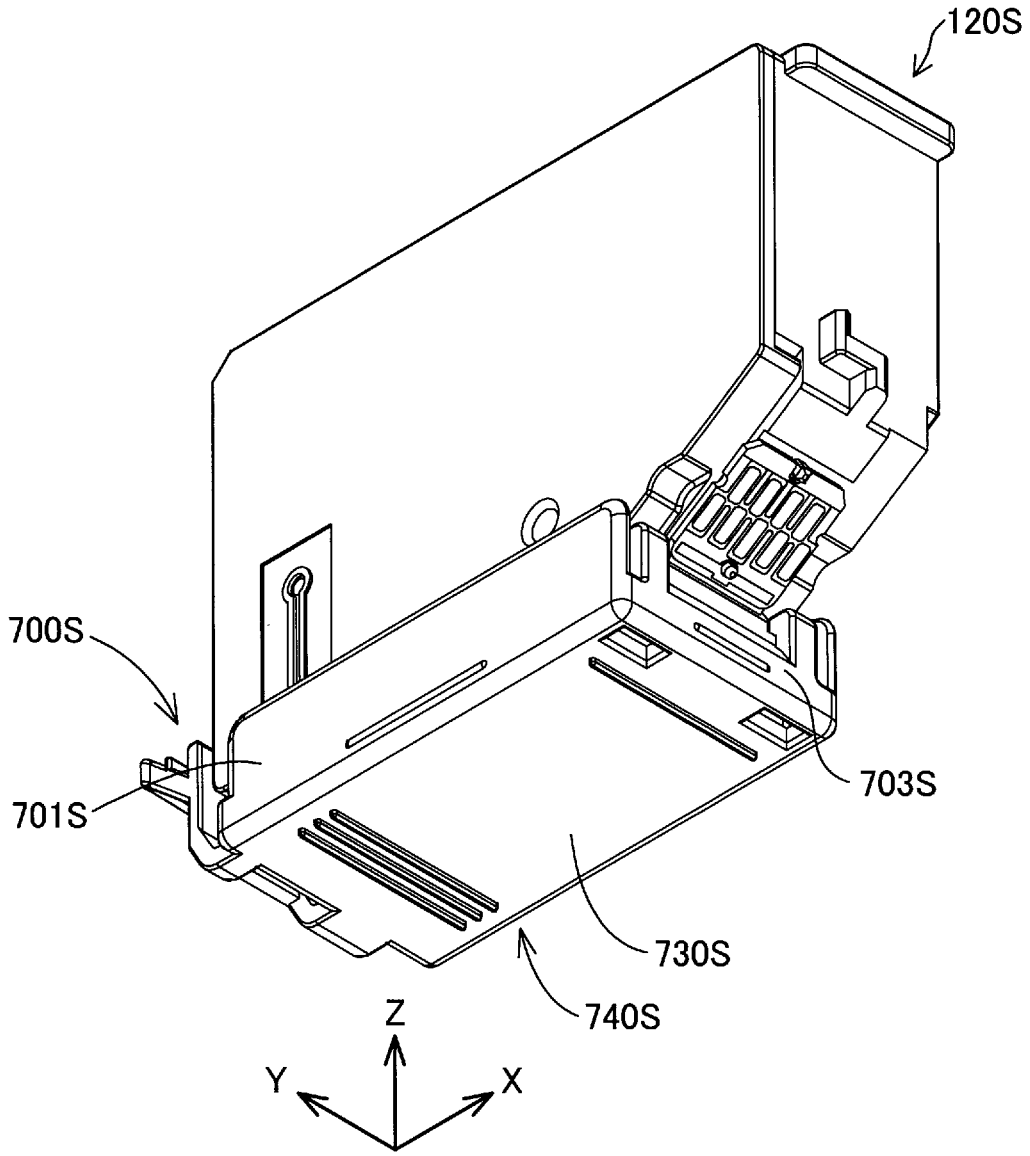
FIG. 42 is a perspective view illustrating the small-size cartridge with a protective cap attached thereto.
Figure 43:
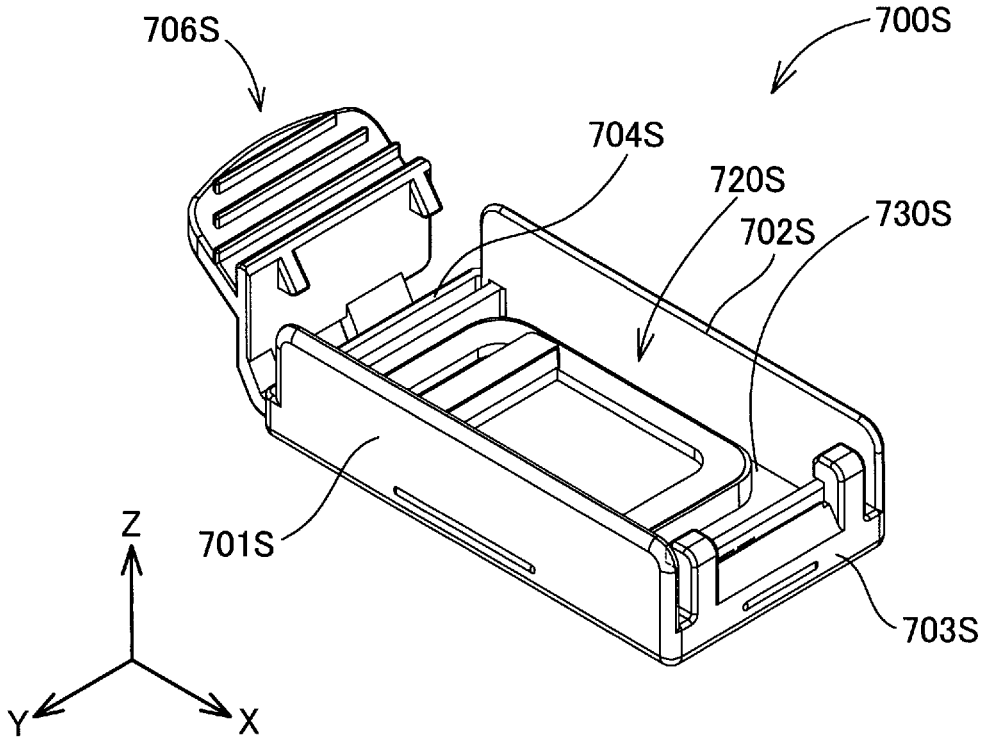
FIG. 43 is a perspective view illustrating the protective cap for the small-size cartridge.
Figure 44:
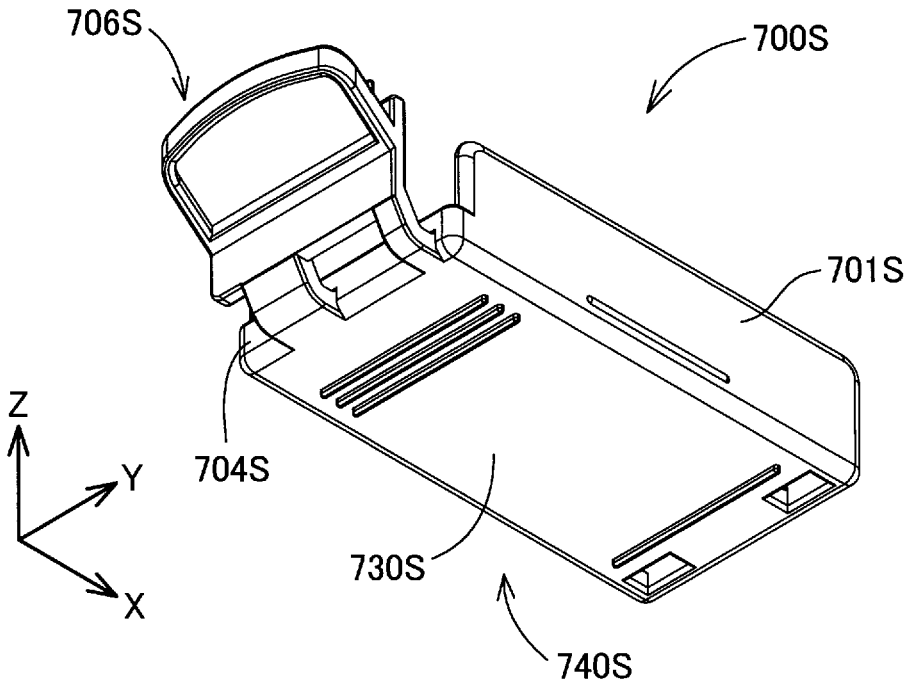
FIG. 44 is a perspective view illustrating the protective cap for the small-size cartridge.

FIG. 42 is a perspective view illustrating the small-size cartridge 120S with a protective cap 700S attached thereto. FIG. 43 and FIG. 44 are perspective views illustrating the protective cap 700S alone. The protective cap 700S includes a cap main body 740S configured to cover almost the whole lower end portion including the first wall portion 201S of the cartridge 120S, and a lever-type engagement element 706S. The cap main body 740S includes a bottom wall portion 730S and four side wall portions 701S, 702S, 703S and 704S.

The bottom wall portion 730S has an approximately rectangular shape and includes a bottom face that is formed flat. A seal portion 720S is placed in a recess on the upper face side of the bottom wall portion 730S. The liquid supply port 280S of the cartridge 120S is covered by this seal portion 720S. The lever-type engagement element 706S is provided on the −X direction side of the fourth side wall portion 704S. The user uses the lever-type engagement element 706S to remove the protective cap 700S from the cartridge 120S.

As described above with reference to FIG. 1, FIG. 5 and FIG. 6, the large-size cartridge 120 and the small-size cartridge 120S can be mounted to the holder 560 of the printer 150 simultaneously. Which cartridge and what number of cartridges are to be mounted may be set arbitrarily as needed basis.

D. Other Embodiments

Figure 45:
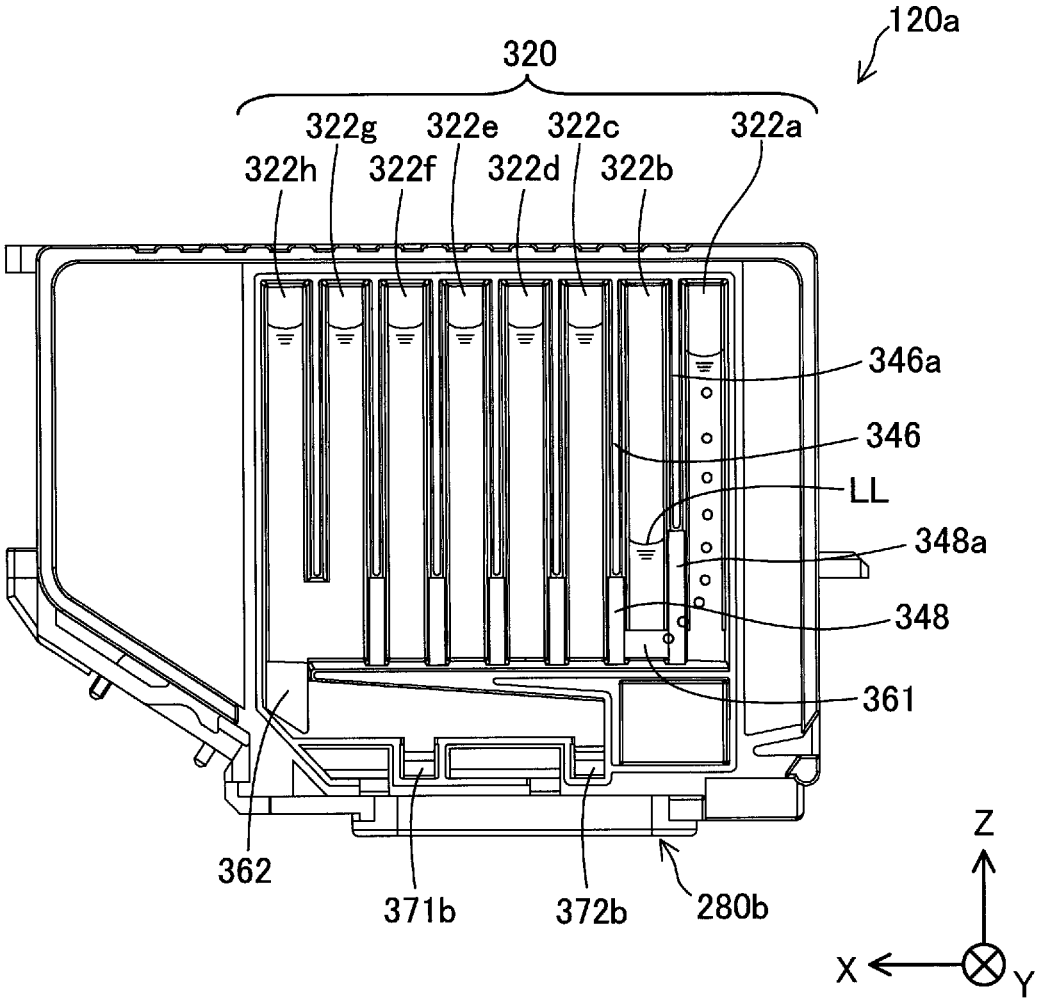
FIG. 45 is a diagram illustrating a second chamber of a cartridge according to a second embodiment.

FIG. 45 illustrates the configuration of a second chamber 320 of a large-size cartridge 120*a* according to a second embodiment. This drawing corresponds to FIG. 25 of the first embodiment. The cartridge 120*a* of the second embodiment differs from the cartridge 120 of the first embodiment by the following two points, but the other configuration is the same with that of the cartridge 120 of the first embodiment:

(1) The connecting hole 361 between the first chamber 310 and the second chamber 320 is provided in the bottom of the second sub-chamber 322*b*.

(2) The dimension in the Z direction of a sub-partition wall 346*a* between the first two sub-chambers 322*a* and 322*b* is shorter those of the other sub-partition walls 346, and the dimension in the Z direction of an inflow-outflow portion 348*a* provided below this sub-partition wall 346*a* is longer than those of the other inflow-outflow portions 348.

FIG. 45 illustrates the state that the air flows from the first chamber 310 into the sub-chambers 322 in the second chamber 320. When the air is accumulated in the second sub-chamber 322*b* and the liquid level LL in the second sub-chamber 322*b* falls to the upper end position of the inflow-outflow portion 348*a* between the first two sub-chambers 322*a* and 322*b*, the air from the first chamber 310 is flowed into the first sub-chamber 322*a* according to the consumption of the liquid. In the second embodiment, the amount of the liquid in the second most upstream-side sub-chamber 322*b* is decreased first among the plurality of sub-chambers 322*a* to 322*h* arrayed in the X direction. The subsequent change in amount of the liquid is similar to the first embodiment, and the amounts of the liquid in the third to the eighth sub-chambers 322*c* to 322*h* are sequentially decreased. As understood from this example, the connecting hole 361 between the first chamber 310 and the second chamber 320 may not be necessarily provided in the most upstream-side sub-chamber 322*a* but may be provided in another sub-chamber. It is, however, preferable that the two connecting holes 361 and 362 are not provided in the same sub-chamber 322 (for example, in the most downstream-side sub-chamber 322*h*) but are provided in different sub-chambers 322. The configuration that the two connecting holes 361 and 362 are provided at separate positions in the X direction gives a relatively long flow path from the first chamber 310 to the liquid supply port 280 and thereby makes it unlikely that air bubbles reach the liquid supply port 280.

Figure 46:
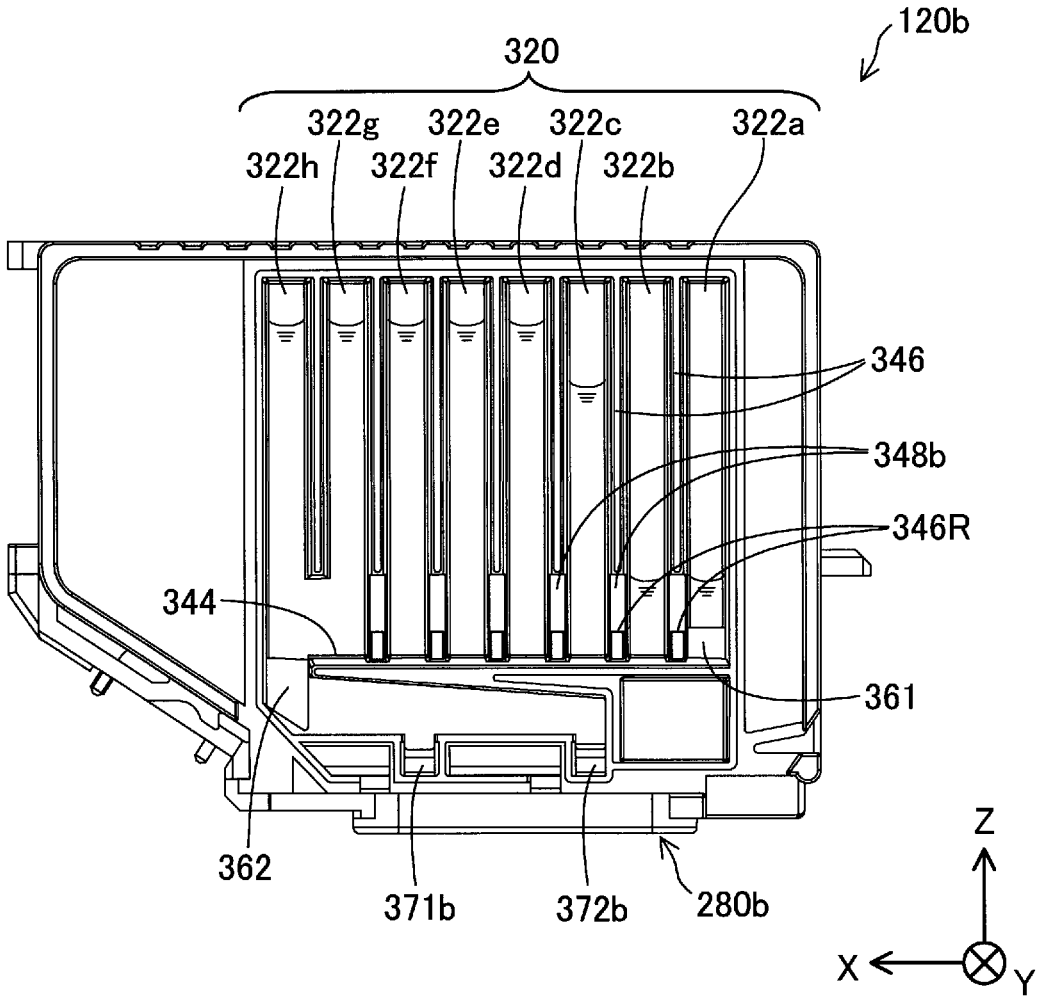
FIG. 46 is a diagram illustrating a second chamber of a cartridge according to a third embodiment.

FIG. 46 illustrates the configuration of a second chamber 320 of a large-size cartridge 120*b* according to a third embodiment. The cartridge 120*b* of the third embodiment differs from the cartridge 120 of the first embodiment by the following point, but the other configuration is the same with that of the cartridge 120 of the first embodiment:

(1) Ribs 346R are provided below the sub-partition walls 346 and are extended upward (in the +Z direction) from the bottom face wall portion 344 of the second chamber 320, and the dimension in the Z direction of an inflow-outflow portion 348*b* between the sub-partition wall 346 and the rib 346R is shorter than that of the inflow-outflow portion 348 of the first embodiment.

It may be regarded that the rib 346R is provided between bottoms of adjoining sub-chambers 322. Like the sub-partition walls 346, Y-direction end faces of the respective ribs 346R are joined with the second sheet member 292 (see FIG. 16).

In this cartridge 120*b*, a recess is formed between adjoining ribs 346R below the sub-chambers 322. When the liquid in the second chamber 320 decreases, the liquid is trapped in the recess between the adjoining ribs 346R. For example, when the liquid contains a sedimentation component such as pigment, the liquid having an excessively high concentration of the sedimentation component may be trapped. This configuration accordingly stabilizes the concentration of the liquid that is supplied from the liquid supply port 280 of the cartridge 120*b*. The rib 346R may not be necessarily provided below all the sub-partition walls 346, but is to be provided between bottoms of at least one pair of sub-chambers 322 adjoining to each other.

Figure 47:
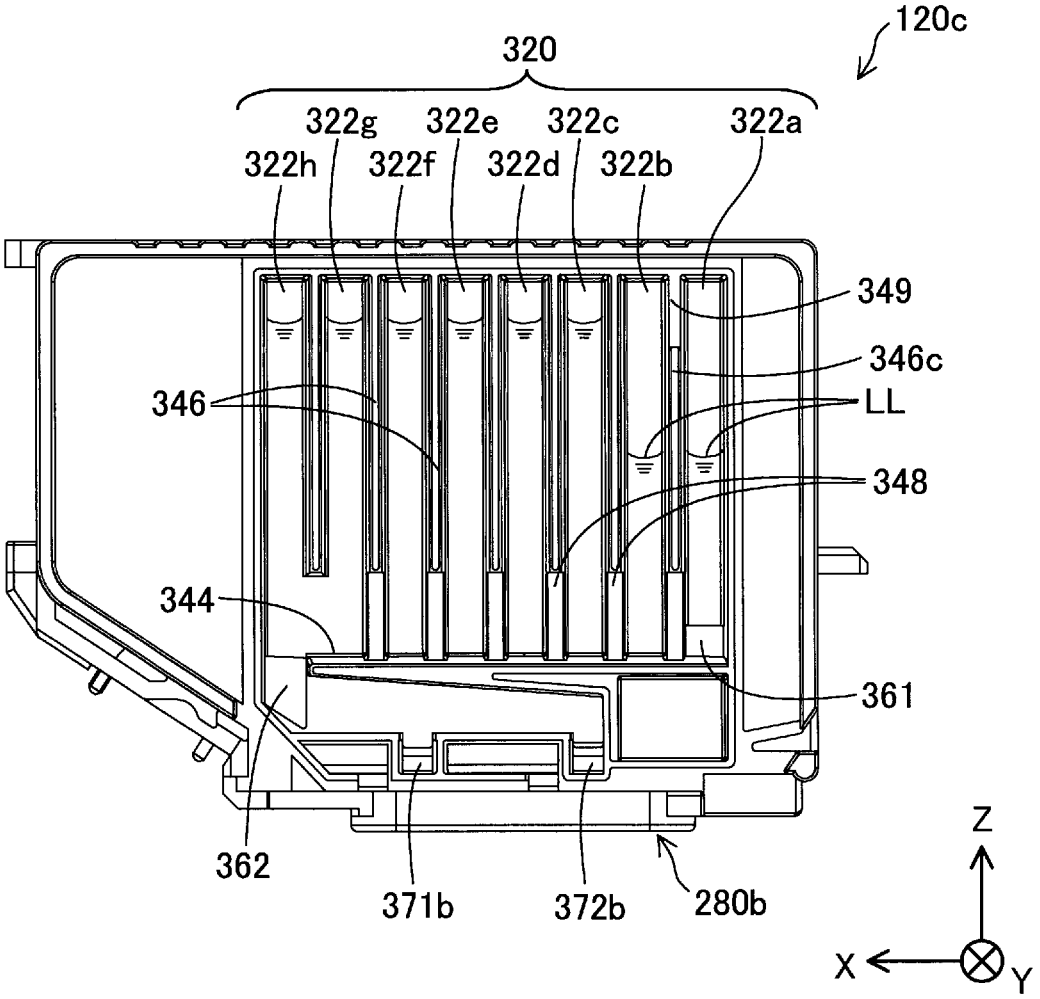
FIG. 47 is a diagram illustrating a second chamber of a cartridge according to a fourth embodiment.

FIG. 47 illustrates the configuration of a second chamber 320 of a large-size cartridge 120*c* according to a fourth embodiment. The cartridge 120*c* of the fourth embodiment differs from the cartridge 120 of the first embodiment by the following point, but the other configuration is the same with that of the cartridge 120 of the first embodiment:

(1) A connecting path 349 is formed by cutting out an upper end of a sub-partition wall 346*c* between the first two sub-chambers 322*a* and 322*b*.

In this cartridge 120*c*, when the liquid in the second chamber 320 decreases, the liquid levels LL decrease at the same heights in the first two sub-chambers 322*a* and 322*b*. The subsequent change in amount of the liquid is similar to the first embodiment. As understood from this example, the connecting path 349 may be provided in the vicinity of the upper ends of the adjoining sub-chambers 322 to connect these sub-chambers 322 with each other. The connecting path 349 may be provided in the vicinity of the upper ends of all the sub-partition walls 346, but it is preferable that the connecting path 349 is not provided from the viewpoint of preventing production of air bubbles. From the viewpoint of making it unlikely that air bubbles reach the liquid supply port 280, it is preferable that the connecting path 349 is not provided in the vicinity of the upper ends of the two most downstream-side sub-chambers 322*g* and 322*h*.

Figure 48:
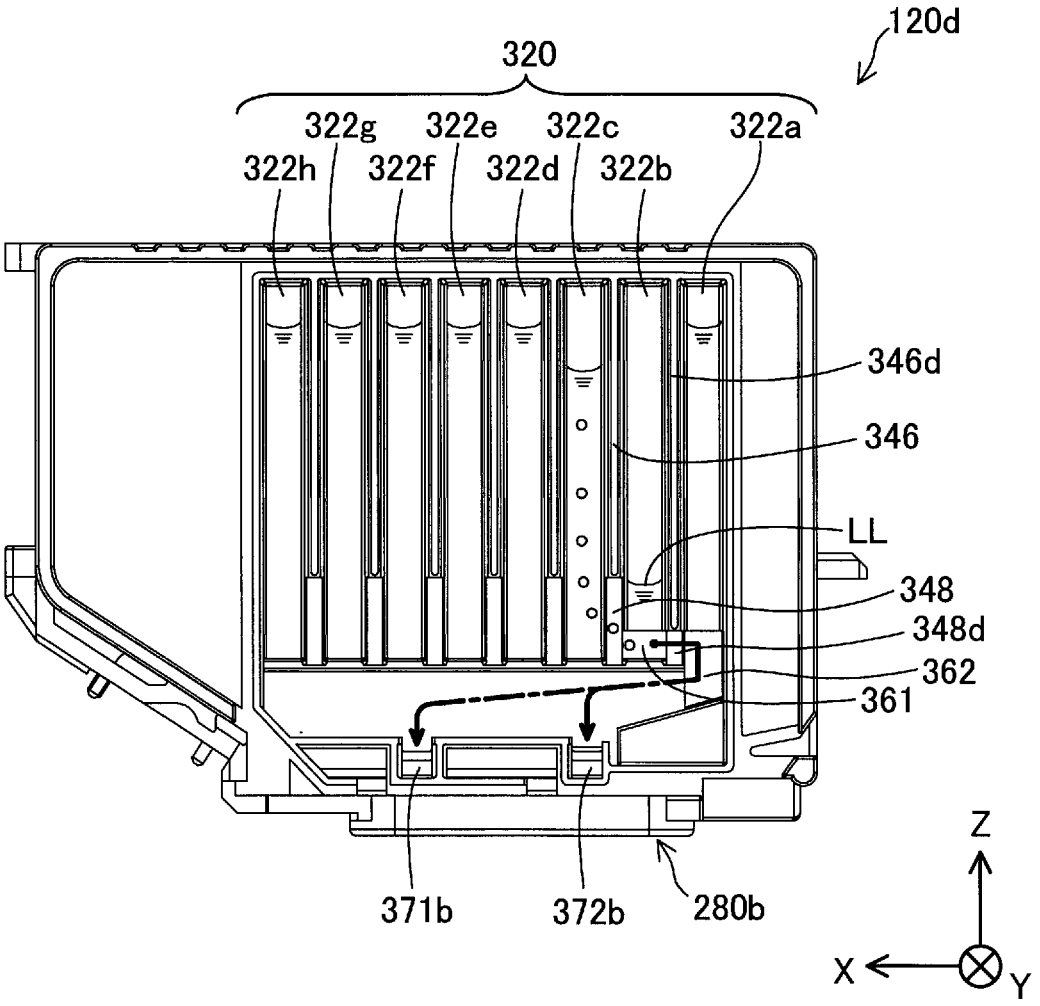
FIG. 48 is a diagram illustrating a second chamber of a cartridge according to a fifth embodiment.

FIG. 48 illustrates the configuration of a second chamber 320 of a large-size cartridge 120*d* according to a fifth embodiment. The cartridge 120*d* of the fifth embodiment differs from the cartridge 120 of the first embodiment by the following three points, but the other configuration is the same with that of the cartridge 120 of the first embodiment:

(1) The connecting hole 361 between the first chamber 310 and the second chamber 320 is provided in the bottom of the second sub-chamber 322*b*.

(2) The outlet 362 of the liquid from the second chamber 320 is provided below the first sub-chamber 322*a*.

(3) The dimension in the Z direction of a sub-partition wall 346*d* between the first two sub-chambers 322*a* and 322*b* is shorter than those of the other sub-partition walls 346, and the dimension in the Z direction of an inflow-outflow portion 348*d* provided below this sub-partition wall 346*d* is longer than those of the other inflow-outflow portions 348.

FIG. 48 illustrates the state that the air flows from the first chamber 310 into the sub-chambers 322 in the second chamber 320. More specifically, FIG. 48 illustrates the state that the liquid in the second sub-chamber 322*b* provided above the connecting hole 361 is consumed first, and the liquid level LL in the second sub-chamber 322*b* falls to the upper end position of the inflow-outflow portion 348 between the second sub-chamber 322*b* and the third sub-chamber 332*c*. In this state, when the air is flowed into the second chamber 320, the air flows into the third sub-chamber 322*c* and the liquid level in the third sub-chamber 322*c* falls. After the liquid in the third and subsequent sub-chambers 322*c* to 322*h* is sequentially consumed, the liquid in the first sub-chamber 322*a* located above the outlet 362 of the liquid from the second chamber 320 is consumed last. In the description hereof, the expression of "consuming the liquid in the sub-chamber 322" means that the liquid level in the sub-chamber 322 falls.

As described above, the fifth embodiment is configured such that the liquid in the sub-chamber 322*b* closest to the connecting hole 361 provided to connect the first chamber 310 with the second chamber 320 is consumed first among the plurality of sub-chambers 322 and that the liquid in the sub-chamber 322*a* closest to the outlet 362 of the liquid from the second chamber 320 is consumed last. Even when the connecting hole 361 and the outlet 362 of the liquid from the second chamber 320 are provided at physically close positions, this configuration causes the liquid in the sub-chamber 322*a* closes to the outlet 362 of the liquid from the second chamber 320 to be consumed last and thereby makes it unlikely that air bubbles reach the liquid supply port 280. The configuration "that the liquid in the sub-chamber 322*b* closest to the connecting hole 361 provided to connect the first chamber 310 with the second chamber 320 is consumed first among the plurality of sub-chambers 322 and that the liquid in the sub-chamber 322*a* closest to the outlet 362 of the liquid from the second chamber 320 is consumed last" is also implemented by the first to the fourth embodiments described above. In this configuration, it is preferable that the number of the sub-chambers 322 is three or more.

Figure 49:
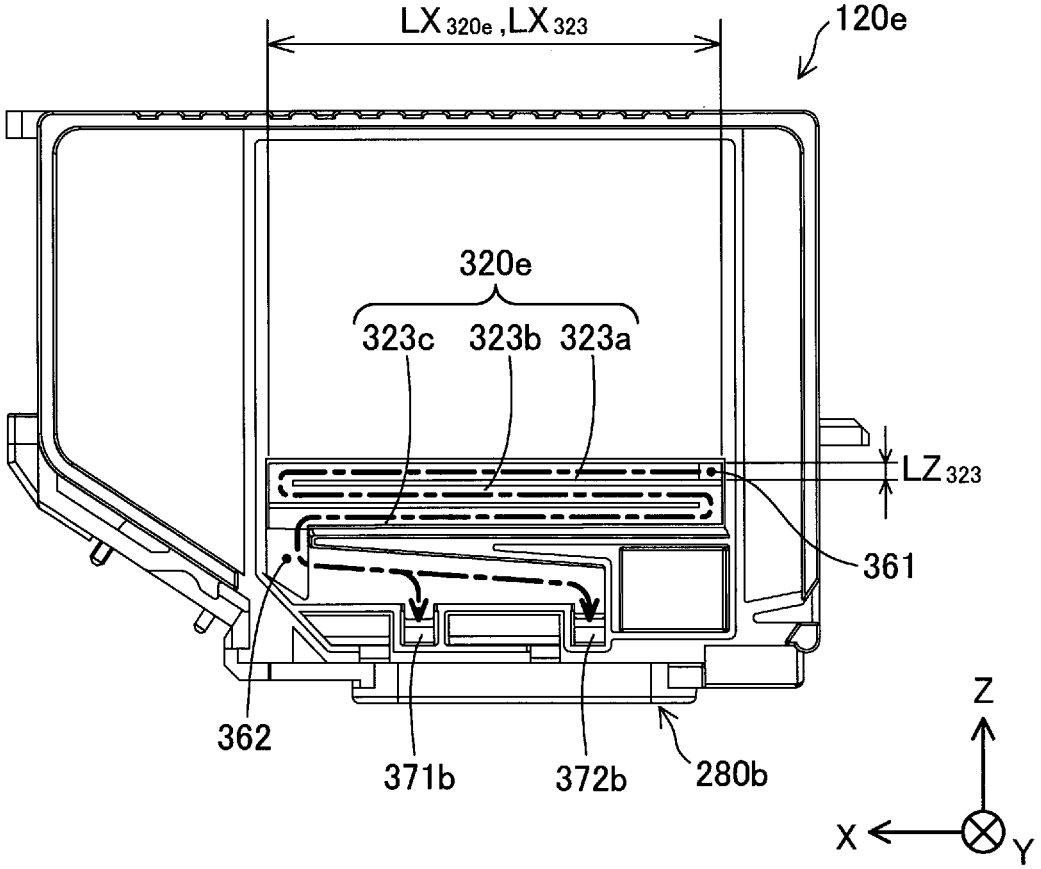
FIG. 49 is a diagram illustrating a second chamber of a cartridge according to a sixth embodiment.

FIG. 49 illustrates the configuration of a second chamber 320*e* of a large-size cartridge 120*e* according to a sixth embodiment. The cartridge 120*e* of the sixth embodiment differs from the cartridge 120 of the first embodiment by the following point, but the other configuration is the same with that of the cartridge 120 of the first embodiment:

(1) A plurality of sub-chambers 323*a* to 323*c* in the second chamber 320*e* are provided as spaces elongated in the X direction and are arrayed along the Z direction. The flow path between the connecting holes 361 and 362 forms a turning flow path (or serpentine flow path) including straight flow paths formed by the plurality of sub-chambers 323*a* to 323*c* and turns on their respective ends.

A dimension $LX_{320e}$ of this second chamber 320*e* in the X direction is equal to a dimension $LX_{323}$ of the sub-chamber 323 in the X direction and is smaller than the dimension $LX_{310}$ of the first chamber 310 in the X direction (see FIG. 17). A dimension $LZ_{323}$ of the sub-chamber 323 in the Z direction is smaller than the dimension $LX_{323}$ of the sub-chamber 323 in the X direction. The sub-chambers 323 having the dimension $LZ_{323}$ in the Z direction smaller than the dimension $LX_{323}$ in the X direction can serve as a trap flow path of air bubbles. Even when air bubbles are produced, this configuration makes it unlikely that the air bubbles reach the liquid supply port 280. Although not being specifically illustrated, it is preferable that a dimension of the sub-chamber 323 in the Y direction is set to be larger than the dimension $LX_{323}$ of the sub-chamber 323 in the X direction. This configuration enables a larger volume of the liquid to be contained in the sub-chamber 323, while suppressing the ripple of the liquid in the sub-chamber 323.

In the configuration that the flow path between the connecting holes 361 and 362 is formed as such a turning flow path, it is preferable that the entire turning flow path has an approximately constant flow passage area (for example, within a range of average value±20%). It is also preferable that the flow path between the connecting holes 361 and 362 is formed near the bottom of the second chamber 320*e*. This configuration causes air bubbles to be accumulated in the vicinity of the upper end of the second chamber 320*e* and makes the air bubbles less likely to flow down and thereby provides such an advantage that air bubbles are more unlikely to reach the liquid supply port 280.

Figure 50:
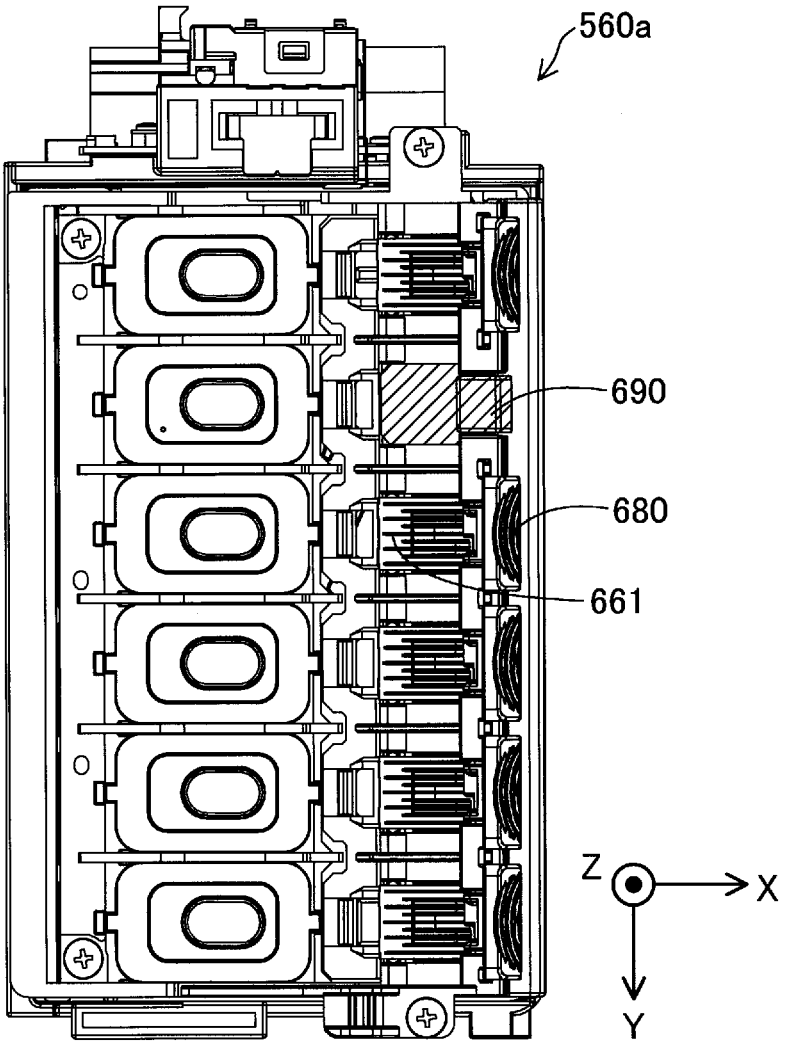
FIG. 50 is a plan view illustrating a holder according to a seventh embodiment.
Figure 51:
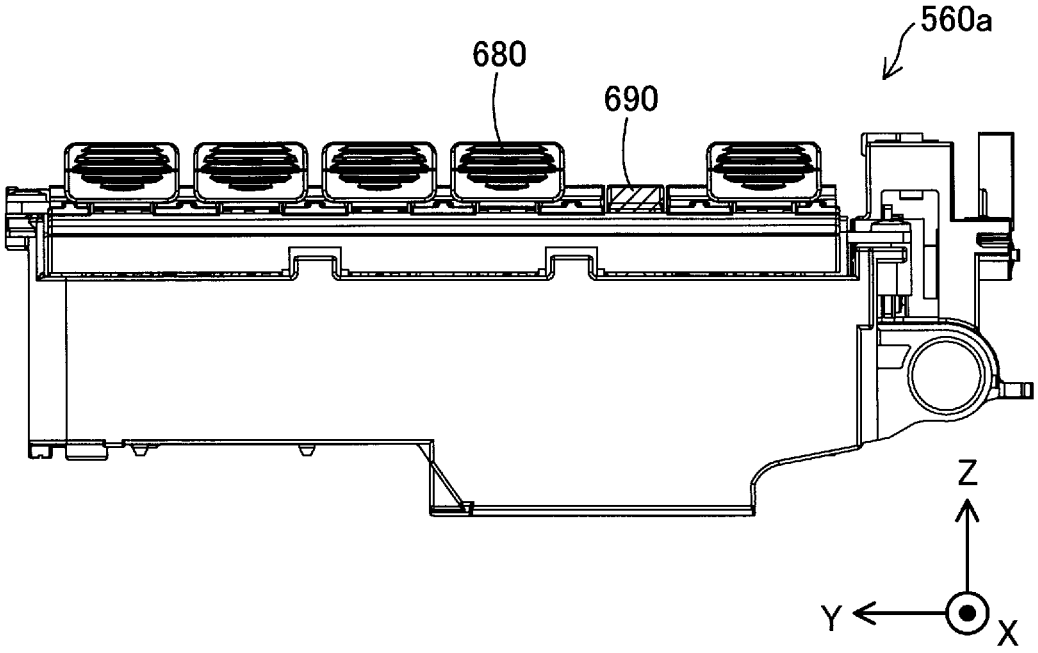
FIG. 51 is a side view illustrating the holder of FIG. 50.

FIG. 50 is a plan view illustrating a holder 560*a* according to a seventh embodiment, and FIG. 51 is a side view illustrating the holder 560*a*. In the seventh embodiment, one of the two levers 680 and one of the two electrode portions 661 that are provided in the slot position (see FIG. 5) where the large-size cartridge 120 is to be mounted are removed from the holder 560*a*, and a cover 690 is placed to cover a holder region where the lever 680 and the electrode portion 661 are removed. In FIG. 50 and FIG. 51, the cover 690 is shown by hatching. The reason why the lever 680 and the electrode portion 661 are removed is that the large-size cartridge 120 (see FIG. 8) is provided with only one cartridge-side restriction structure 210 that is engaged with the lever 680 and is provided with only one substrate 115 that is electrically connectable with the electrode portion 661.

In the seventh embodiment, the unnecessary lever 680 is removed. The user can thus readily press the lever 680 for releasing engagement of the cartridge 120 without question in the process of detaching the cartridge 120 from the holder 560*a*. Additionally, the electrode portion 661 is covered by the cover 690. this reduces the possibility of an undesired short circuit in the unused electrode portion 661.

Figure 52:
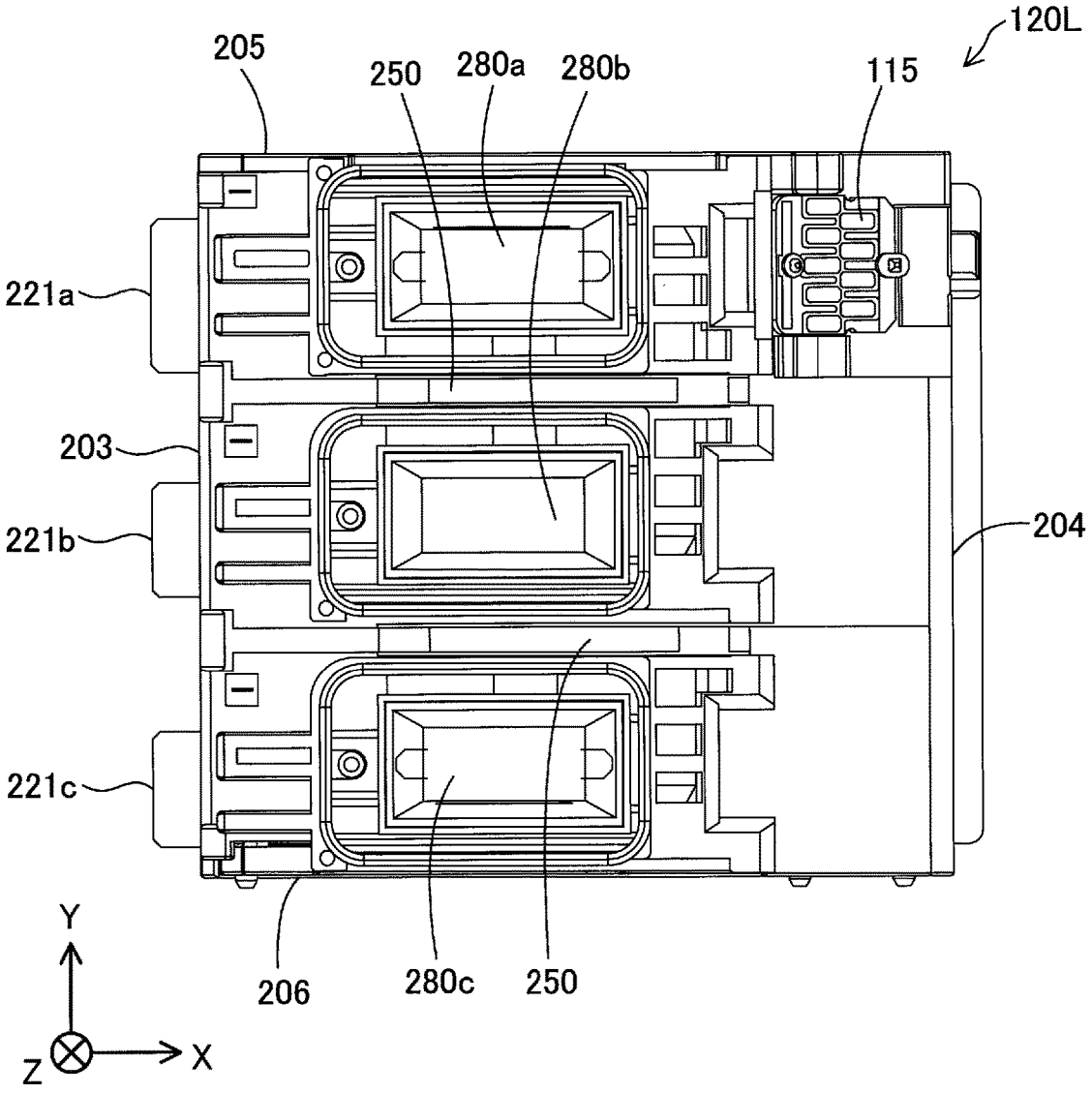
FIG. 52 is a bottom view illustrating a cartridge according to an eighth embodiment.

FIG. 52 is a bottom view illustrating the configuration of a cartridge 120L according to an eighth embodiment. The cartridge 120L of the eighth embodiment differs from the cartridge 120 of the first embodiment by the following points, but the other configuration is the same with that of the cartridge 120 of the first embodiment:

(1) A dimension of the cartridge 120L in the Y direction is approximately three times that of the small-size cartridge 120S.

(2) The cartridge 120L is provided with three liquid supply ports 280*a*, 280*b* and 280*c* and two grooves 250 formed therebetween.

(3) Three cartridge-side restriction structures 221*a*, 221*b* and 221*c* are formed in the third wall portion 203.

One cartridge 120L is placed across three slots of the holder 560. Although the internal configuration of the cartridge 120L is omitted, it is preferable that the first chamber 310 (see FIG. 17) is provided on the side near to the fifth wall portion 205 (or first side wall 205) and that the second chamber 320 (see FIG. 18) is provided on the side near to the sixth wall portion 206 (or second side wall 206). A preferable configuration is that the three liquid supply ports 280*a*, 280*b* and 280*c* are all connected with the downstream side of the second chamber 320.

In an embodiment, a cartridge including four or more liquid supply ports 280 may be provided. As understood from this example, the large-size cartridge may be configured to include two or more liquid supply ports 280.

In another embodiment, a configuration similar to the inner configuration of the large-size cartridge 120 may be employed for the small-size cartridge 120S including one liquid supply port 280 (see FIG. 31). More specifically, the inside of the small-size cartridge 120S may be parted into the first chamber 310 and the second chamber 320 by the partition wall 330, and the small-size cartridge 120S may be configured such that the liquid in the first chamber 310 is flowed from the connecting hole 361 between the first chamber 310 and the second chamber 320 into the second chamber 320 and is introduced through the sub-chambers 322 of the second chamber 320 into the liquid supply port 280. This configuration suppresses production of air bubbles in the small-size cartridge 120S.

Figure 53:
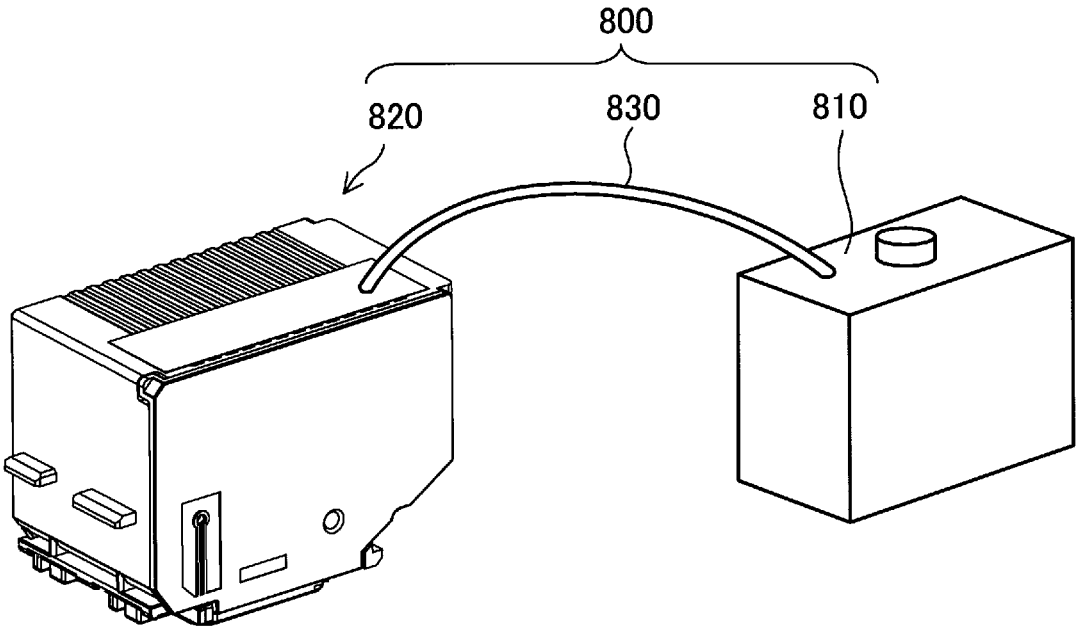
FIG. 53 is a diagram illustrating the configuration of a liquid supply unit according to a ninth embodiment.

FIG. 53 is a diagram illustrating the configuration of a liquid supply unit 800 according to a ninth embodiment. This liquid supply unit 800 includes a liquid bottle 810, a cartridge 820 and a liquid supply tube 830. The cartridge 820 has a similar configuration to that of the large-size cartridge 120 of the first embodiment, except that the liquid supply tube 830 is connected with the cartridge 120.

The liquid supply tube 830 connects the liquid bottle 810 with the first chamber 310 (see FIG. 17) included in the cartridge 820. A liquid (or ink) is contained in the liquid bottle 810. The liquid bottle 810 may be appropriately refilled with the liquid. The liquid bottle 810 is placed outside of the printer 150. The liquid contained in the liquid bottle 810 is supplied through the liquid supply tube 830 to the first chamber 310 in the cartridge 820. This configuration of the liquid supply unit 800 may be regarded as external extension of the liquid chamber of the large-size cartridge 120 according to the first embodiment. The respective components of the cartridge 820 have similar configurations to those of the cartridge 120 of the first embodiment, so that this liquid supply unit 800 has similar functions and advantageous effects to those of the first embodiment.

E. Modifications

The disclosure is not limited to any of the embodiments and the modifications described above but may be implemented by a diversity of other aspects without departing from the scope of the disclosure. Some of possible modifications are given below.

Modification 1

In the above embodiments, as long as the first wall portion 201 to the seventh wall portion 207 are assembled to constitute the cartridge 120, their externally facing parts and internally facing parts may not be necessarily flat but may include some unevenness. In the above embodiments, the cartridge 120 is constituted by the seven wall portions 201 to 207. The number of wall portions constituting the cartridge 120 is, however, not limited to seven, as long as the wall portions are arranged to define a space for containing ink inside thereof. For example, the cartridge 120 may be constituted by six or a less number of wall portions or may be constituted by eight or a greater number of wall portions. The cartridge 120 may also be constituted by one or more spherical or curved wall portions. The cartridge 120 may further be constituted by a combination of curved wall portions and plate-like wall portions.

Modification 2

The configuration of the cartridge (or liquid container) according to each of the embodiments described above may be divided into a liquid container member and an adapter. The adapter is provided with various engagement members to be engaged with the holder of the cartridge and is configured as a member to receive the liquid container body in a separable manner. In this modification, a preferable configuration is that the liquid container body is provided with a liquid chamber and a liquid containing port, and the adapter is provided with a substrate including a memory device.

Modification 3

The disclosure is not limited to the inkjet printer or the ink cartridge thereof but is also applicable to any liquid ejection apparatuses consuming liquids other than ink and cartridges (or liquid containers) used for such liquid ejection apparatuses. For example, the disclosure may be applied to cartridges used for various liquid ejection apparatuses described below:

(1) image recording apparatus such as facsimile machine;

(2) color material ejection apparatus used for manufacturing color filters for image display apparatuses such as liquid crystal displays;

(3) electrode material ejection apparatus used for forming electrodes of, for example, organic EL (electroluminescence) displays and field emission displays (FED);

(4) liquid ejection apparatus configured to eject a bioorganic material-containing liquid used for manufacturing biochips;

(5) sample ejection apparatus used as precision pipette;

(6) ejection apparatus of lubricating oil;

(7) ejection apparatus of resin solutions;

(8) liquid ejection apparatus for pinpoint ejection of lubricating oil on precision machines such as watches and cameras;

(9) liquid ejection apparatus configured to eject transparent resin solutions, such as ultraviolet curable resin solution, onto substrates to manufacture hemispherical microlenses (optical lenses) used for, for example, optical communication elements;

(10) liquid ejection apparatus configured to eject acidic or alkaline etching solutions to etch substrates and the like; and

(11) liquid ejection apparatus equipped with a liquid consuming head configured to eject a very small volume of droplets of any other liquid.

The "droplet" herein means the state of liquid ejected from the liquid ejection apparatus and may be in a granular shape, a teardrop shape or a tapered threadlike shape. The "liquid" herein may be any material consumable by the liquid ejection apparatus. The "liquid" may be any material in the liquid phase. For example, the "liquid" may be any material in the liquid phase. Liquid-state materials of high viscosity or low viscosity, sols, aqueous gels and other liquid-state materials including inorganic solvents, organic solvents, solutions, liquid resins and liquid metals (metal melts) are included in the "liquid". The "liquid" is not limited to the liquid state as one of the three states of matter but includes solutions, dispersions and mixtures of the functional solid material particles, such as pigment particles or metal particles, solved in, dispersed in or mixed with solvents. Typical examples of the liquid include ink described in the above embodiments and liquid crystal. The ink herein includes general water-based inks and oil-based inks, as well as various liquid compositions, such as gel inks and hot-melt inks.

What is claimed is:

1. A liquid container configured to be mounted to a carriage that reciprocates in an X direction, the liquid container comprising:

an upper wall and a bottom wall opposed to each other in a Z direction that crosses the X direction;

a first side wall and a second side wall opposed to each other in a Y direction that crosses the X direction and the Z direction;

a third side wall and a fourth side wall opposed to each other in the X direction;

a liquid supply port provided in the bottom wall;

a first chamber configured to contain a liquid therein;

a second chamber configured to contain the liquid therein and to include at least one sub-chamber having a smaller dimension in the X direction than a dimension in the X direction of the first chamber;

a partition wall configured to part the first chamber from the second chamber; and a connecting hole configured to connect the first chamber with the second chamber, wherein the second chamber is connected with the liquid supply port, the first chamber is connected with the liquid supply port via the connecting hole and the second chamber, and the liquid contained in the first chamber is flowed from the connecting hole into the second chamber and is subsequently introduced through the sub-chamber to the liquid supply port, the second chamber includes two or more sub-chambers, the two or more sub-chambers are arrayed in the X direction, and a rib extended in the Z direction is provided between bottoms of adjoining sub-chambers among the two or more sub-chambers.

2. The liquid container according to claim 1, wherein the first chamber is provided with an air introducing hole configured to introduce air from outside of the first chamber into the first chamber.

3. The liquid container according to claim 1, wherein a connecting flow path is provided between the liquid supply port and an outlet of the liquid from the second chamber to connect the liquid supply port with the outlet.

4. A liquid container configured to be mounted to a carriage that reciprocates in an X direction, the liquid container comprising:

an upper wall and a bottom wall opposed to each other in a Z direction that crosses the X direction;

a first side wall and a second side wall opposed to each other in a Y direction that crosses the X direction and the Z direction;

a third side wall and a fourth side wall opposed to each other in the X direction;

a liquid supply port provided in the bottom wall;

a first chamber configured to contain a liquid therein;

a second chamber configured to contain the liquid therein and to include at least one sub-chamber having a smaller dimension in the X direction than a dimension in the X direction of the first chamber;

a partition wall configured to part the first chamber from the second chamber; and a connecting hole configured to connect the first chamber with the second chamber, wherein the second chamber is connected with the liquid supply port, the first chamber is connected with the liquid supply port via the connecting hole and the second chamber, and the liquid contained in the first chamber is flowed from the connecting hole into the second chamber and is subsequently introduced through the sub-chamber to the liquid supply port, the second chamber includes two or more sub-chambers, the two or more sub-chambers are arrayed in the X direction, and the second chamber includes three or more sub-chambers and is configured such that the liquid in a specific sub-chamber among the three or more sub-chambers which is nearest to the connecting hole is consumed first and the liquid in another specific sub-chamber among the three or more sub-chambers which is nearest to an outlet of the liquid from the second chamber is consumed last.

5. The liquid container according to claim 4, wherein the first chamber is provided with an air introducing hole configured to introduce air from outside of the first chamber into the first chamber.

6. The liquid container according to claim 4, wherein a connecting flow path is provided between the liquid supply port and an outlet of the liquid from the second chamber to connect the liquid supply port with the outlet.

* * * * *